US010621917B2

(12) United States Patent
Asano

(10) Patent No.: US 10,621,917 B2
(45) Date of Patent: Apr. 14, 2020

(54) DISPLAY DEVICE, DRIVER CIRCUIT, AND DRIVING METHOD

(71) Applicant: Sony Corporation, Tokyo (JP)

(72) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/531,116

(22) PCT Filed: Oct. 27, 2015

(86) PCT No.: PCT/JP2015/080191
§ 371 (c)(1),
(2) Date: May 26, 2017

(87) PCT Pub. No.: WO2016/103896
PCT Pub. Date: Jun. 30, 2016

(65) Prior Publication Data

US 2017/0270866 A1 Sep. 21, 2017

(30) Foreign Application Priority Data

Dec. 22, 2014 (JP) ..... 2014-258526

(51) Int. Cl.
*G09G 3/3258* (2016.01)
*G09G 3/3233* (2016.01)
*G09G 3/3266* (2016.01)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ... G09G 2300/0814; G09G 2300/0819; G09G 2300/0871; G09G 2310/0213;
(Continued)

(56) References Cited

U.S. PATENT DOCUMENTS

2005/0001787 A1* 1/2005 Montgomery ..... G09G 3/003 345/6
2009/0122053 A1 5/2009 Yamamoto et al.
(Continued)

FOREIGN PATENT DOCUMENTS

JP 2009-122352 A 6/2009
JP 2009-237041 A 10/2009
(Continued)

*Primary Examiner* — Dmitriy Bolotin
(74) *Attorney, Agent, or Firm* — Michael Best & Friedrich LLP

(57) ABSTRACT

A display device of the disclosure includes a plurality of pixels and a driver. The driver unit makes scanning of pixels that belong to a plurality of pixel lines out of the plurality of pixels, in units of pixel line groups each of which is constituted by a predetermined number of the pixel lines, in a scanning order indicated by scanning ordinal numbers associated with the respective pixel line groups, to perform a write drive that includes writing a pixel voltage to each pixel. The scanning ordinal numbers are set to allow a sum of the scanning ordinal numbers of any two adjacent pixel line groups to approximate to a predetermined value.

12 Claims, 32 Drawing Sheets

(52) U.S. Cl.
CPC ..... *G09G 2300/0814* (2013.01); *G09G 2300/0819* (2013.01); *G09G 2300/0871* (2013.01); *G09G 2310/0213* (2013.01); *G09G 2310/0289* (2013.01); *G09G 2310/08* (2013.01); *G09G 2320/045* (2013.01); *G09G 2320/066* (2013.01)

(58) Field of Classification Search
CPC ..... G09G 2310/0289; G09G 2310/08; G09G 2320/045; G09G 2320/066; G09G 3/3233; G09G 3/3258; G09G 3/3266; H01L 51/05
See application file for complete search history.

(56) References Cited

U.S. PATENT DOCUMENTS

| | | | | |
|---|---|---|---|---|
| 2009/0244055 | A1* | 10/2009 | Asano ..... | G09G 3/3233 345/214 |
| 2009/0295423 | A1* | 12/2009 | Levey ..... | G09G 3/006 324/760.01 |
| 2011/0181626 | A1 | 7/2011 | Toyomura et al. | |
| 2017/0193926 | A1* | 7/2017 | de Greef ..... | G09G 3/348 |

FOREIGN PATENT DOCUMENTS

| | | | |
|---|---|---|---|
| JP | 2011-007842 | A | 1/2011 |
| JP | 2011-154237 | A | 8/2011 |
| JP | 2014-153531 | A | 8/2014 |
| WO | 2012/032559 | A1 | 3/2012 |

* cited by examiner

[ FIG. 1 ]
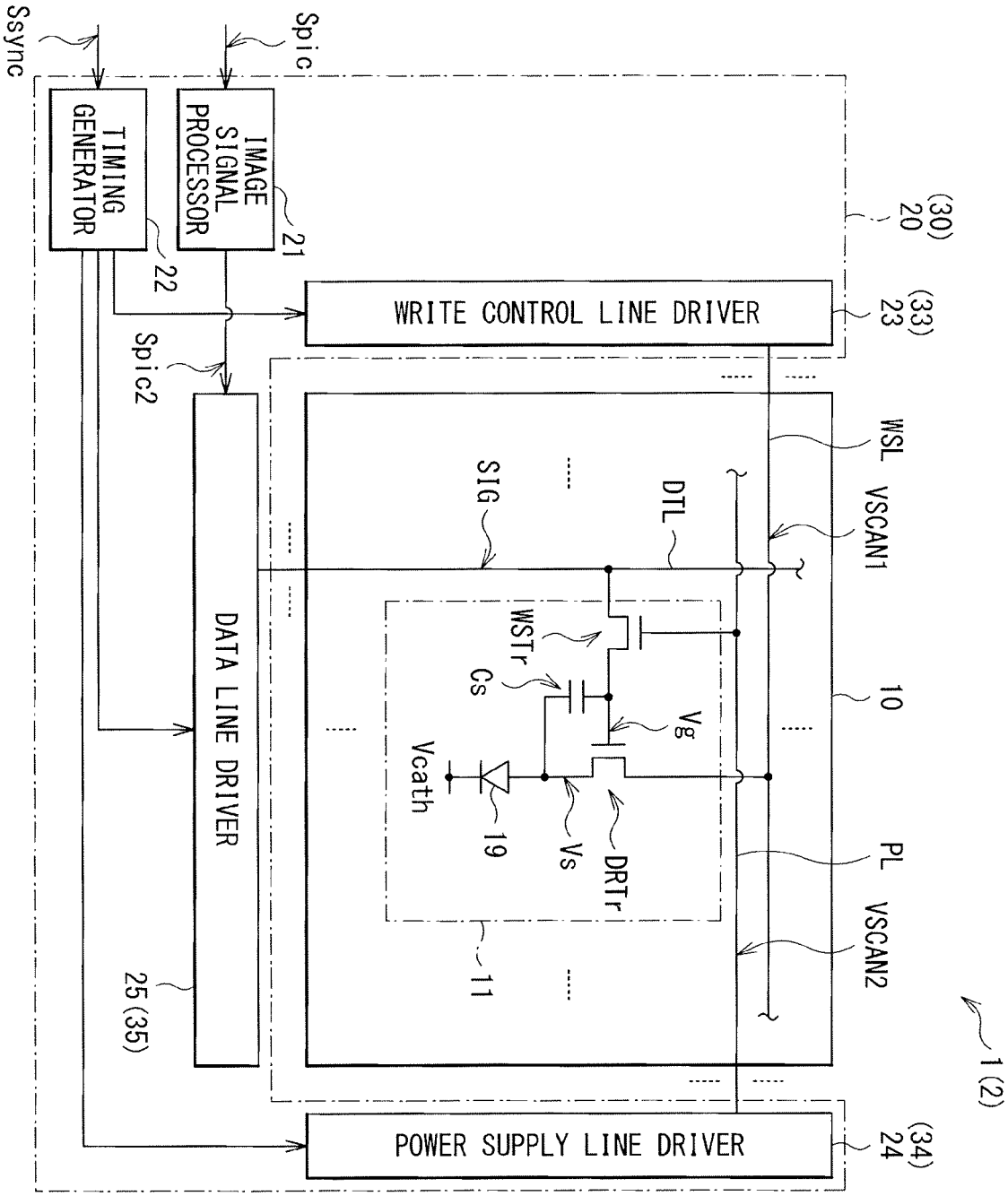

[ FIG. 2 ]
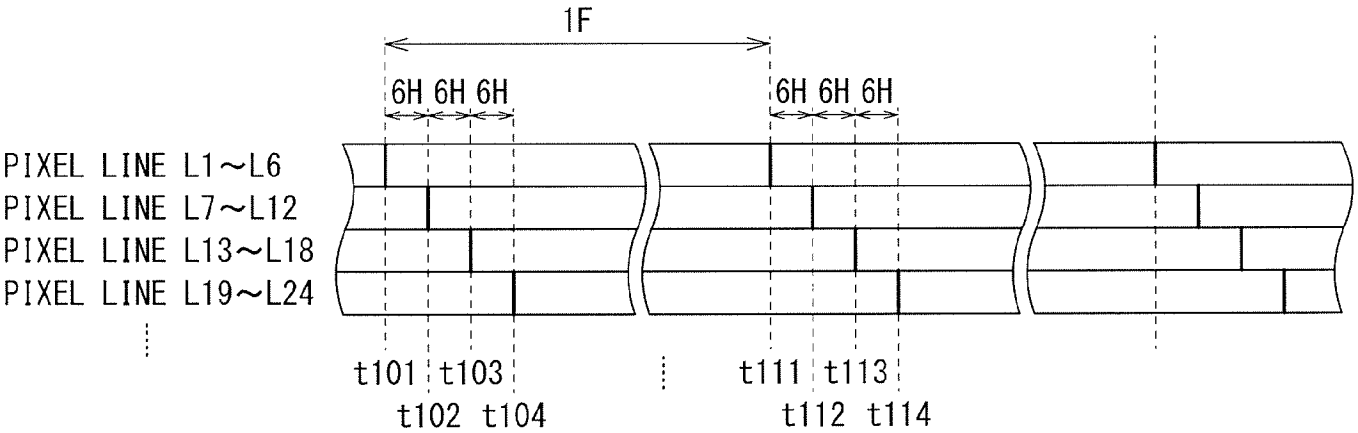

[ FIG. 3 ]
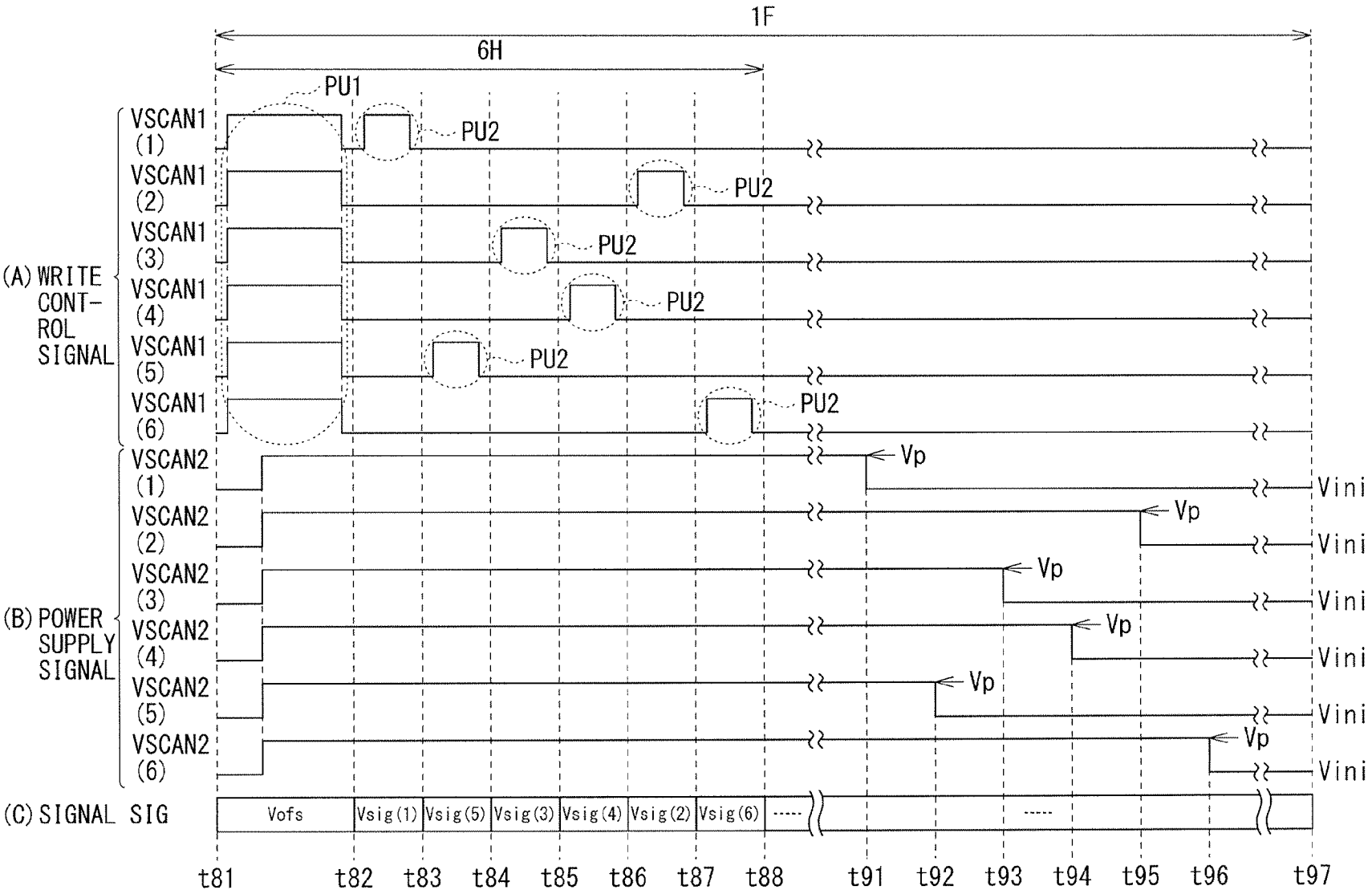

[ FIG. 4 ]
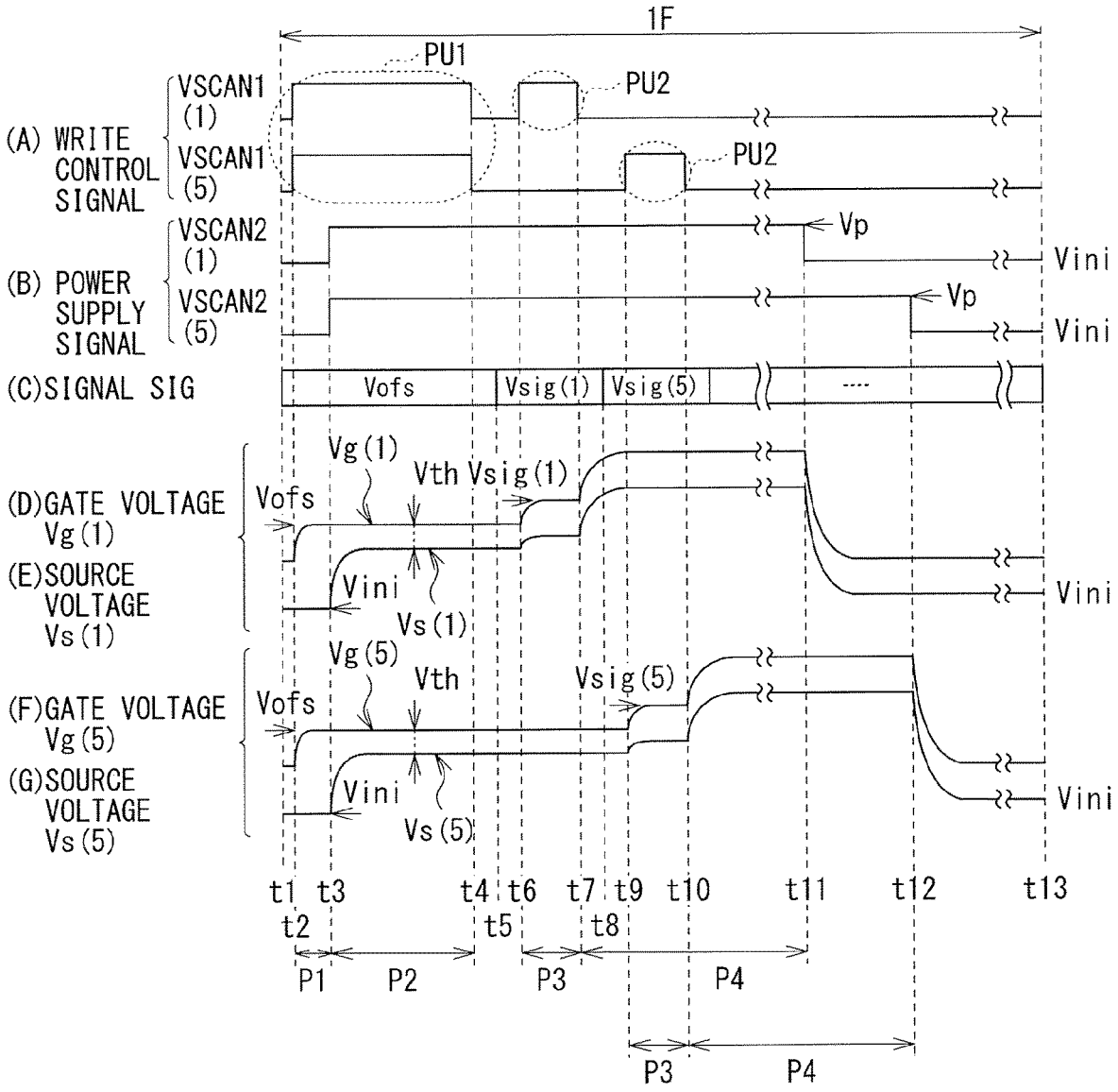

[ FIG. 5 ]
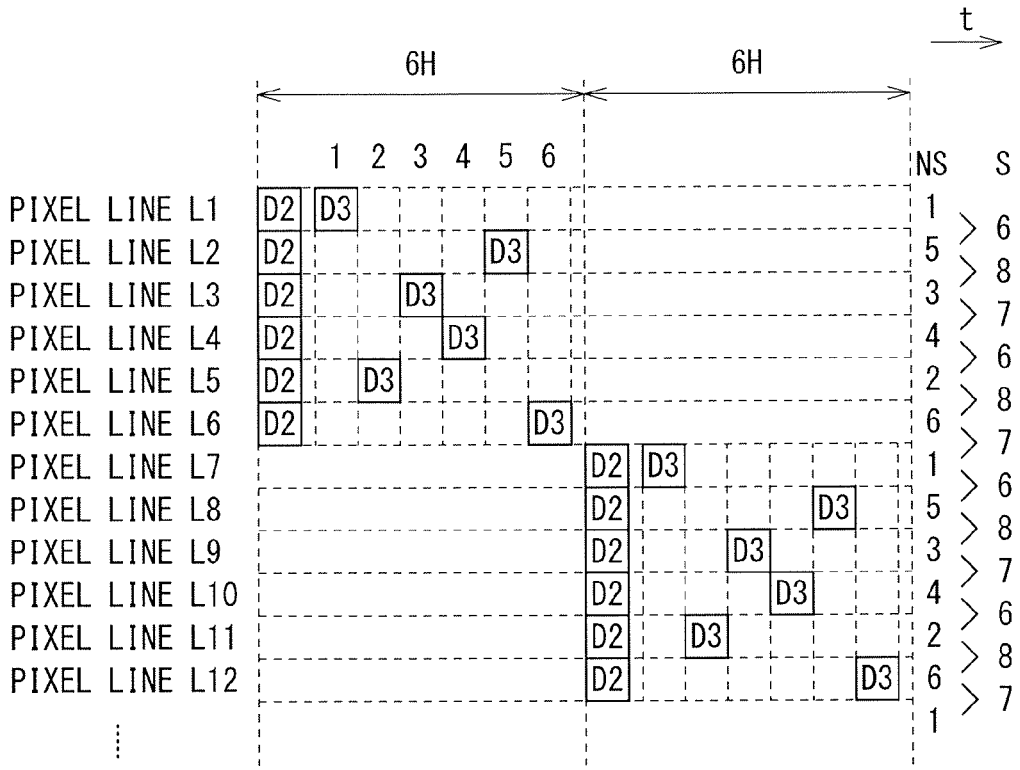
[ FIG. 6 ]
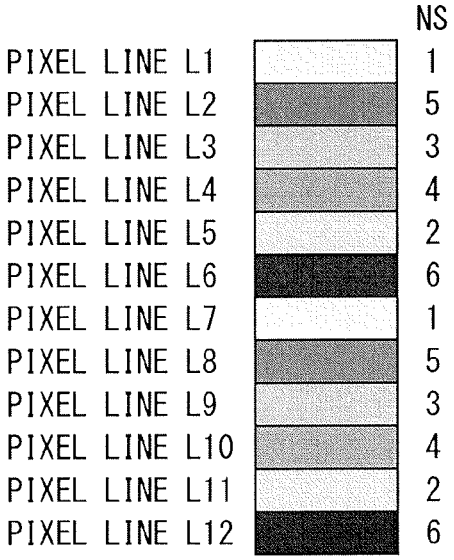

[ FIG. 7 ]
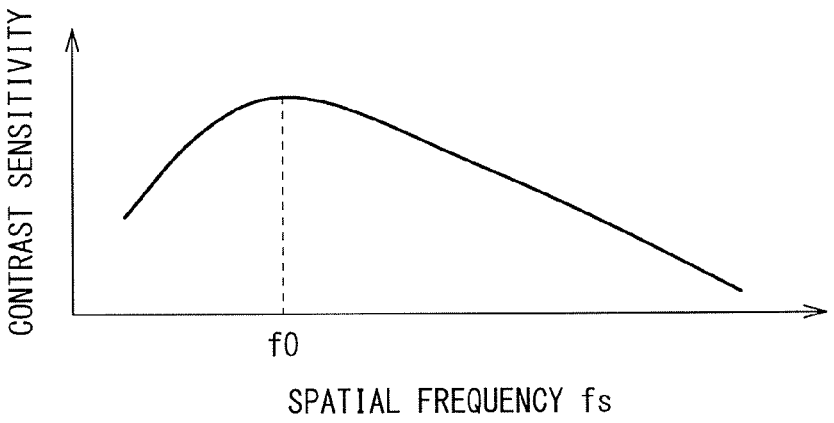
[ FIG. 8 ]
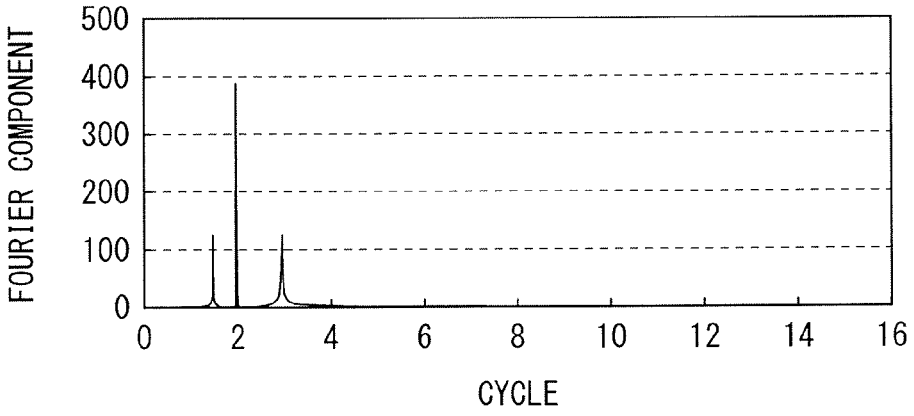

[ FIG. 9 ]
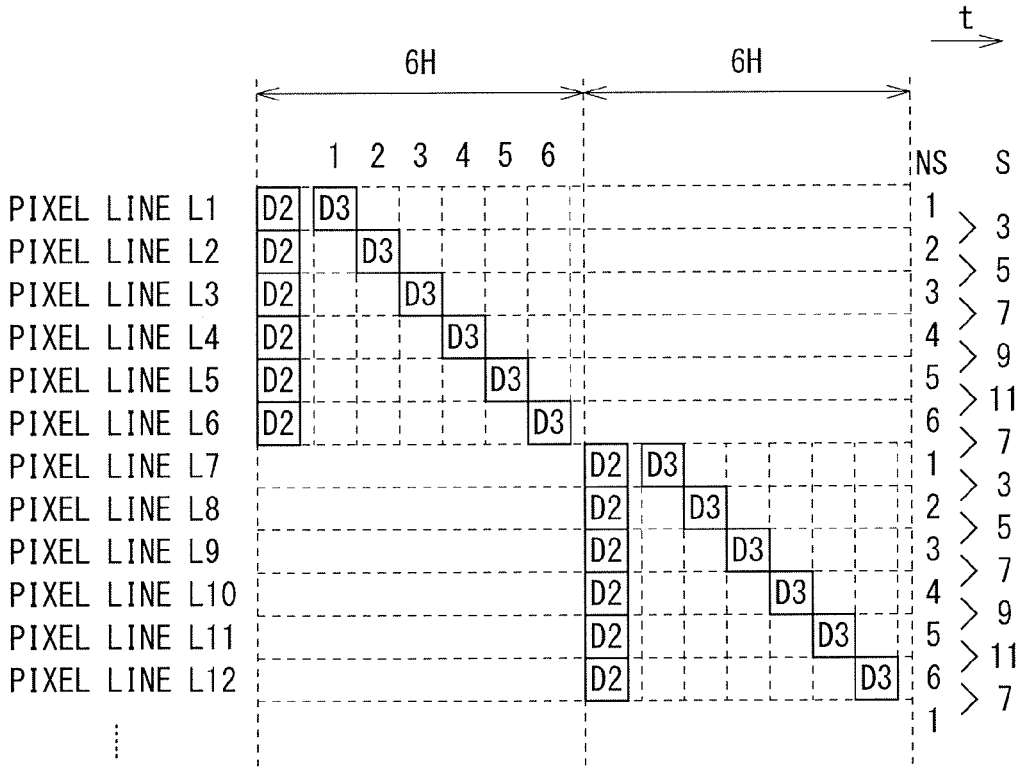
[ FIG. 10 ]
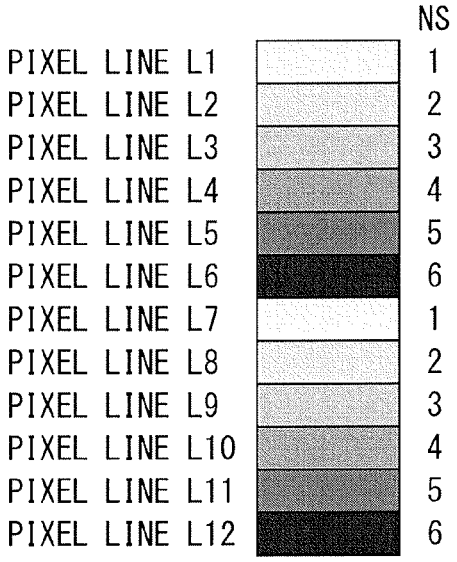

[ FIG. 11 ]
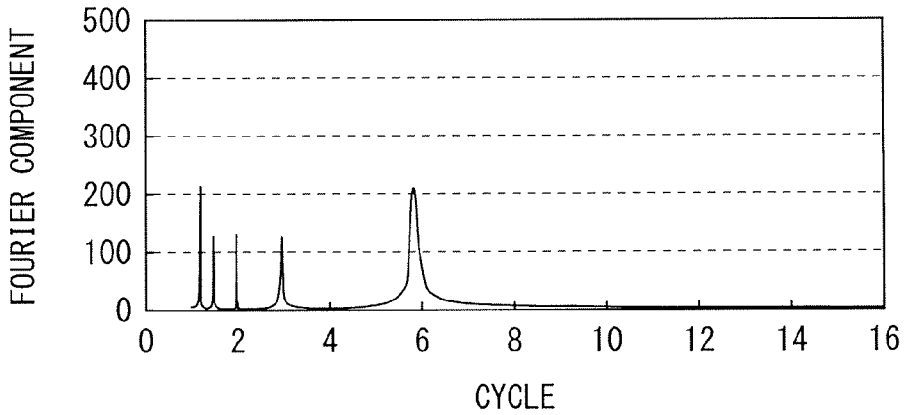
[ FIG. 12 ]
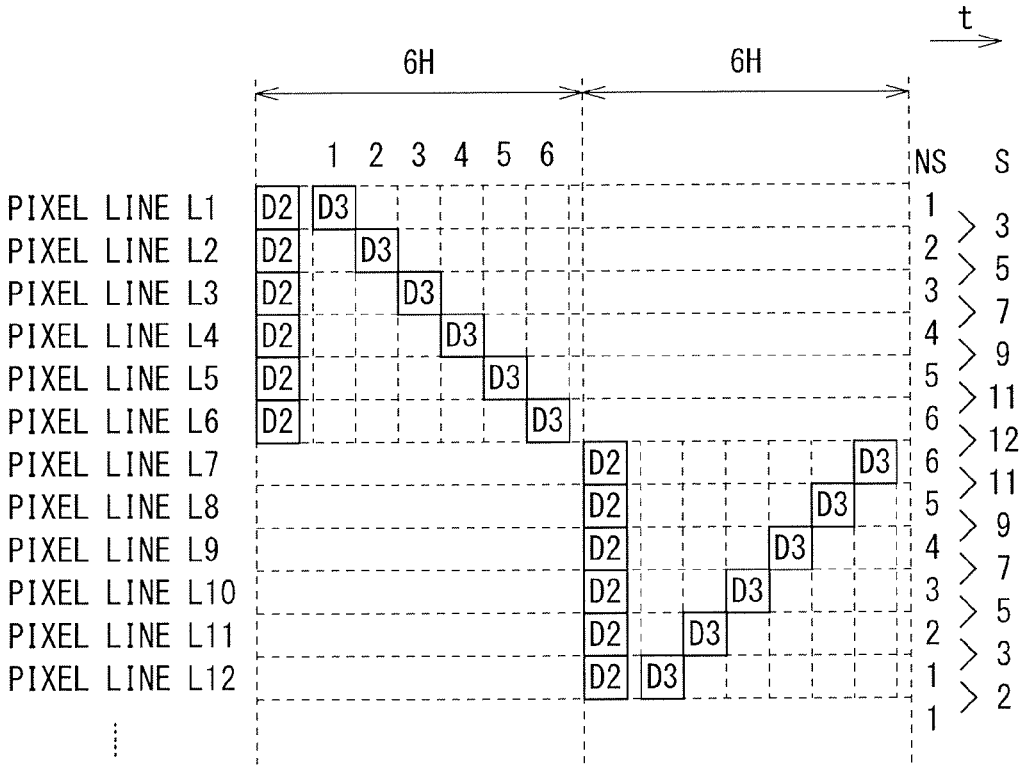

[ FIG. 13 ]
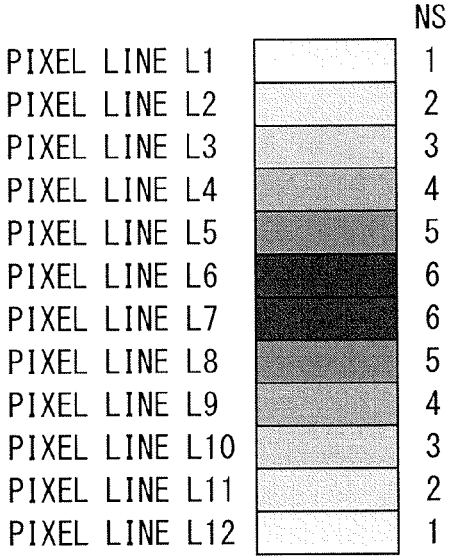
[ FIG. 14 ]
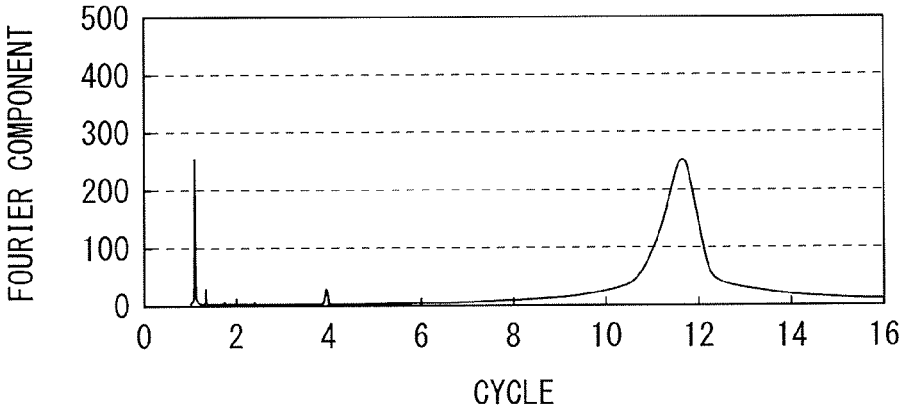

[ FIG. 15 ]
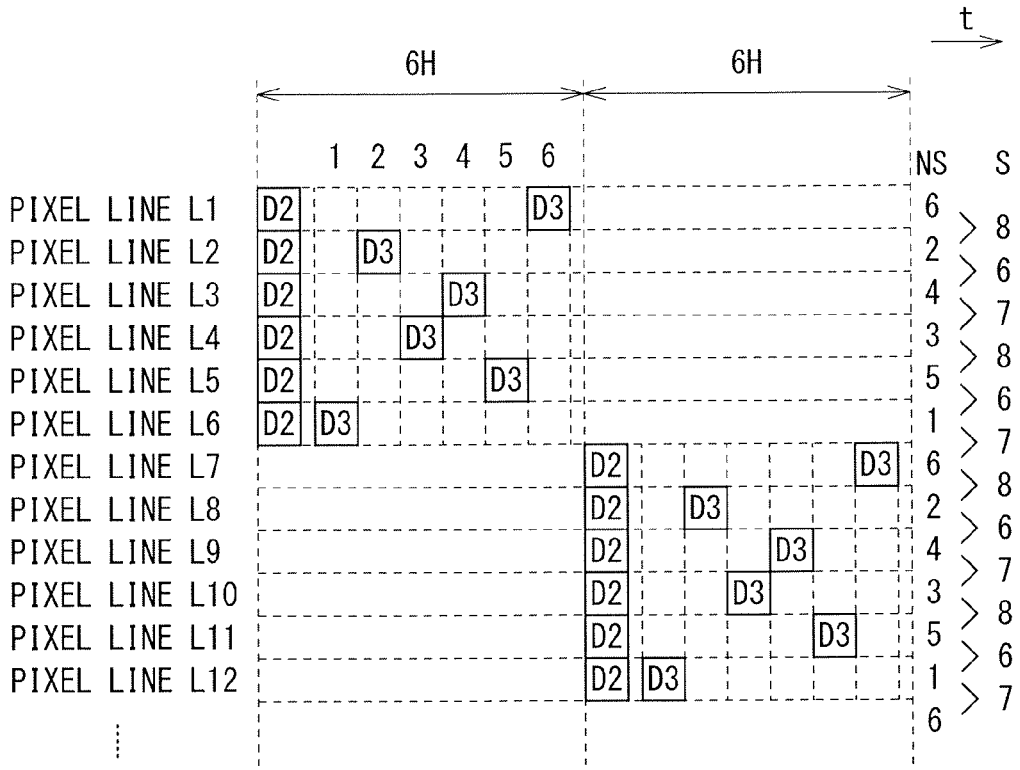
[ FIG. 16 ]
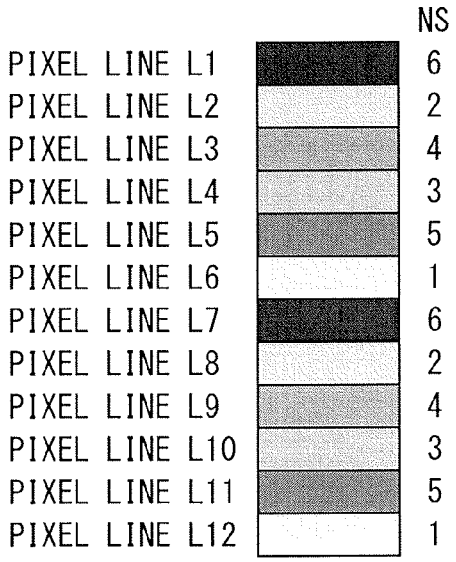

[ FIG. 17 ]
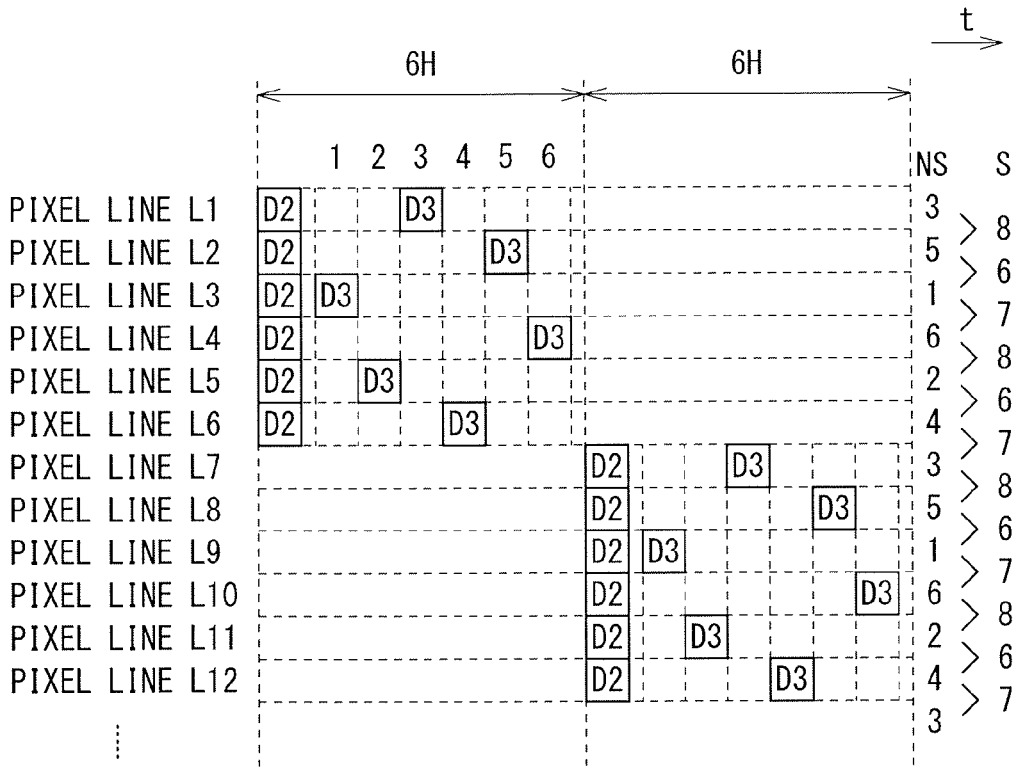
[ FIG. 18 ]
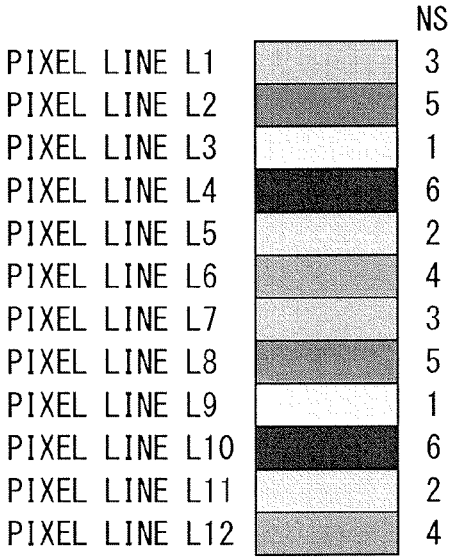

[ FIG. 19 ]
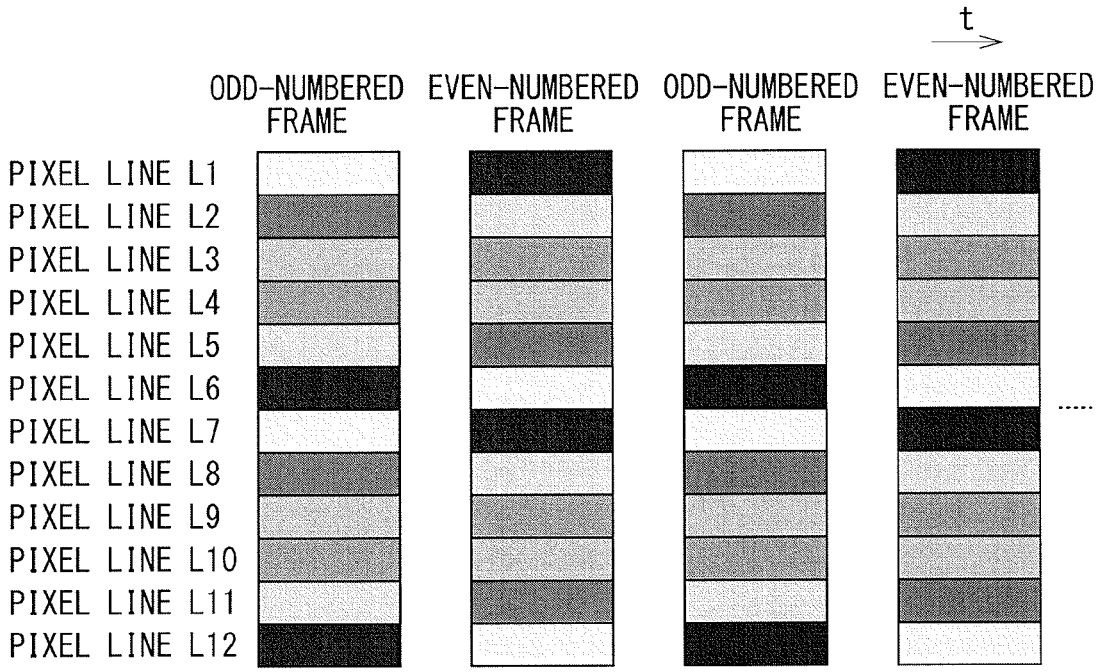
[ FIG. 20 ]
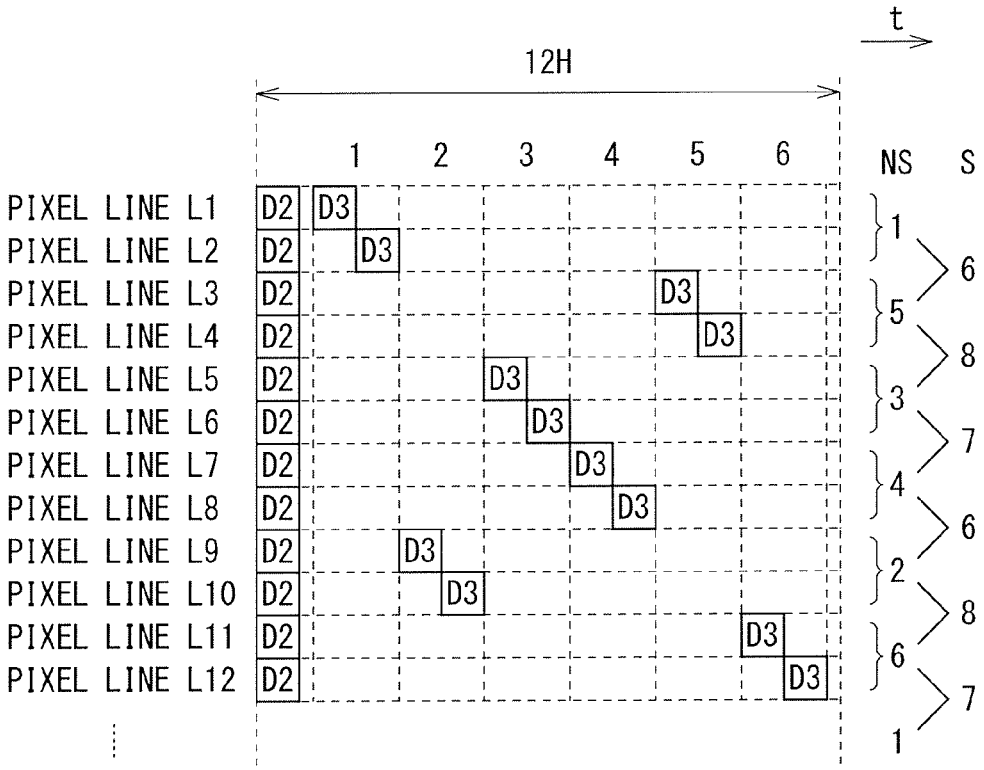

[ FIG. 21 ]
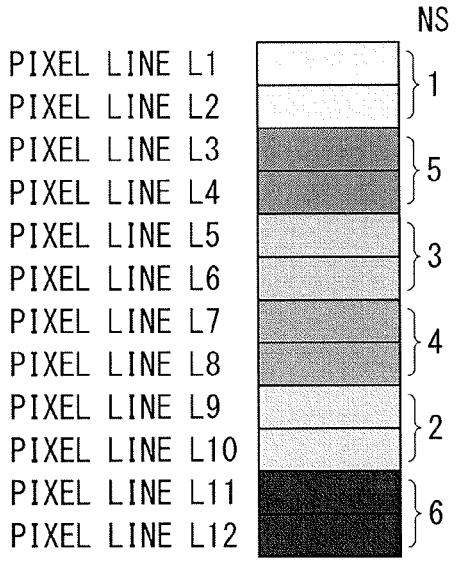
[ FIG. 22 ]
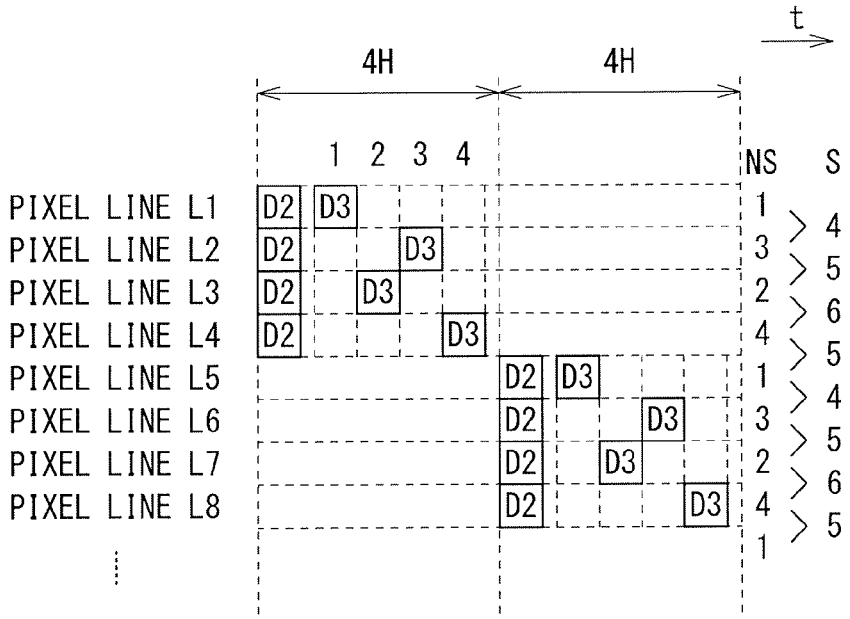

[ FIG. 23 ]
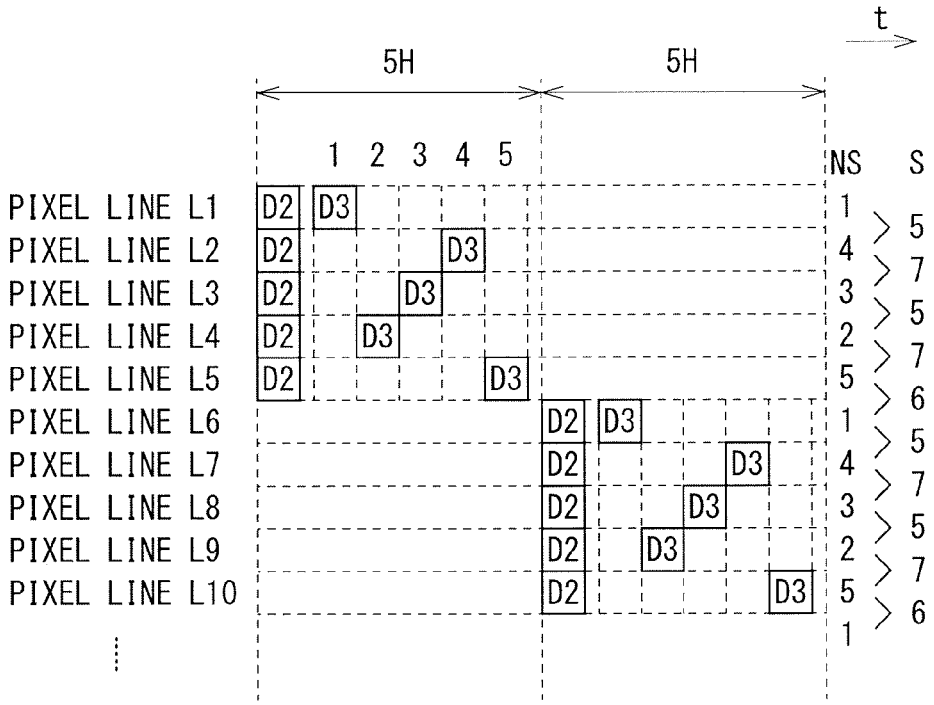
[ FIG. 24 ]
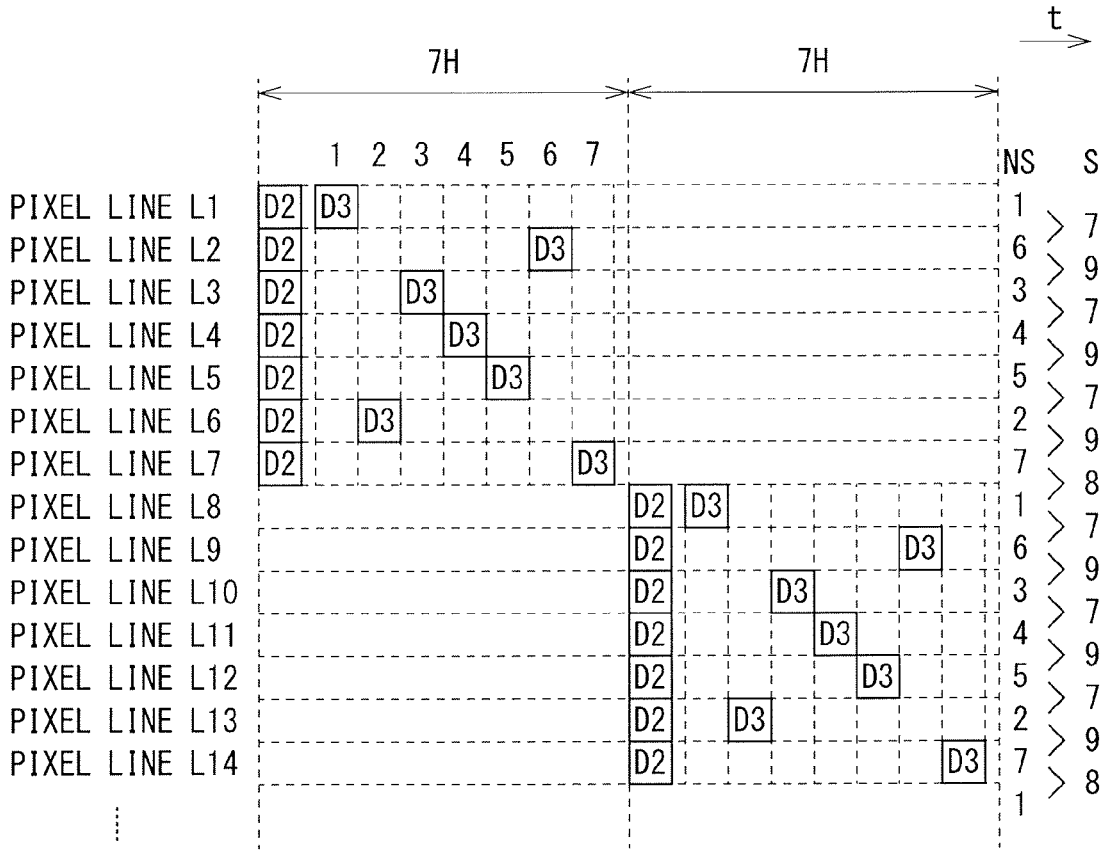

[ FIG. 25 ]
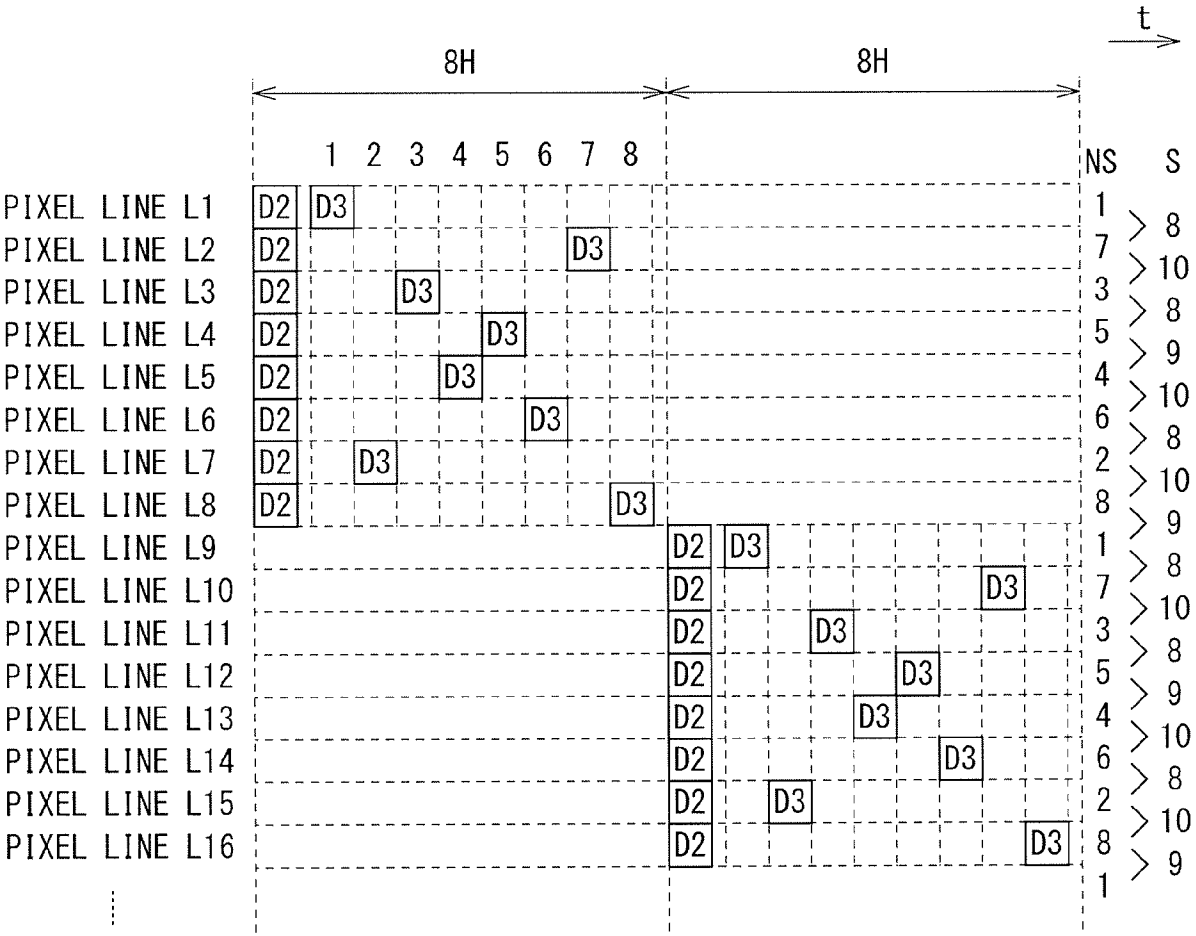

[ FIG. 26 ]
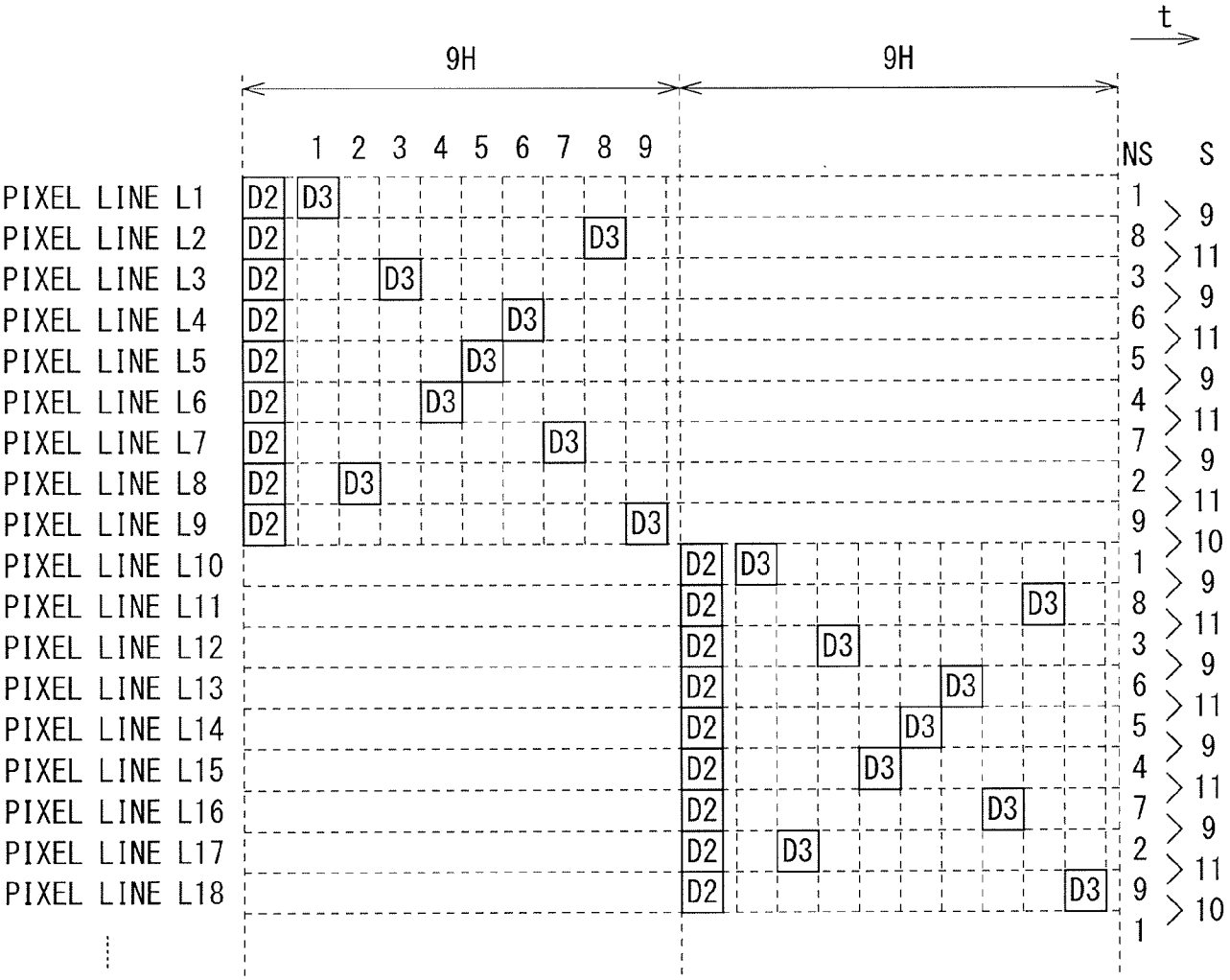

[ FIG. 27 ]
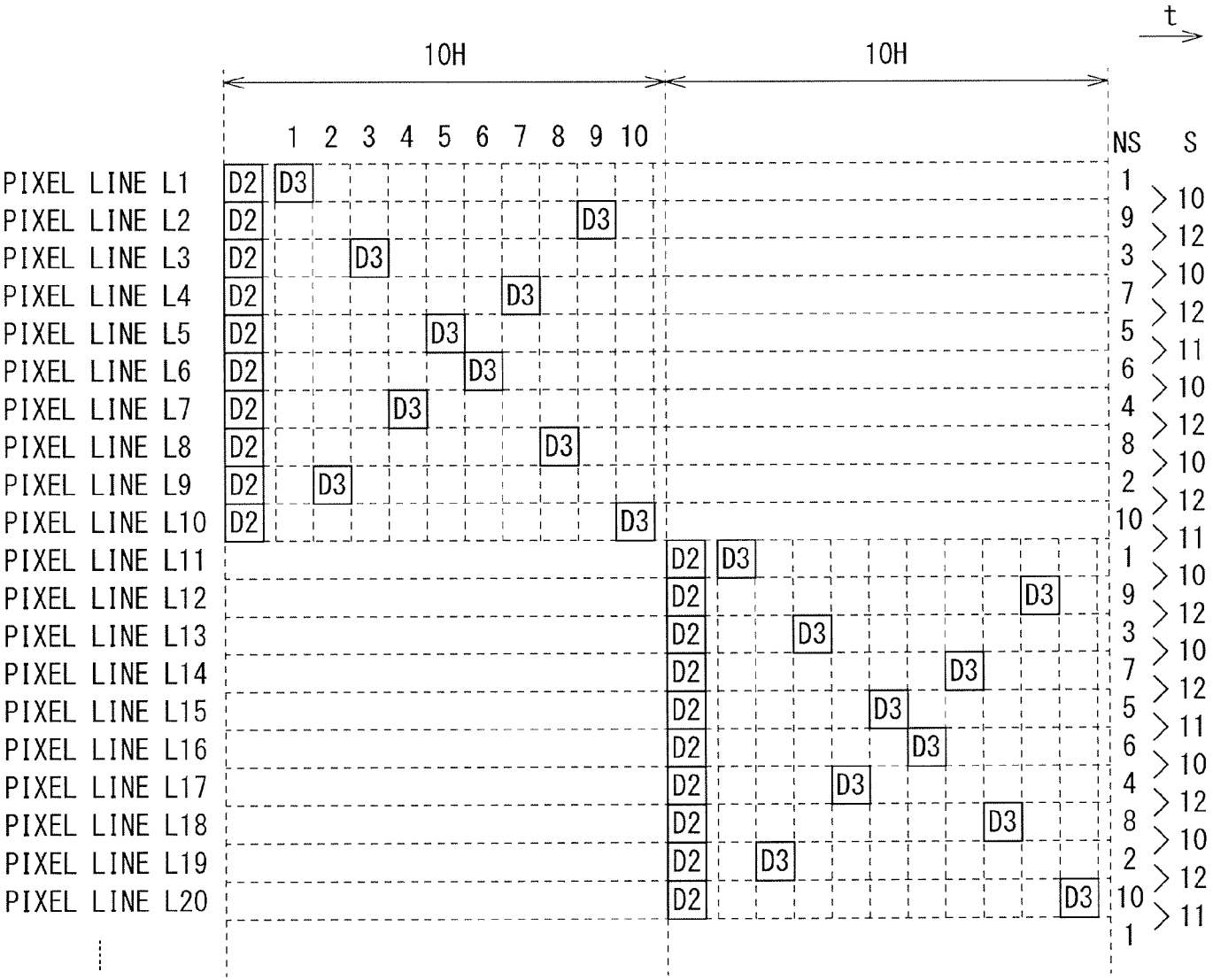

[ FIG. 28 ]
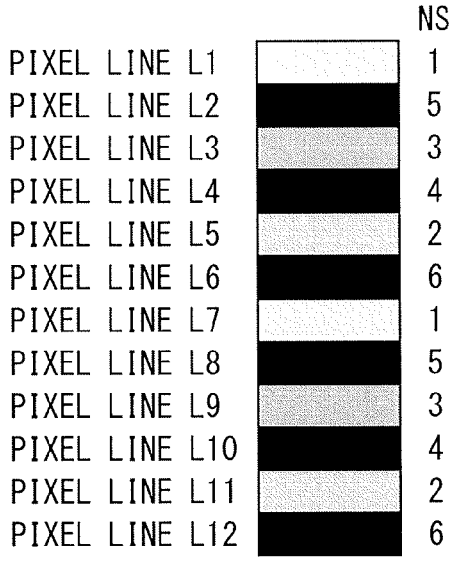
[ FIG. 29 ]
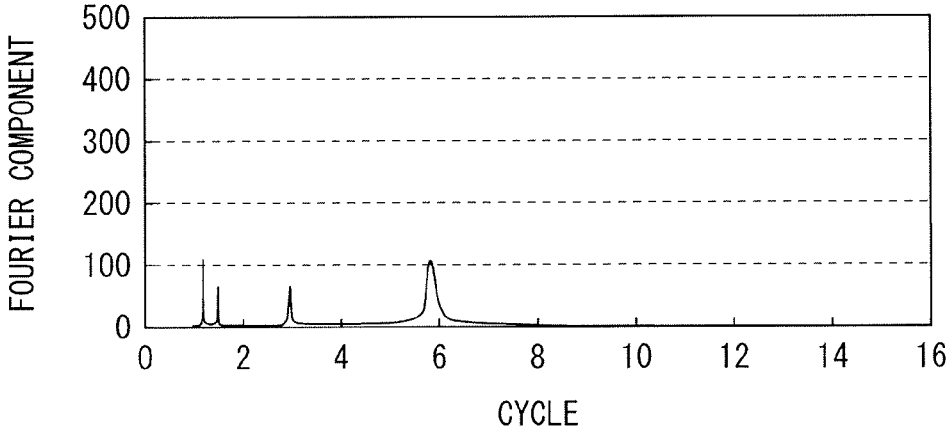

[ FIG. 30 ]
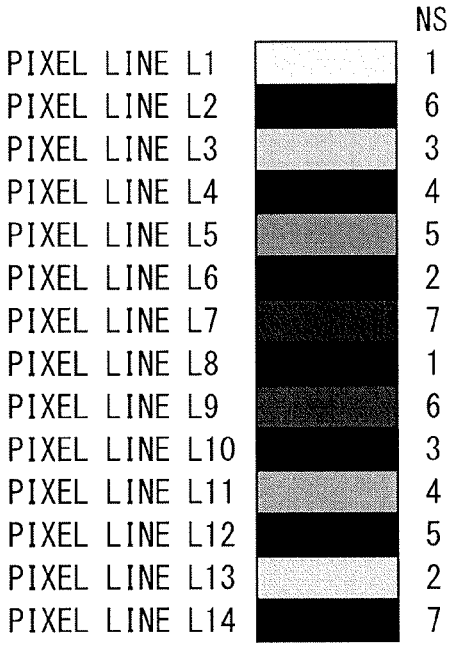
[ FIG. 31 ]
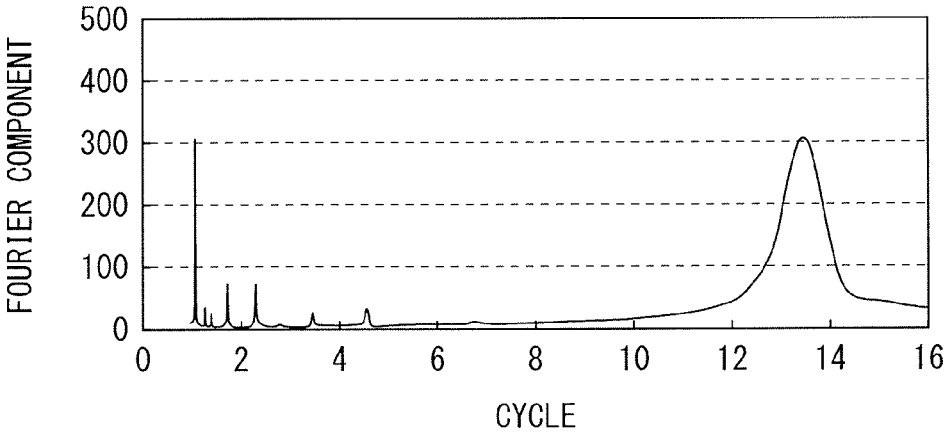

[ FIG. 32 ]
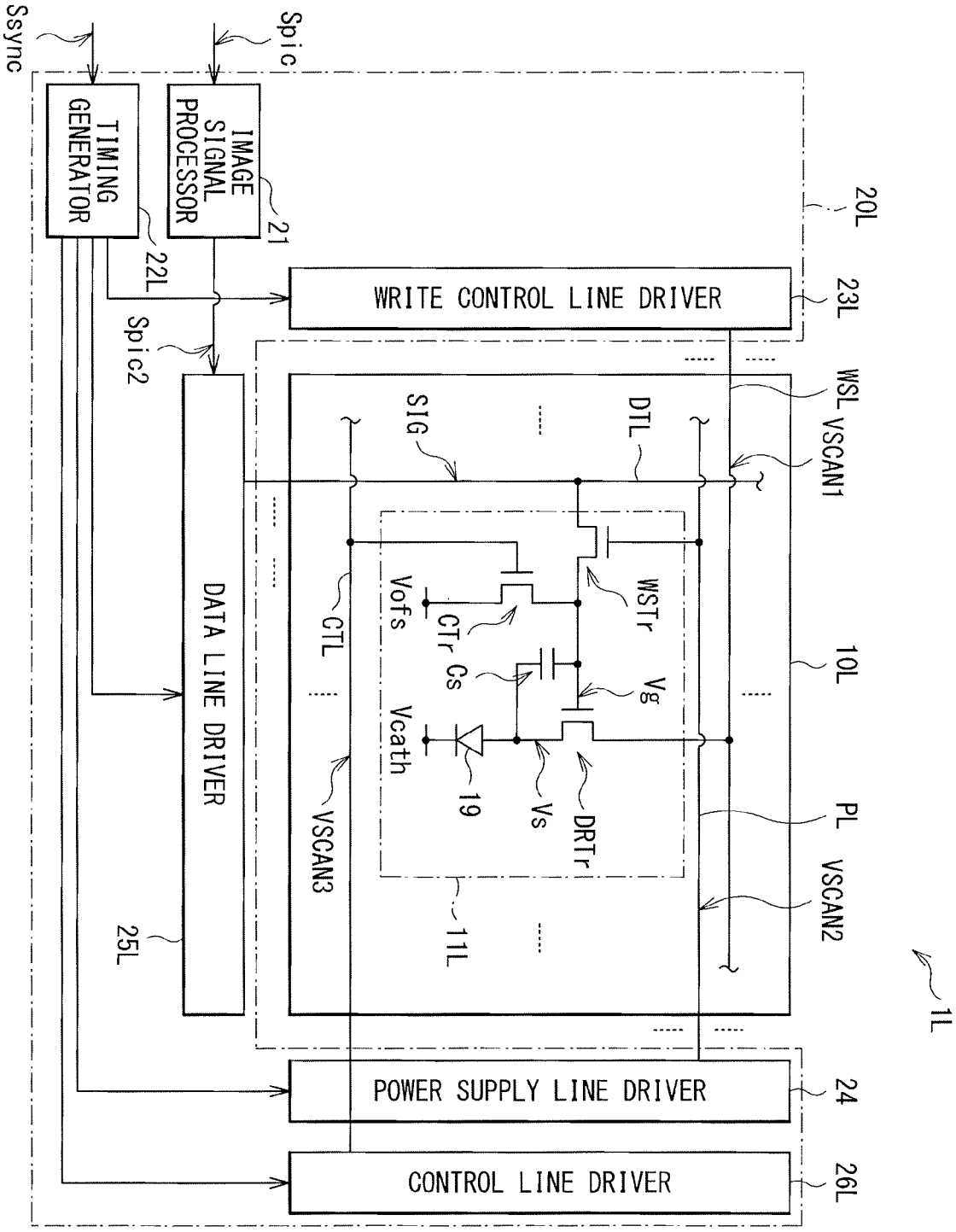

[ FIG. 33 ]
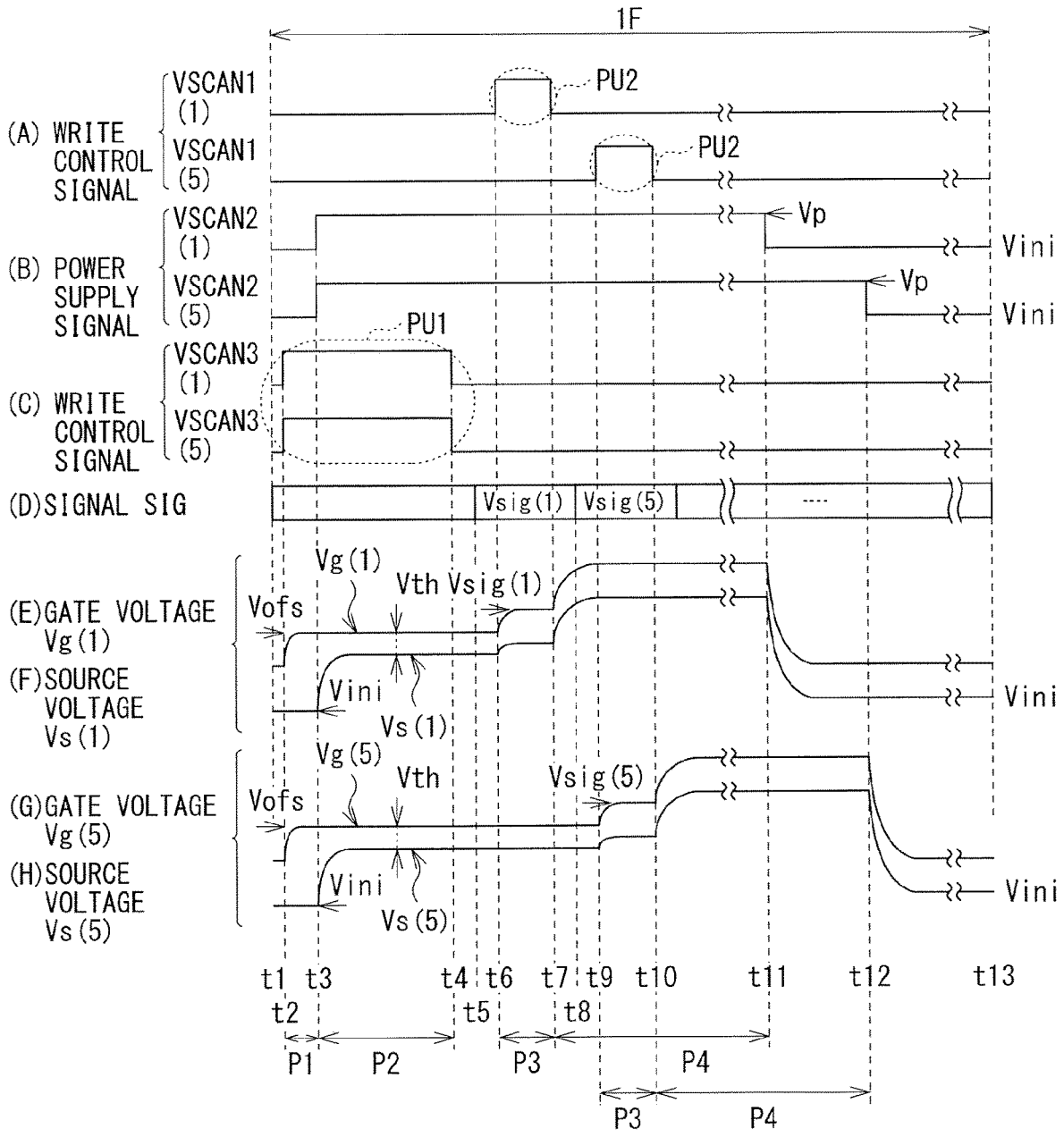

[ FIG. 34 ]
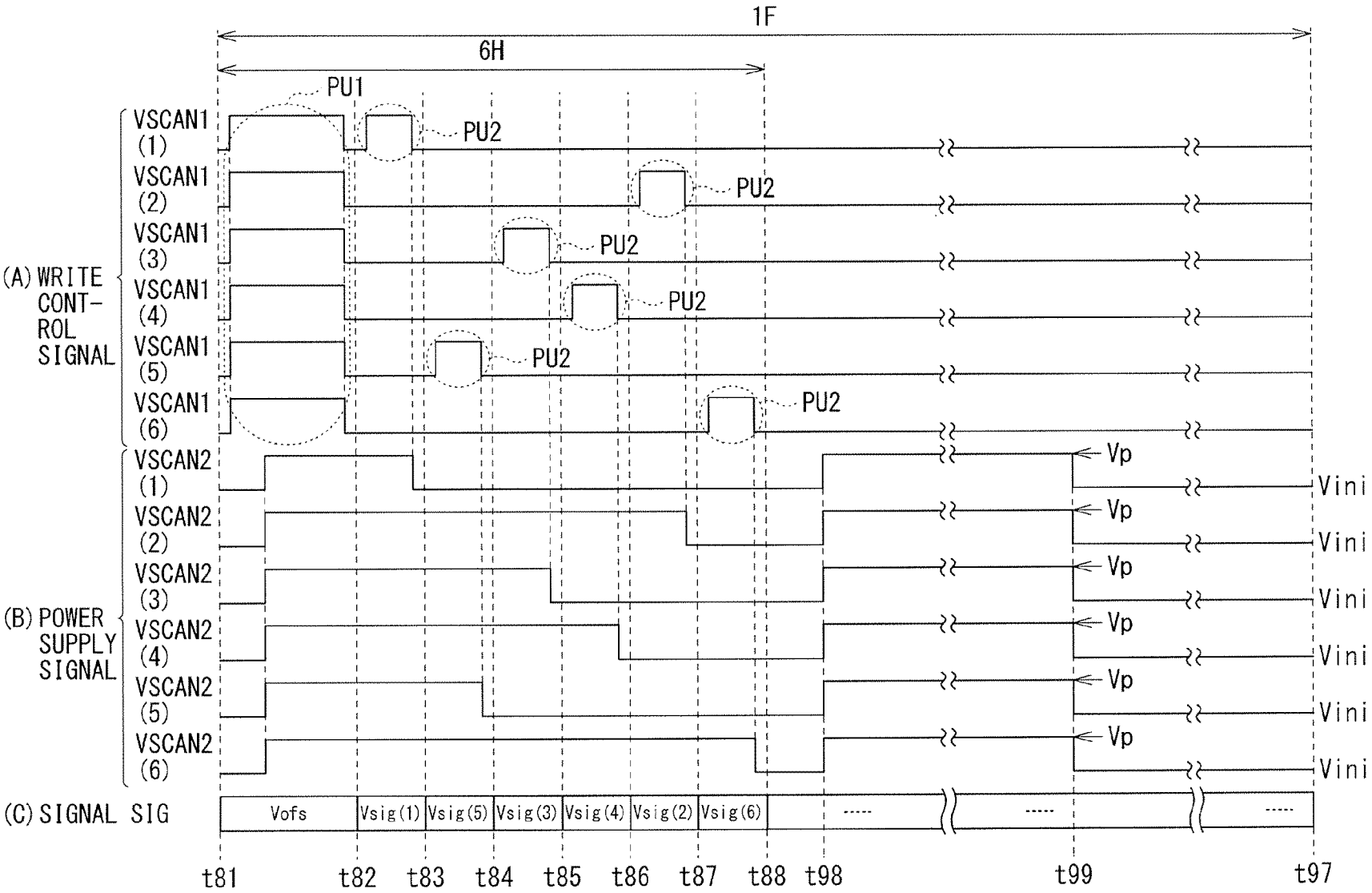

[ FIG. 35 ]
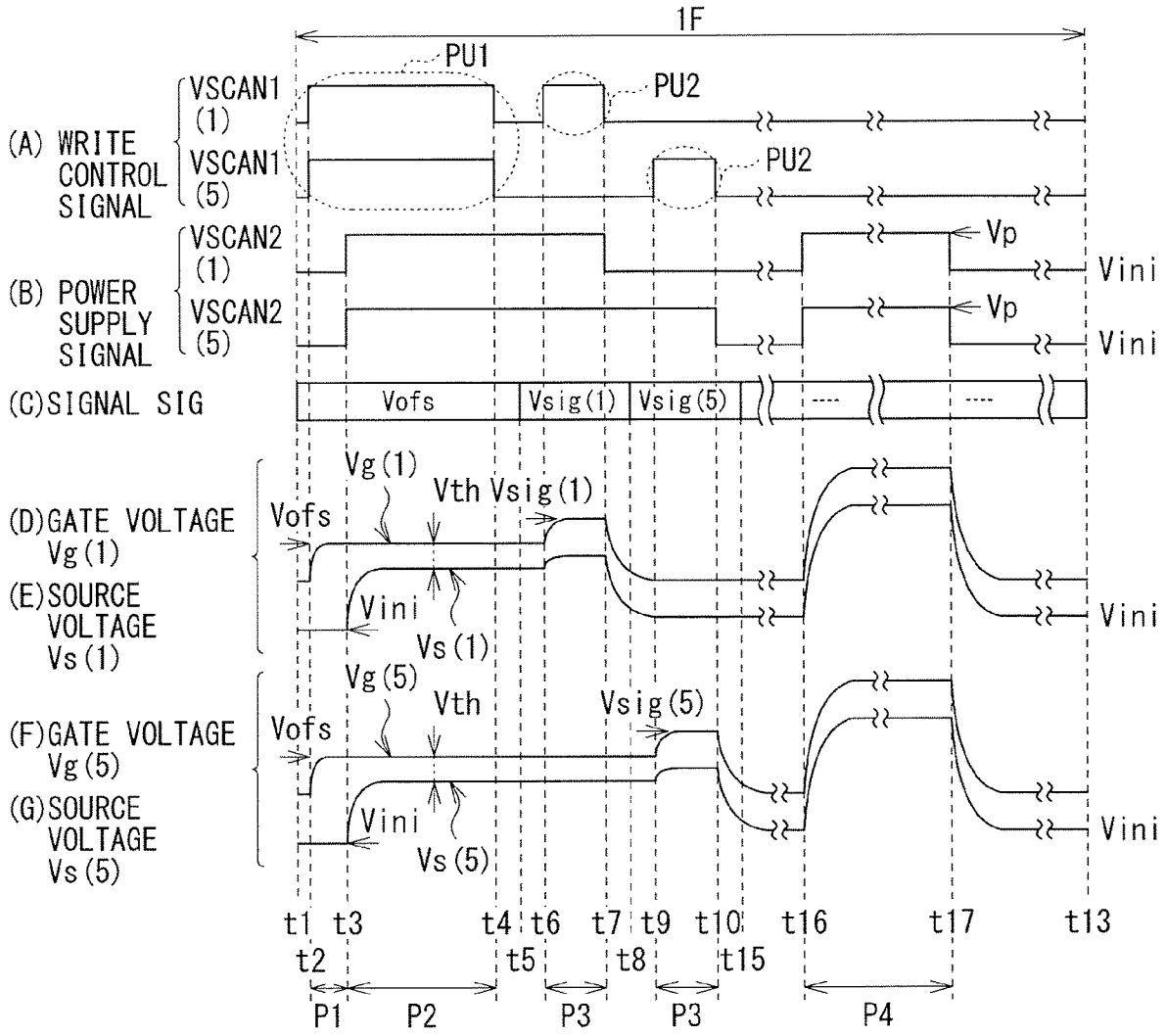

[ FIG. 36 ]
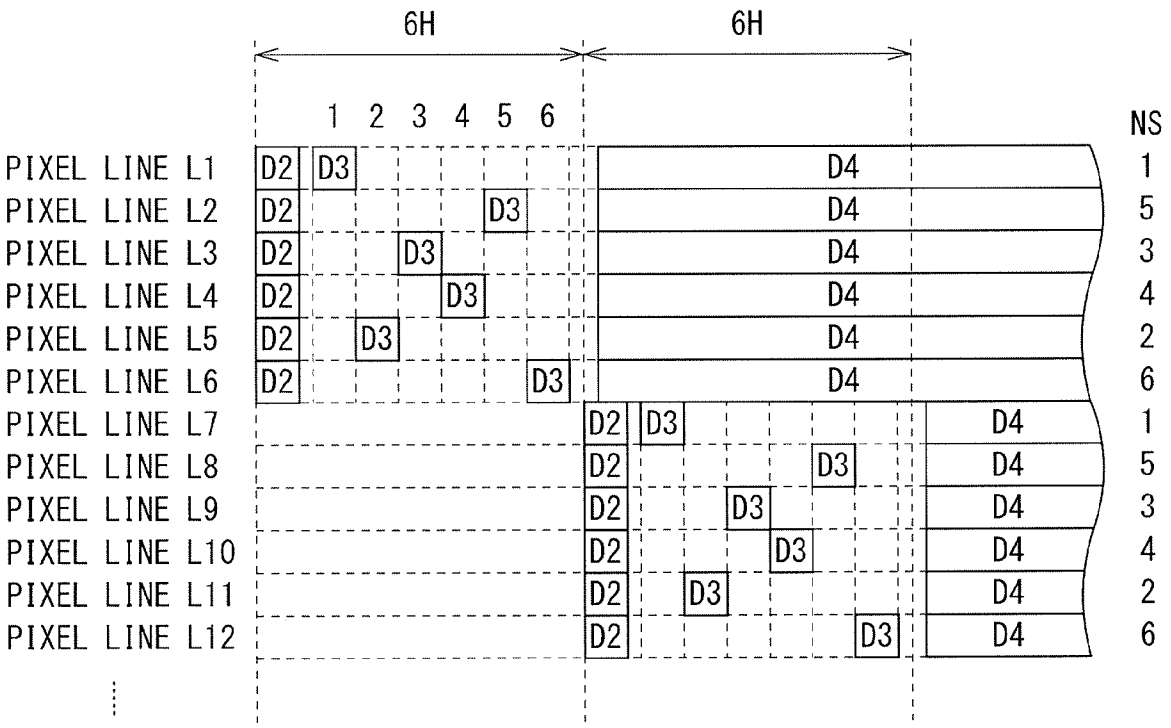

[ FIG. 37 ]
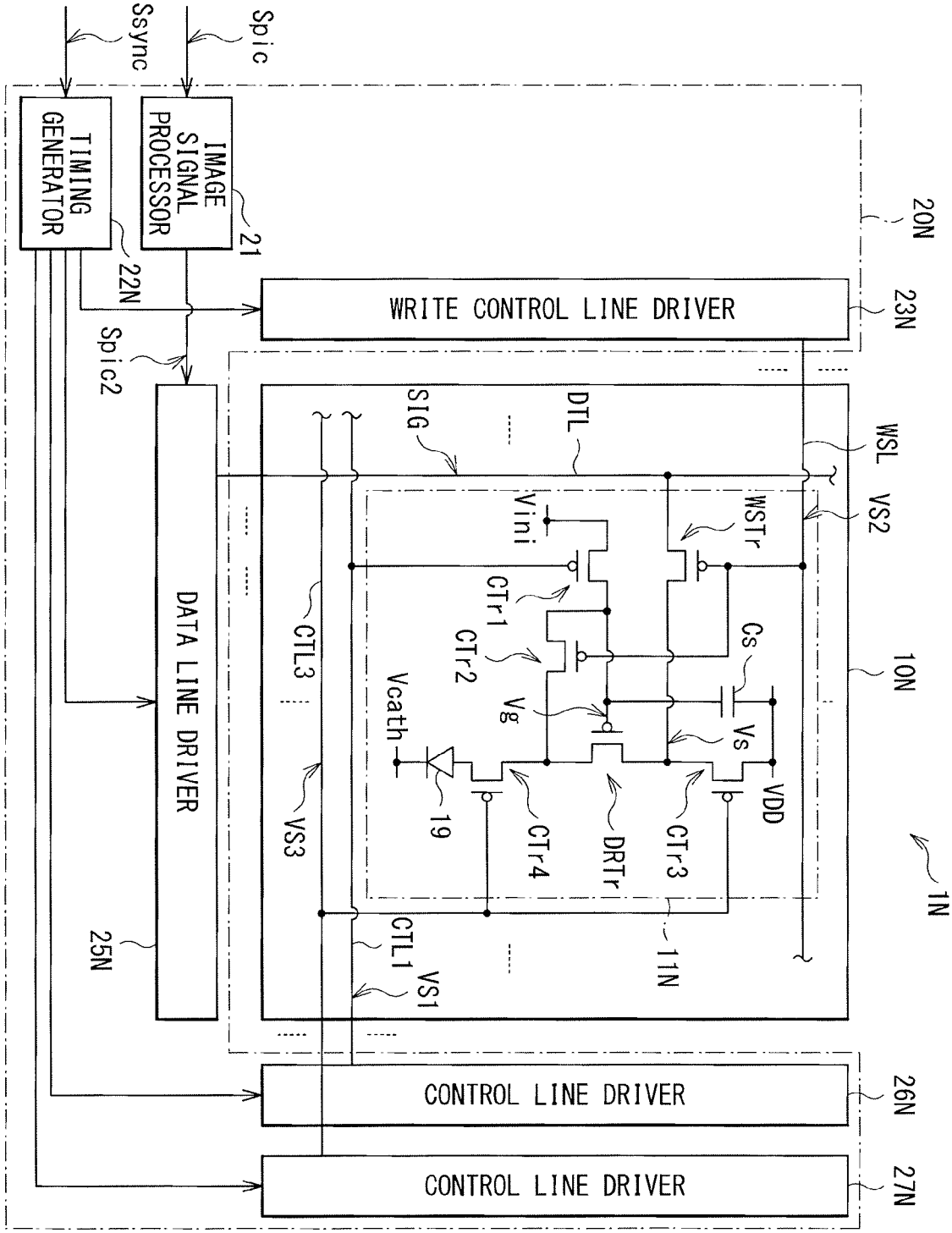

[ FIG. 38 ]
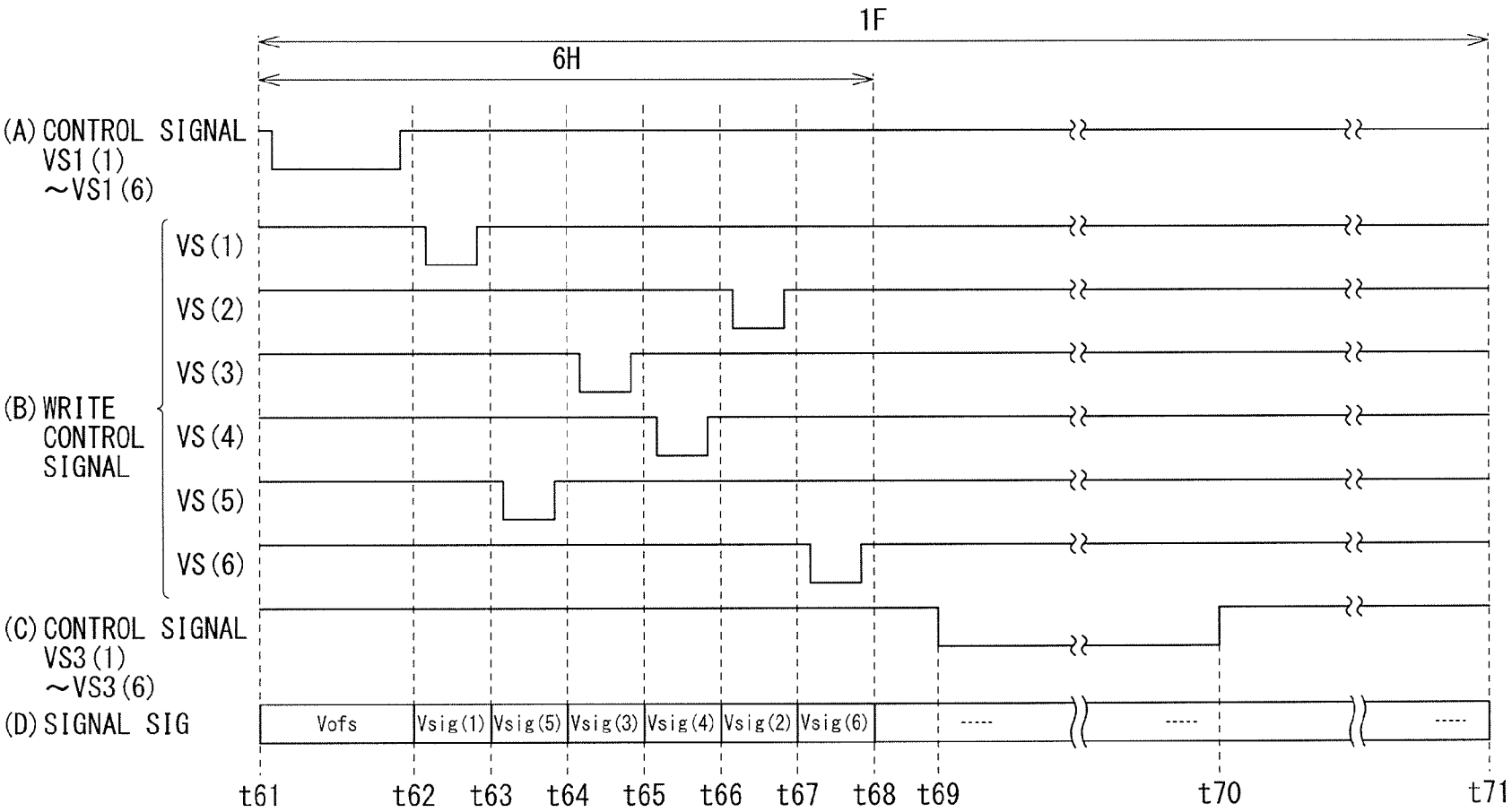

[ FIG. 39 ]
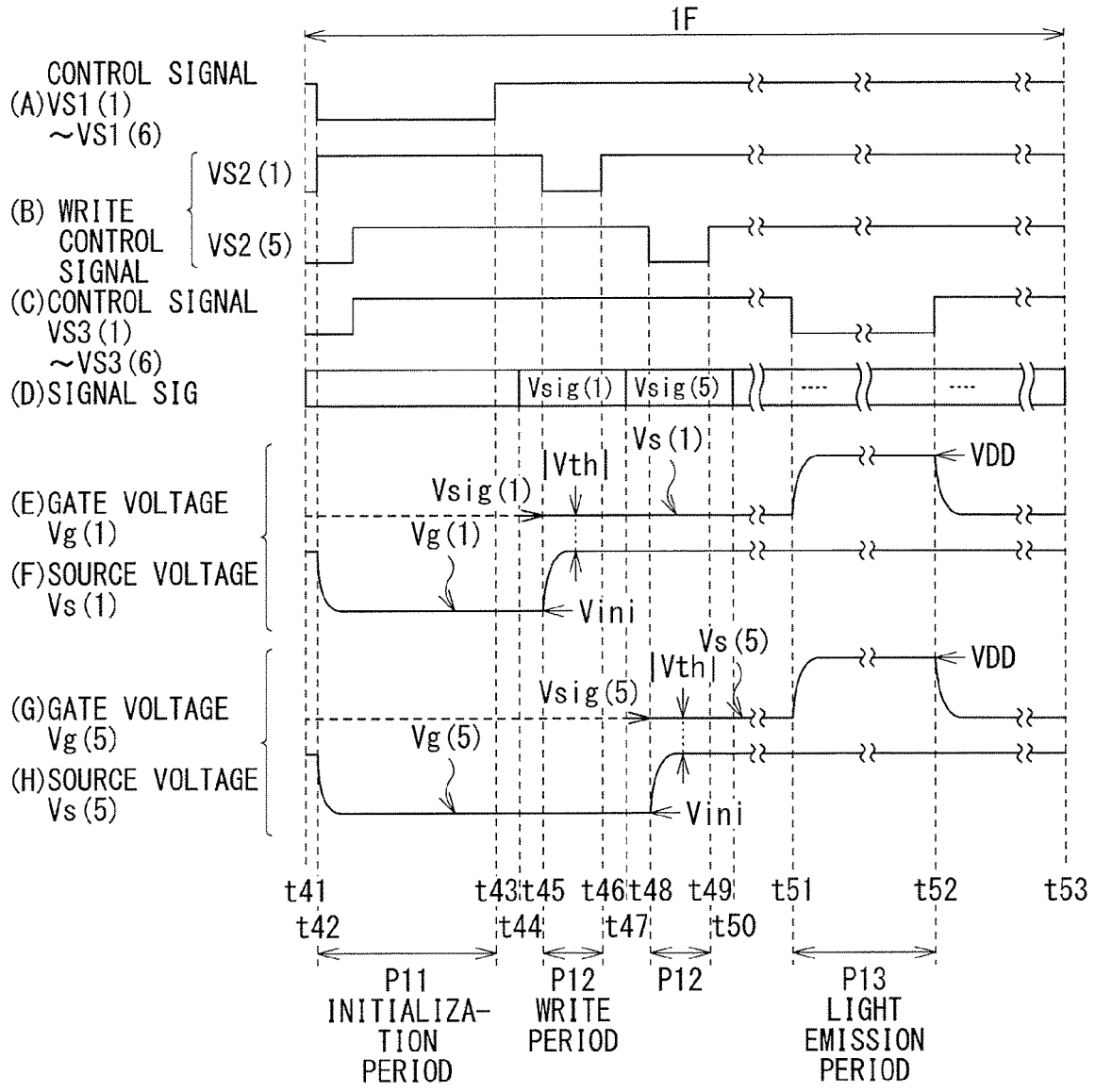

[ FIG. 40 ]
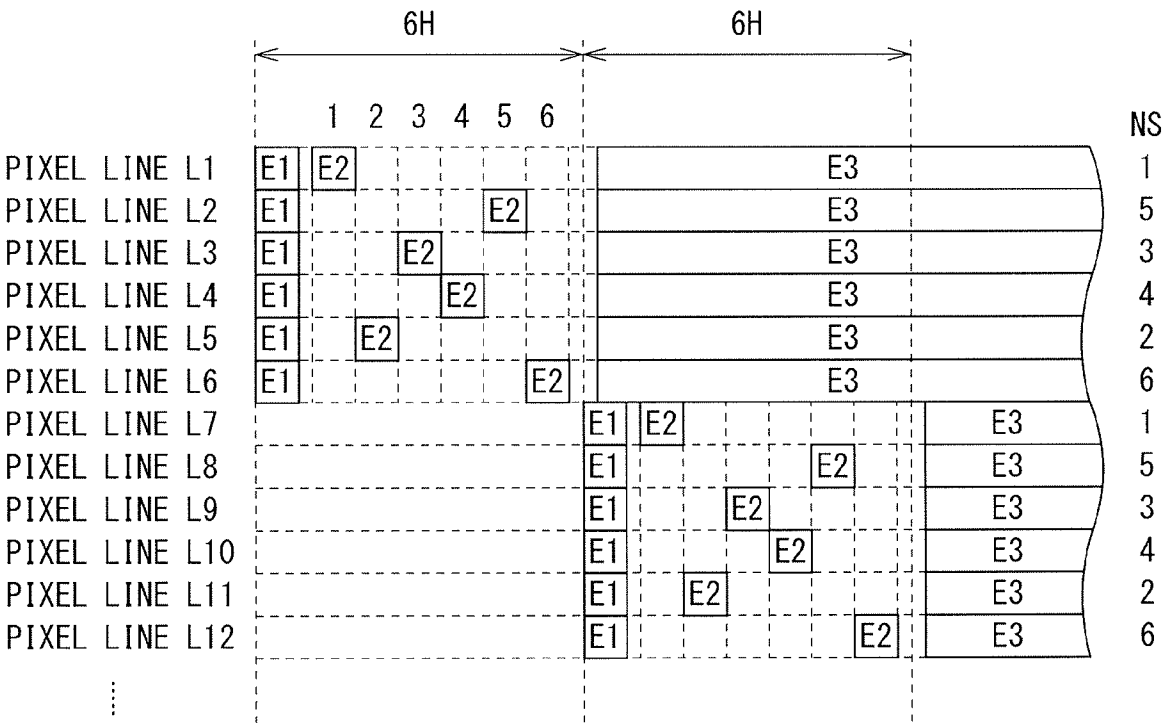

[ FIG. 41 ]
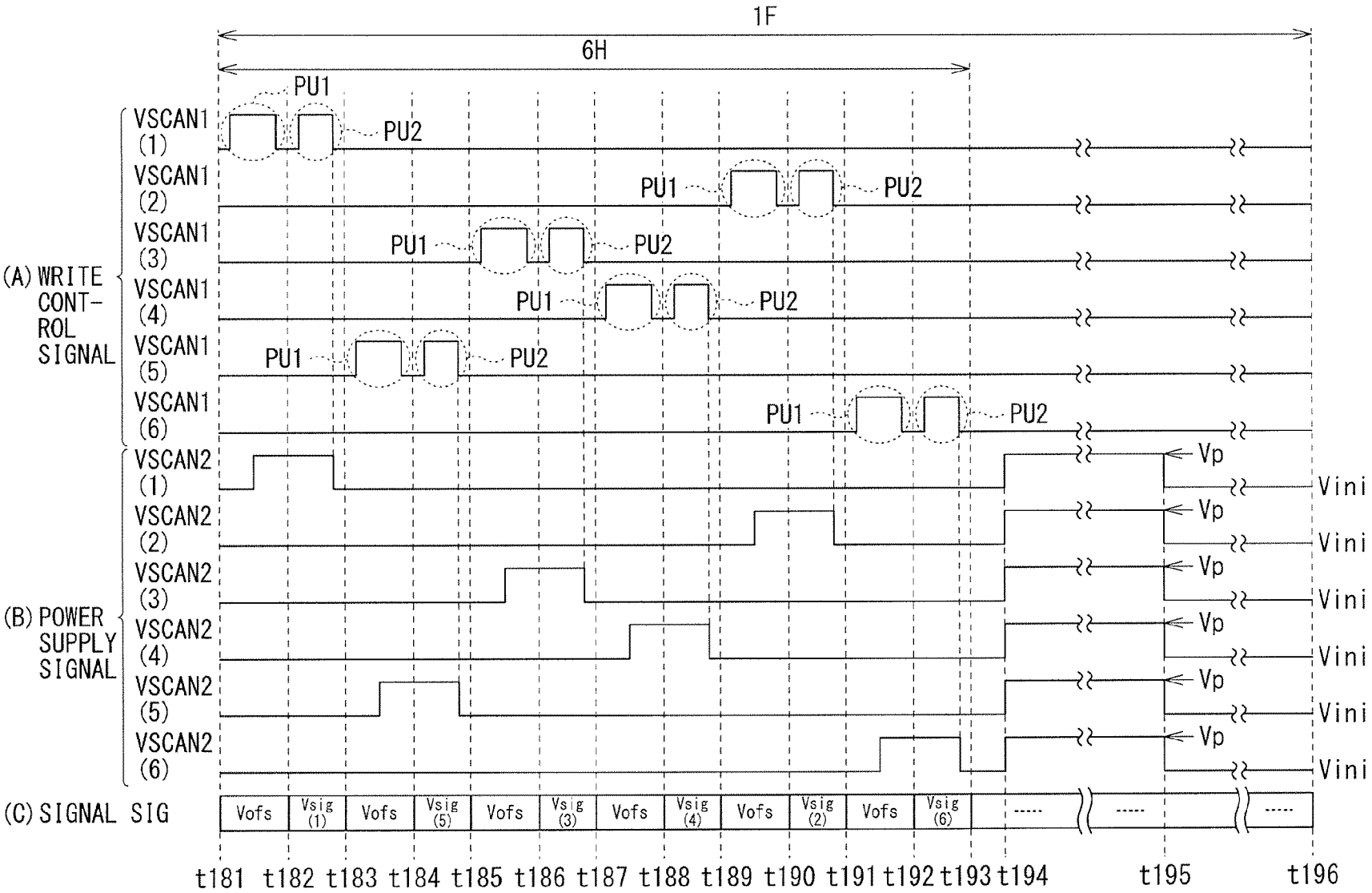

[ FIG. 42 ]
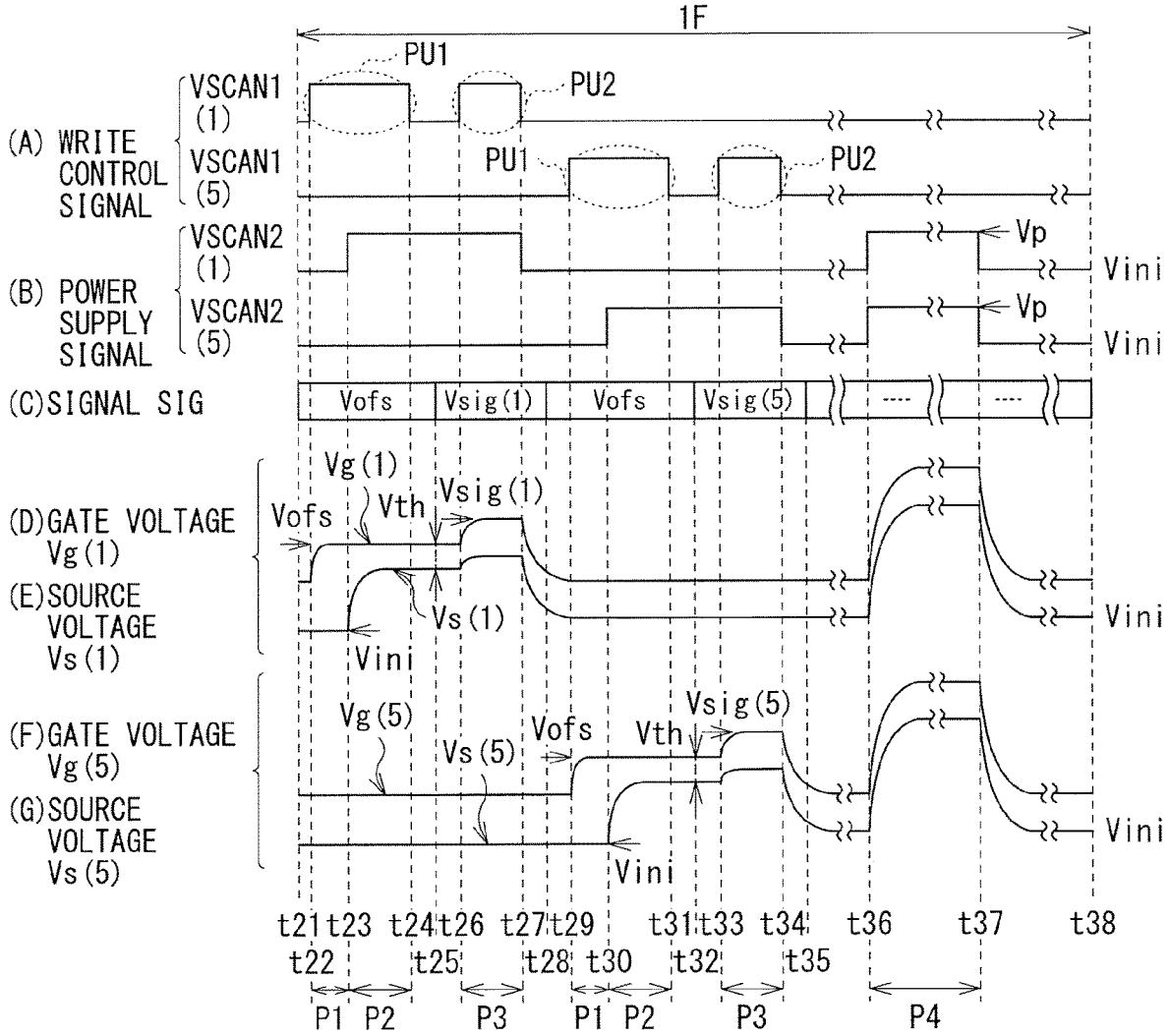

[ FIG. 43 ]
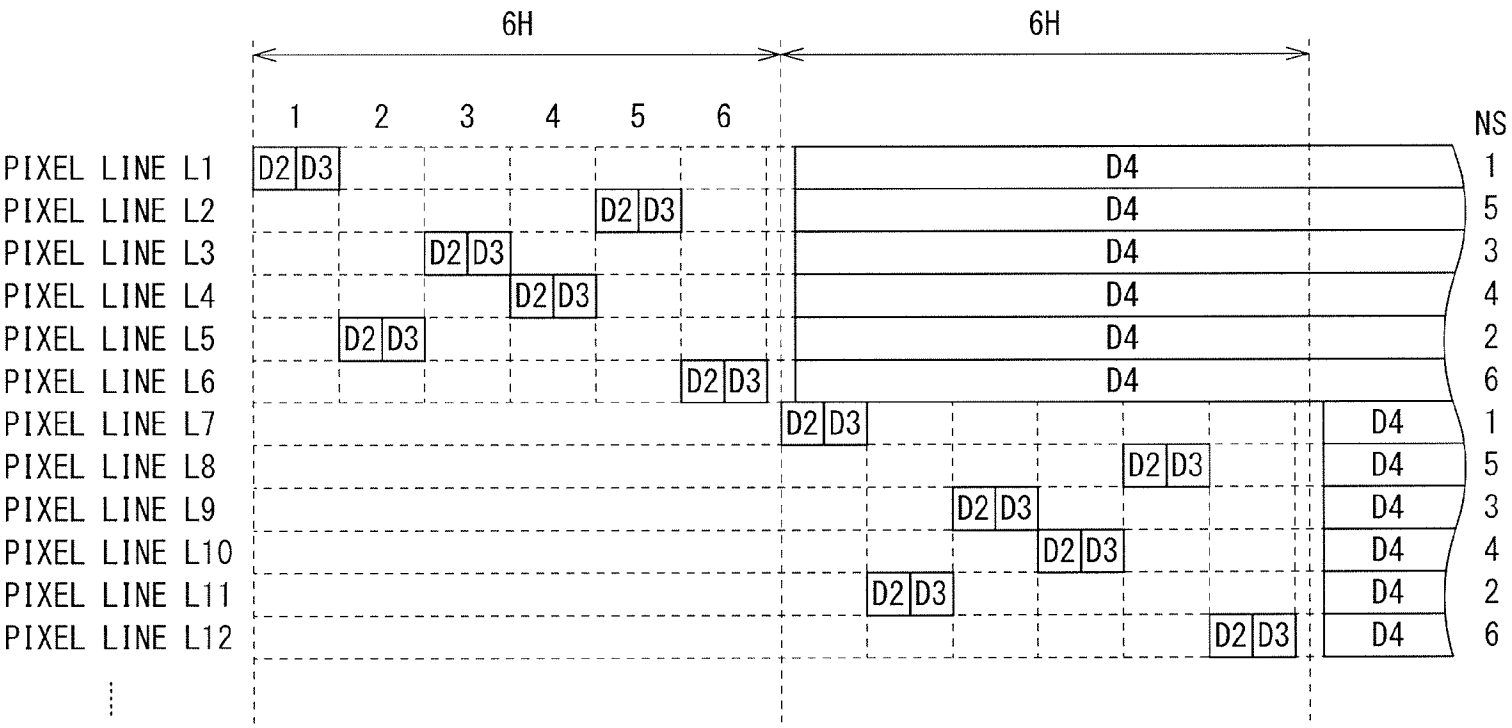

[ FIG. 44 ]
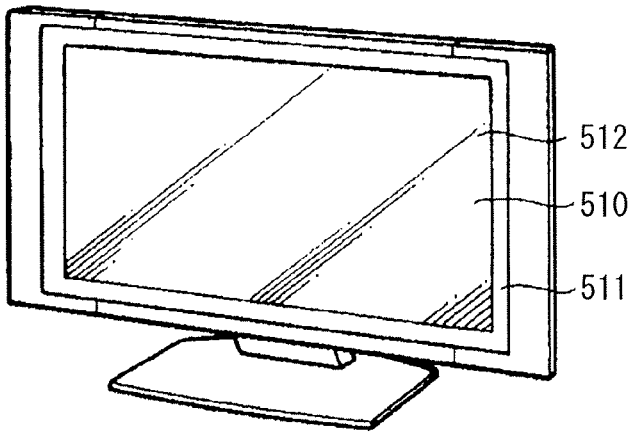

DISPLAY DEVICE, DRIVER CIRCUIT, AND DRIVING METHOD

TECHNICAL FIELD

The disclosure relates to a display device including a current drive display element, a driver circuit of the display device, and a driving method used for the display device.

BACKGROUND ART

In recent years, in a field of display devices that perform image display, display devices (organic EL display devices) have been developed and commercialized that utilize, as light emitting elements, current drive optical elements such as organic EL (Electro Luminescence) elements. The current drive optical elements change in light emission intensity in accordance with values of currents flowing therethrough. Unlike liquid crystal elements or some other elements, such optical elements are spontaneous light emitting elements, and do not have to be equipped with separate light sources (backlights). Accordingly, for example, the organic EL display devices have features such as high image visibility, low power consumption, and a high response speed of elements, as compared to liquid crystal display devices that involve the light sources.

In such display devices, for example, each pixel is constituted using a light emitting element and a drive transistor that supplies a current to the light emitting element. The drive transistor sometimes varies in characteristics for each pixel. In such cases, there is possibility of lowered image quality. For example, PTL 1 discloses a display device that makes a correction of variation in threshold voltages of the drive transistors every time a pixel voltage is written to pixels. The display device makes the correction simultaneously with respect to pixels that belong to a plurality of pixel lines.

CITATION LIST

Patent Literature

PTL 1: Japanese Unexamined Patent Application Publication No. 2009-122352

SUMMARY OF THE INVENTION

As described, in the display devices, high image quality is desired, with expectation of further improvement in the image quality.

It is therefore desirable to provide a display device, a driver circuit, and a driving method that make it possible to enhance image quality.

A first display device according to an embodiment of the disclosure includes a plurality of pixels and a driver unit. The driver unit makes scanning of pixels that belong to a plurality of pixel lines out of the plurality of pixels, in units of pixel line groups each of which is constituted by a predetermined number of the pixel lines, in a scanning order indicated by scanning ordinal numbers associated with the respective pixel line groups, to perform a write drive that includes writing a pixel voltage to each pixel. The scanning ordinal numbers are set to allow a sum of the scanning ordinal numbers of any two adjacent pixel line groups to approximate to a predetermined value.

A second display device according to an embodiment of the disclosure includes a plurality of pixels and a driver unit.

The driver unit makes scanning of pixels that belong to a plurality of pixel lines out of the plurality of pixels, in units of pixel line groups each of which is constituted by a predetermined number of the pixel lines, in a scanning order indicated by scanning ordinal numbers associated with the respective pixel line groups, to perform a write drive that includes writing a pixel voltage to each pixel. The scanning ordinal numbers are set to allow a component at a high spatial frequency to become larger, in a sequence of the scanning ordinal numbers of the respective pixel line groups.

A driver circuit according to an embodiment of the disclosure includes a driver unit. The driver unit makes scanning of pixels that belong to a plurality of pixel lines, in units of pixel line groups each of which is constituted by a predetermined number of the pixel lines, in a scanning order indicated by scanning ordinal numbers associated with the respective pixel line groups, to perform a write drive that includes writing a pixel voltage to each pixel. The scanning ordinal numbers are set to allow a sum of the scanning ordinal numbers of any two adjacent pixel line groups to approximate to a predetermined value.

A driving method according to an embodiment of the disclosure includes: setting scanning ordinal numbers of a plurality of respective pixel line groups, in which the plurality of pixel line groups each are constituted by a predetermined number of pixel lines, and the scanning ordinal numbers are set to allow a sum of the scanning ordinal numbers of any two adjacent pixel line groups to approximate to a predetermined value; and making scanning of pixels that belong to a plurality of pixel lines, in units of the pixel line groups, in a scanning order indicated by the scanning ordinal numbers, to write a pixel voltage to each pixel.

In the first display device, the driver circuit, and the driving method according to the embodiments of the disclosure, the scanning of the pixels that belong to the plurality of pixel lines is made, in units of the pixel line groups, in the scanning order indicated by the scanning ordinal numbers. Thus, the write drive is performed. The scanning ordinal numbers are set to allow the sum of the scanning ordinal numbers of any two adjacent pixel line groups to approximate to the predetermined value.

In the second display device according to the embodiment of the disclosure, the scanning of the pixels that belong to the plurality of pixel lines is made, in units of the pixel line groups, in the scanning order indicated by the scanning ordinal numbers. Thus, the write drive is performed. The scanning ordinal numbers are set to allow the component at the high special frequency to become larger, in the sequence of the scanning ordinal numbers of the respective pixel line groups.

According to the first display device, the driver circuit, and the driving method of the embodiments of the disclosure, the scanning ordinal numbers are set to allow the sum of the scanning ordinal numbers of any two adjacent pixel line groups to approximate to the predetermined value. Hence, it is possible to enhance image quality.

According to the second display device of the embodiment of the disclosure, the scanning ordinal numbers are set to allow the component at the high special frequency to become larger, in the sequence of the scanning ordinal numbers of the respective pixel line groups. Hence, it is possible to enhance image quality.

It is to be noted that effects of the disclosure are not necessarily limited to the effects described above, and may include any of effects that are described herein.

BRIEF DESCRIPTION OF DRAWING

FIG. 1 is a block diagram that illustrates one configuration example of a display device according to example embodiments of the disclosure.

FIG. 2 is a timing chart that illustrates one operation example of a driver unit illustrated in FIG. 1.

FIG. 3 is a timing waveform chart that illustrates one operation example of a driver unit according to a first embodiment.

FIG. 4 is a timing waveform chart that illustrates one operation example of a display device according to the first embodiment.

FIG. 5 is a timing chart that illustrates one operation example of the display device according to the first embodiment.

FIG. 6 is a descriptive diagram that illustrates one example of intensity distribution in the display device according to the first embodiment.

FIG. 7 is a descriptive diagram that illustrates relation between spatial frequency and contrast sensitivity.

FIG. 8 is a descriptive diagram that illustrates one characteristic example of the display device according to the first embodiment.

FIG. 9 is a timing chart that illustrates one operation example of a display device according to a comparative example.

FIG. 10 is a descriptive diagram that illustrates one example of intensity distribution in the display device illustrated in FIG. 9.

FIG. 11 is a descriptive diagram that illustrates one characteristic example of the display device illustrated in FIG. 9.

FIG. 12 is a timing chart that illustrates one operation example of a display device according to another comparative example.

FIG. 13 is a descriptive diagram that illustrates one example of intensity distribution in the display device illustrated in FIG. 12.

FIG. 14 is a descriptive diagram that illustrates one characteristic example of the display device illustrated in FIG. 12.

FIG. 15 is a timing chart that illustrates one operation example of a display device according to a modification example of the first embodiment.

FIG. 16 is a descriptive diagram that illustrates one example of intensity distribution in the display device illustrated in FIG. 15.

FIG. 17 is a timing chart that illustrates one operation example of a display device according to another modification example of the first embodiment.

FIG. 18 is a descriptive diagram that illustrates one example of intensity distribution in the display device illustrated in FIG. 15.

FIG. 19 is a descriptive diagram that illustrates one example of intensity distribution in a display device according to another modification example of the first embodiment.

FIG. 20 is a timing chart that illustrates one operation example of a display device according to another modification example of the first embodiment.

FIG. 21 is a descriptive diagram that illustrates one example of intensity distribution in the display device illustrated in FIG. 20.

FIG. 22 is a timing chart that illustrates one operation example of a display device according to another modification example of the first embodiment.

FIG. 23 is a timing chart that illustrates one operation example of a display device according to another modification example of the first embodiment.

FIG. 24 is a timing chart that illustrates one operation example of a display device according to another modification example of the first embodiment.

FIG. 25 is a timing chart that illustrates one operation example of a display device according to another modification example of the first embodiment.

FIG. 26 is a timing chart that illustrates one operation example of a display device according to another modification example of the first embodiment.

FIG. 27 is a timing chart that illustrates one operation example of a display device according to another modification example of the first embodiment.

FIG. 28 is a descriptive diagram that illustrates one example of intensity distribution in a display device according to another modification example of the first embodiment.

FIG. 29 is a descriptive diagram that illustrates one characteristic example of a display device according to another modification example of the first embodiment.

FIG. 30 is a descriptive diagram that illustrates one example of intensity distribution in a display device according to another modification example of the first embodiment.

FIG. 31 is a descriptive diagram that illustrates one characteristic example of a display device according to another modification example of the first embodiment.

FIG. 32 is a block diagram that illustrates one configuration example of a display device according to another modification example of the first embodiment.

FIG. 33 is a timing waveform chart that illustrates one operation example of the display device illustrated in FIG. 32.

FIG. 34 is a timing chart that illustrates one operation example of a driver unit according to another modification example of the first embodiment.

FIG. 35 is a timing waveform chart that illustrates one operation example of a display device according to another modification example of the first embodiment.

FIG. 36 is a timing chart that illustrates one operation example of a display device according to another modification example of the first embodiment.

FIG. 37 is a block diagram that illustrates one configuration example of a display device according to another modification example of the first embodiment.

FIG. 38 is a timing chart that illustrates one operation example of a driver unit illustrated in FIG. 37.

FIG. 39 is a timing waveform chart that illustrates one operation example of the display device illustrated in FIG. 37.

FIG. 40 is a timing chart that illustrates one operation example of the display device illustrated in FIG. 37.

FIG. 41 is a timing chart that illustrates one operation example of a driver unit according to a second embodiment.

FIG. 42 is a timing waveform chart that illustrates one operation example of a display device according to the second embodiment.

FIG. 43 is a timing chart that illustrates one operation example of the display device according to the second embodiment.

FIG. 44 is a perspective view of an external appearance and a configuration of a television device to which the display devices according to the example embodiments is applied.

MODES FOR CARRYING OUT THE INVENTION

In the following, some embodiments of the disclosure are described in detail with reference to the drawings. It is to be noted that description is made in the following order.

1. First Embodiment
2. Second Embodiment
3. Application Examples

1. First Embodiment

Configuration Example

FIG. 1 illustrates one configuration example of a display device (a display device 1) according to a first embodiment. The display device 1 is an active matrix display device that utilizes organic EL elements. It is to be noted that since a driver circuit and a driving method according to embodiments of the disclosure are embodied by this embodiment, description thereof is made together. The display device 1 includes a display unit 10 and a driver unit 20.

The display unit 10 displays an image on the basis of a drive by the driver unit 20. The display unit 10 includes a plurality of pixels 11 that are arranged in a matrix. Moreover, the display unit 10 includes a plurality of write control lines WSL, a plurality of power supply lines PL, and a plurality of data lines DTL. The plurality of the write control lines WSL extend in a row direction (a horizontal direction). The plurality of the power supply lines PL extend in the row direction. The plurality of the data lines DTL extend in a column direction (a vertical direction). One ends of the plurality of the write control lines WSL, the plurality of the power supply lines PL, and the plurality of the data lines DTL are each coupled to the driver unit 20. Each of the pixels 11 is coupled to the write control line WSL, the power supply line PL, and the data line DTL.

The pixel 11 includes, as illustrated in FIG. 1, a write transistor WSTr, a drive transistor DRTr, a capacitor Cs, and a light emitting element 19. In other words, in this example, the pixel 11 has a so-called "2Tr1C" configuration that is constituted using two transistors and one capacitor.

The write transistor WsTr and the drive transistor DrTr are constituted by, for example, N channel MOS (Metal Oxide Semiconductor) TFTs (Thin Film Transistors). The write transistor WsTr includes a gate coupled to the write control line WSL, a source coupled to the data line DTL, and a drain coupled to a gate of the drive transistor DRTr and one end of the capacitor Cs. The drive transistor DRTr includes the gate coupled to the drain of the write transistor WSTr and the one end of the capacitor Cs, a drain coupled to the power supply line PL, and a source coupled to another end of the capacitor Cs and an anode of the light emitting element 19.

The capacitor Cs includes the one end coupled to the gate of the drive transistor DRTr and the drain of the write transistor WSTr, and the other end coupled to the source of the drive transistor DRTr and the anode of the light emitting element 19. The light emitting element 19 is a light emitting element that is constituted using an organic EL element. The light emitting element 19 includes the anode coupled to the source of the drive transistor DRTr and the other end of the capacitor Cs, and a cathode that is supplied with a voltage Vcath by the driver unit 20. The voltage Vcath is a direct-current voltage. The light emitting element 19 includes, although undepicted, a parasitic capacitance between the anode and the cathode. The parasitic capacitance has a larger capacitance value than a capacitance value of the capacitor Cs. The light emitting element 19 emits light in, for example, a red color (R), a green color (G), or a blue color (B). It is to be noted that this is non-limiting. For example, the light emitting element 19 may emit light in a white color, allowing a color filter to generate the light in the red color (R), the green color (G), and the blue color (B). Moreover, the colors of the light are not limited to the three colors, but may be four colors (e.g., the red color (R), the green color (G), the blue color (B), and the white color (W)).

The driver unit 20 drives the display unit 10, on the basis of an image signal Spic and a synchronization signal Ssync that are supplied from outside. The driver unit 20 includes an image signal processor 21, a timing generator 22, a write control line driver 23, a power supply line driver 24, and a data line driver 25.

The image signal processor 21 performs predetermined signal processing on the image signal Spic supplied from the outside, to generate an image signal Spic2. Examples of the predetermined signal processing include gamma correction and overdrive correction.

The timing generator 22 supplies, on the basis of the synchronization signal Ssync supplied from the outside, a control signal to each of the write control line driver 23, the power supply line driver 24, and the data line driver 25, to control them to operate in synchronization with one another.

The write control line driver 23 applies, in accordance with the control signal supplied from the timing generator 22, a write control signal VSCAN1 to the plurality of the write control lines WSL. Thus, the write control line driver 23 selects the pixel 11.

The power supply line driver 24 applies, in accordance with the control signal supplied from the timing generator 22, a power supply signal VSCAN2 to the plurality of the power supply lines PL. Thus, the power supply line driver 24 performs a control of light emission operation and light extinguishment operation of the pixel 11. The power supply signal VSCAN2 makes transitions between a voltage Vp and a voltage Vini. As described later, the voltage Vini is a voltage provided for initialization of the pixel 11. The voltage Vp is a voltage provided for the light emission of the light emitting element 19 by flowing a current through the drive transistor DRTr.

The data line driver 25 generates a signal SIG, in accordance with the image signal Spic2 supplied from the image signal processor 21 and in accordance with the control signal supplied from the timing generator 22. The signal SIG includes a predetermined voltage Vofs and a pixel voltage Vsig. The pixel voltage Vsig instructs light emission intensity of each of the pixels 11. The data line driver 25 applies the signal SIG to each of the data lines DTL.

With this configuration, the driver unit 20 makes a scanning drive of the pixels 11 of the display unit 10, on the plurality-of-pixel-line-L basis (six-pixel-line-L in this example), as described later. Moreover, the driver unit 20 performs, with respect to the pixels 11 that belong to the six pixel lines, a Vth correction drive D2 (described later) simultaneously, and thereafter, performs a write drive D3 (described later) of the pixel voltage Vsig in a predetermined scanning order.

Here, for example, pixel lines L1 to L6 correspond to one specific example of a "plurality of pixel lines" in the disclosure. Each of the pixel lines L corresponds to one specific example of a "pixel line group" in the disclosure. The Vth correction drive D2 corresponds to one specific example of a "preparatory drive" in the disclosure.

[Operation and Workings]

Description is given next of operation and workings of the display device 1 according to this embodiment.

[Outline of Overall Operation]

First, description is given on an outline of overall operation of the display device 1 with reference to FIG. 1. The image signal processor 21 performs the predetermined signal processing with respect to the image signal Spic supplied from the outside, to generate the image signal Spic2. The timing generator 22 supplies, on the basis of the synchronization signal Ssync supplied from the outside, the control signal to each of the write control line driver 23, the power supply line driver 24, and the data line driver 25, to control them to operate in synchronization with one another. The write control line driver 23 applies, in accordance with the control signal supplied from the timing generator 22, the write control signal VSCAN1 to the plurality of the write control lines WSL, to select the pixel 11. The power supply line driver 24 applies, in accordance with the control signal supplied from the timing generator 22, the power supply signal VSCAN2 to the plurality of the power supply lines PL, to perform the control of the light emission operation and the light extinguishment operation of the pixel 11. The data line driver 25 generates the signal SIG, in accordance with the image signal Spic2 supplied from the image signal processor 21 and in accordance with the control signal supplied from the timing generator 22. The signal SIG includes the predetermined voltage Vofs and the pixel voltage Vsig. The pixel voltage Vsig corresponds to the intensity of each of the pixels 11. The data line driver 25 applies the signal SIG to each of the data lines DTL. The display unit 10 performs display operation on the basis of the write control signal VSCAN1, the power supply signal VSCAN2, and the signal SIG that are supplied from the driver unit 20.

[Detailed Operation]

FIG. 2 illustrates drive operation of the driver unit 20. The driver unit 20 drives the display unit 10 on the basis of the image signal Spic and the synchronization signal Ssync that are supplied from the outside. At this occasion, the driver unit 20 makes the scanning drive of the pixels 11 of the display unit 10, on the six-pixel-line-L basis. Specifically, in one frame period (1F) of timing t101 to t111, the driver unit 20 performs an initialization drive D1, the Vth correction drive D2, the write drive D3, and a light emission drive D4, as described later, with respect to the pixels 11 that belong to the pixel lines L1 to L6. Moreover, in a period of timing t102 to t112, the driver unit 20 performs the initialization drive D1, the Vth correction drive D2, the write drive D3, and the light emission drive D4, in a similar manner, with respect to the pixels 11 that belong to the pixel lines L7 to L12. The timing t102 is later from the timing t101 by a period having duration of six horizontal periods (6H). The timing t112 is later from the timing t111 by the period having the duration of the six horizontal periods (6H). The same applies to other pixel lines. As described, in the display device 1, the scanning drive is made on the six-pixel-line-L basis, with timing of a start being shifted by the period having the duration of the six horizontal periods (6H).

FIG. 3 illustrates the drive operation of the driver unit 20 with respect to the pixels 11 that belong to the pixel lines L1 to L6, with (A) indicating waveforms of write control signals VSCAN1(1) to VSCAN1(6), with (B) indicating waveforms of power supply signals VSCAN2(1) to VSCAN2(6), and with (C) indicating the signal SIG. Here, the write control signals VSCAN1(1) to VSCAN1(6) are, respectively, the write control signals VSCAN1 to be supplied to the pixels 11 that belong to the pixel lines L1 to L6. The power supply signals VSCAN2(1) to VSCAN2(6) are, respectively, the power supply signals VSCAN2 to be supplied to the pixels 11 that belong to the pixel lines L1 to L6. Pixel voltages Vsig(1) to Vsig(6) are, respectively, the pixel voltages Vsig to be supplied to pixels 11(1) to 11(6) of one column of interest, out of the pixels 11 that belong to the pixel lines L1 to L6.

The data line driver 25 of the driver unit 20 generates the signal SIG ((C) of FIG. 3), in a leading period (a period of timing t81 to t88) of the one frame period (1F). The leading period has the duration of the six horizontal periods (6H). The signal SIG includes the predetermined voltage Vofs and the pixel voltages Vsig(1) to Vsig(6). The pixel voltages Vsig(1) to Vsig(6) are to be written to the pixels 11(1) to 11(6). Specifically, the data line driver 25 sets a voltage of the signal SIG as the voltage Vofs, in a period of the timing t81 to t82. Moreover, the data line driver 25 sets the voltage of the signal SIG as the pixel voltage Vsig(1) in a period of the timing t82 to t83, sets the voltage of the signal SIG as the pixel voltage Vsig(5) in a period of the timing t83 to t84, sets the voltage of the signal SIG as the pixel voltage Vsig(3) in a period of the timing t84 to t85, sets the voltage of the signal SIG as the pixel voltage Vsig(4) in a period of the timing t85 to t86, sets the voltage of the signal SIG as the pixel voltage Vsig(2) in a period of the timing t86 to t87, and sets the voltage of the signal SIG as the pixel voltage Vsig(6) in a period of the timing t87 to t88.

Moreover, the write control line driver 23 of the driver unit 20 generates, in the period of the timing t81 to t88, the write control signals VSCAN1(1) to VSCAN1(6) ((A) of FIG. 3) that include pulses PU1 and PU2 having positive polarity. Specifically, the write control line driver 23 generates the write control signal VSCAN1(1) that includes the pulse PU1 in the period of the timing t81 to t82 and includes the pulse PU2 in the period of the timing t82 to t83 during which the signal SIG is set as the pixel voltage Vsig(1). Moreover, the write control line driver 23 generates the write control signal VSCAN1(5) that includes the pulse PU1 in the period of the timing t81 to t82 and includes the pulse PU2 in the period of the timing t83 to t84 during which the signal SIG is set as the pixel voltage Vsig(5). Furthermore, the write control line driver 23 generates the write control signal VSCAN1(3) that includes the pulse PU1 in the period of the timing t81 to t82 and includes the pulse PU2 in the period of the timing t84 to t85 during which the signal SIG is set as the pixel voltage Vsig(3). In addition, the write control line driver 23 generates the write control signal VSCAN1(4) that includes the pulse PU1 in the period of the timing t81 to t82 and includes the pulse PU2 in the period of the timing t85 to t86 during which the signal SIG is set as the pixel voltage Vsig(4). Further, the write control line driver 23 generates the write control signal VSCAN1(2) that includes the pulse PU1 in the period of the timing t81 to t82 and includes the pulse PU2 in the period of the timing t86 to t87 during which the signal SIG is set as the pixel voltage Vsig(2). Furthermore, the write control line driver 23 generates the write control signal VSCAN1(6) that includes the pulse PU1 in the period of the timing t81 to t82 and includes the pulse PU2 in the period of the timing t87 to t88 during which the signal SIG is set as the pixel voltage Vsig(6).

Moreover, the power supply line driver 24 of the driver unit 20 generates the power supply signals VSCAN2(1) to VSCAN2(6) ((B) of FIG. 3) that rise simultaneously at certain timing within a pulse period of the pulses PU1 of the write control signals VSCAN1(1) to VSCAN1(6) in the period of the timing t81 to t82 and fall at different timing from one another. Specifically, the power supply line driver 24 changes voltages of the power supply signals VSCAN2(1) to VSCAN2(6) simultaneously from the voltage Vini to the voltage Vp, at the certain timing within the pulse period of the pulses PU1 in the period of the timing t81 to t82. Moreover, the power supply line driver 24 changes the voltage of the power supply signal VSCAN2(1) from the voltage Vp to the voltage Vini at later timing t91, changes the voltage of the power supply signal VSCAN2(5) from the voltage Vp to the voltage Vini at later timing t92, changes the voltage of the power supply signal VSCAN2(3) from the voltage Vp to the voltage Vini at later timing t93, changes the voltage of the power supply signal VSCAN2(4) from the voltage Vp to the voltage Vini at later timing t94, changes the voltage of the power supply signal VSCAN2(2) from the voltage Vp to the voltage Vini at later timing t95, and changes the voltage of the power supply signal VSCAN2(6) from the voltage Vp to the voltage Vini at later timing t96.

Thus, as described below, in the leading period (the period of the timing t81 to t88) of the one frame period (1F), the driver unit 20 writes the pixel voltage Vsig to the pixel 11(1) that belongs to the pixel line L1, the pixel 11(5) that belongs to the pixel line L5, the pixel 11(3) that belongs to the pixel line L3, the pixel 11(4) that belongs to the pixel line L4, the pixel 11(2) that belongs to the pixel line L2, and the pixel line 11(6) that belongs to the pixel line L6, in the order named. The leading period has the duration of the six horizontal periods (6H). It is to be noted that in this example, description is made with the pixel lines L1 to L6 given as an example, but the same applies to the other pixel lines.

FIG. 4 provides a timing chart of drive operation with respect to the pixels 11(1) to 11(6). In this figure, illustrated is the drive operation with respect to the pixel 11(1) that belongs to the pixel line L1 and the pixel 11(5) that belongs to the pixel line L5. In other words, in this figure, description is provided focusing on the two pixels 11(1) and 11(5) to which the pixel voltage Vsig is written first and second, in consideration that the driver unit 20 writes, as illustrated in FIG. 3, the pixel voltage Vsig to the pixel 11(1), the pixel 11(5), the pixel 11(3), the pixel 11(4), the pixel 11(2), and the pixel 11(6) in the order named, in the leading period of the one frame period (1F), with the leading period having the duration of the six horizontal periods (6H).

In FIG. 4, (A) indicates waveforms of the write control signals VSCAN1(1) and VSCAN1(5), (B) indicates waveforms of the power supply signals VSCAN2(1) and VSCAN2(5), (C) indicates the signal SIG, (D) and (E) respectively indicate waveforms of a gate voltage Vg(1) and a source voltage Vs(1) of the pixel 11(1), and (F) and (G) respectively indicate waveforms of a gate voltage Vg(5) and a source voltage Vs(5) of the pixel 11(5). In (D) and (E) of FIG. 4, the indication of the waveforms is provided using a same voltage axis. Likewise, in (F) and (G) of FIG. 4, the indication of the waveforms is provided using a same voltage axis.

In a period of timing t1 to t13 (the one frame period (1F)), the driver unit 20 performs the initialization drive D1 in an initialization period P1, performs the Vth correction drive D2 in a Vth correction period P2, performs the write drive D3 of the pixel voltage Vsig in a write and μ correction period P3, and performs the light emission drive D4 in a light emission period P4, with respect to the pixels 11(1) to 11(6). Detailed description is given below.

First, prior to the initialization period P1, the power supply line driver 24 sets the voltages of the power supply signals VSCAN2(1) to VSCAN2(6) as the voltage Vini ((B) of FIG. 4). This causes each of the drive transistors DRTr of the pixels 11(1) to 11(6) to be turned on, causing the source voltages Vs(1) to Vs(6) of the respective drive transistors DRTr to be set as the voltage Vini ((E) and (G) of FIG. 4). Moreover, at the timing t1, the data line driver 25 sets the voltage of the signal SIG as the voltage Vofs ((C) of FIG. 4).

Thereafter, the driver unit 20 performs the initialization drive D1 with respect to the pixels 11(1) to 11(6), in a period of timing t2 to t3 (the initialization period P1). Specifically, at the timing t2, the write control line driver 23 changes the voltages of the write control signals VSCAN1(1) to VSCAN1(6) from a low level to a high level ((A) of FIG. 4). This causes each of the write transistors WSTr of the pixels 11(1) to 11(6) to be turned on, causing the gate voltages Vg(1) to Vg(6) of the respective drive transistors DRTr to be set as the voltage Vofs ((D) and (F) of FIG. 4). In this way, a gate-source voltage Vgs (=Vofs−Vini) of each of the drive transistors DRTr is set as a voltage larger than the threshold voltage Vth of the relevant drive transistor DRTr. Thus, the pixels 11(1) to 11(6) are each initialized.

Thereafter, the driver unit 20 performs the Vth correction drive D2 in a period of the timing t3 to t4 (the Vth correction period P2). Specifically, at the timing t3, the power supply line driver 24 changes the power supply signals VSCAN2(1) to VSCAN2(6) from the voltage Vini to the voltage Vp ((B) of FIG. 4). This causes each of the drive transistors DRTr of the pixels 11(1) to 11(6) to operate in saturated regions. A current Ids flows from the drain to the source in each of the drive transistors DRTr, resulting in an increase in the source voltages Vs(1) to Vs(6) of the respective drive transistors DRTr ((E) and (G) of FIG. 4). It is to be noted that no current flows through the light emitting element 19, because the source voltages Vs(1) to Vs(6) are each lower than a sum (Vel+Vcath) of a threshold voltage Vel and the voltage Vcath of each of the light emitting elements 19 of the pixels 11(1) to 11(6). As described, the increase in each of the source voltages Vs(1) to Vs(6) causes a decrease in each of the gate-source voltages Vgs, resulting in a decrease in each of the currents Ids. Owing to this negative feedback operation, the currents Ids each converge toward "0" (zero). In other words, the gate-source voltage Vgs of each of the drive transistors DRTr converges to become equal to the threshold voltage Vth of the relevant drive transistor DRTr (Vgs=Vth). In this way, the gate-source voltage Vgs of each of the drive transistors DRTr is set as the threshold voltage Vth of the relevant drive transistor DRTr.

Thereafter, at the timing t4, the write control line driver 23 changes the voltages of the write control signals VSCAN1(1) to VSCAN1(6) from the high level to the low level ((A) of FIG. 4). This causes each of the write transistors WSTr of the pixels 11(1) to 11(6) to be turned off. Moreover, at timing t5, the data line driver 25 sets the voltage of the signal SIG as the pixel voltage Vsig(1) ((C) of FIG. 4).

Thereafter, in a period of timing t6 to t7 (the write and μ correction period P3), the driver unit 20 performs the write drive D3 with respect to the pixel 11(1). Specifically, at the timing t6, the write control line driver 23 changes the voltage of the write control signal VSCAN1(1) from the low level to the high level ((A) of FIG. 4). This causes the write transistor WSTr of the pixel 11(1) to be turned on, causing the gate voltage Vg(1) of the drive transistor DRTr of the pixel 11(1) to increase from the voltage Vofs to the pixel voltage Vsig(1) ((D) of FIG. 4). At this occasion, the gate-source voltage Vgs of the drive transistor DRTr becomes larger than the threshold voltage Vth (Vgs>Vth), causing the current Ids to flow from the drain to the source. Accordingly, the source voltage Vs(1) of the drive transistor DRTr increases ((E) of FIG. 4). Such negative feedback operation leads to suppression of influences of element variations in the drive transistors DRTr (the μ correction), allowing the gate-source voltage Vgs of the drive transistor DRTr of the pixel 11(1) to be set as a voltage corresponding to the pixel voltage Vsig(1).

Thereafter, in a period of the timing t7 to t11 (the light emission period P4), the driver unit 20 performs the light emission drive D4 with respect to the pixel 11(1). Specifically, at the timing t7, the write control line driver 23 changes the voltage of the write control signal VSCAN1(1) from the high level to the low level ((A) of FIG. 4). This causes the write transistor WSTr of the pixel 11(1) to be turned off, causing the gate of the drive transistor DRTr of the pixel 11(1) to become floating. After this, a terminal voltage of the capacitor Cs of the pixel 11(1), i.e., the gate-source voltage Vgs of the drive transistor DRTr is maintained. Moreover, as the current Ids flows through the drive transistor DRTr, the source voltage Vs(1) of the drive transistor DRTr increases ((E) of FIG. 4), which is accompanied by an increase in the gate voltage Vg(1) of the drive transistor DRTr as well ((D) of FIG. 4). Moreover, when the source voltage Vs(1) of the drive transistor DRTr becomes larger than the sum (Vel+Vcath) of the threshold voltage Vel and the voltage Vcath of the light emitting element 19, a current flows between the anode and the cathode of the light emitting element 19, causing light emission of the light emitting element 19. In other words, the source voltage Vs(1) increases by an amount of element variations of the light emitting element 19, causing the light emission of the light emitting element 19 of the pixel 11(1).

Thereafter, at timing t8, the data line driver 25 sets the voltage of the signal SIG as the pixel voltage Vsig(5) ((C) of FIG. 4).

Thereafter, in a period of timing t9 to t10 (the write and μ correction period P3), the driver unit 20 performs the write drive D3 with respect to the pixel 11(5). Specifically, at the timing t9, the write control line driver 23 changes the voltage of the write control signal VSCAN1(5) from the low level to the high level ((A) of FIG. 4). In this way, as with the case of the pixel 11(1), the gate-source voltage Vgs of the drive transistor DRTr of the pixel 11(5) is set as a voltage corresponding to the pixel voltage Vsig(5).

Thereafter, in a period of the timing t10 to t12 (the light emission period P4), the driver unit 20 performs the light emission drive D4 with respect to the pixel 11(5). Specifically, at the timing t10, the write control line driver 23 changes the voltage of the write control signal VSCAN1(5) from the high level to the low level ((A) of FIG. 4). In this way, as with the case of the pixel 11(1), the gate voltage Vg(5) and the source voltage Vs(5) of the drive transistor DRTr of the pixel 11(5) increase ((F) and (G) of FIG. 4), causing the light emission of the light emitting element 19 of the pixel 11(5).

Thereafter, although undepicted, the driver unit 20 performs the write drive D3 and the light emission drive D4 in a similar manner, with respect to the pixel 11(3), the pixel 11(4), the pixel 11(2), and the pixel 11(6), in the order named.

Moreover, at the timing t11, the power supply line driver 24 changes the voltage of the power supply signal VSCAN2 (1) from the voltage Vp to the voltage Vini. This causes the source voltage Vs(1) of the drive transistor DRTr of the pixel 11(1) to fall and to be set as the voltage Vini ((E) of FIG. 4). At this occasion, because the gate-source voltage Vgs of the drive transistor DRTr is maintained, the gate voltage Vg(1) of the drive transistor DRTr also falls ((D) of FIG. 4). As a result, the light emitting element 19 of the pixel 11(1) is put out.

Thereafter, at the timing t12, the power supply line driver 24 changes the voltage of the power supply signal VSCAN2 (5) from the voltage Vp to the voltage Vini. Accordingly, as with the case of the pixel 11(1), the gate voltage Vg(5) and the source voltage Vs(5) of the drive transistor DRTr of the pixel 11(5) fall ((F) and (G) of FIG. 4), and the light emitting element 19 of the pixel 11(5) is put out.

Thereafter, although undepicted, the driver unit 20 puts out the pixel 11(3), the pixel 11(4), the pixel 11(2), and the pixel 11(6) in the order named.

In this way, at the timing t13, the one frame period (1F) finishes. The driver unit 20 repeats such operation with respect to the pixels 11(1) to 11(6). Thus, the display device 1 displays an image.

In the display device 1, as described, the Vth correction drive D2 is performed simultaneously with respect to the six pixels 11(1) to 11(6). Hence, it is possible to reduce time necessary for the Vth correction, as compared to a case where the Vth correction is made separately with respect to the six pixels 11(1) to 11(6). As a result, in the display device 1, it is possible to enhance, for example, resolution. To be specific, because a display unit having high resolution includes many pixel lines, time duration of one horizontal period (1H) becomes shorter. Accordingly, time assigned to, for example, the Vth correction period P2 and the write and μ correction period P3 becomes shorter. In the display device 1, the Vth correction drive D2 is performed simultaneously with respect to the six pixels 11(1) to 11(6), making it possible to reduce the time necessary for the Vth correction. Hence, it is possible to ensure the time assigned to the write and μ correction period P3. As a result, in the display device 1, it is possible to enhance the resolution.

FIG. 5 illustrates drive operation with respect to the pixels 11 that belong to the pixel lines L1 to L12. It is to be noted that in FIG. 5, for convenience of explanation, illustration is omitted except for the Vth correction drive D2 and the write drive D3.

Referring to FIG. 5, in the period having the duration of the six horizontal periods (6H), the driver unit 20 performs, first, the Vth correction drive D2 simultaneously with respect to the pixels 11 that belong to the pixel lines L1 to L6, and thereafter, performs the write drive D3 with respect to the pixels 11 in the following order: the pixel lines L1, L5, L3, L4, L2, and L6. In other words, because the pixel line L1 is scanned first out of the six pixel lines L1 to L6, the scanning ordinal number NS is "1". Because the pixel line L2 is scanned fifth, the scanning ordinal number NS is "5". Because the pixel line L3 is scanned third, the scanning ordinal number NS is "3". Because the pixel line L4 is scanned fourth, the scanning ordinal number NS is "4". Because the pixel line L5 is scanned second, the scanning ordinal number NS is "2". Because the pixel line L6 is scanned sixth, the scanning ordinal number NS is "6".

Moreover, in the next period having the duration of the six horizontal periods (6H), the driver unit 20 performs, first, the Vth correction drive D2 simultaneously with respect to the pixels 11 that belong to the pixel lines L7 to L12, and thereafter, performs the write drive D3 with respect to the pixels 11 in the following order: the pixel lines L7, L11, L9, L10, L8 and L12. In other words, the scanning ordinal numbers NS of the pixel lines L7 to L12 are respectively "1", "5", "3", "4", "2", and "6". That is, the driver unit 20 performs the write drive D3 with respect to the pixel lines L7 to L12 in a same scanning order as that of the pixel lines L1 to L6. The same applies to the other pixel lines.

At this occasion, a length of time between the Vth correction drive D2 and the write drive D3 differs according to the pixel lines L. Specifically, for example, the time between the Vth correction drive D2 and the write drive D3 is short in the pixel lines L1, L7, . . . on which the write drive D3 is performed first out of the six pixel lines L. The time between the Vth correction drive D2 and the write drive D3 is long in the pixel lines L6, L12, . . . on which the write drive D3 is performed last out of the six pixel lines L. Accordingly, as described below, there is possibility of differences in intensity even in a case where the same pixel voltage Vsig is written to the pixels 11 that belong to each of the pixel lines L.

FIG. 6 illustrates the intensity of the pixels 11 that belong to the pixel lines L1 to L12, in the case where the same pixel voltage Vsig is written. In this example, the intensity of the pixels 11 that belong to the pixel lines L1 and L7 is the highest. The intensity is gradually lowered in the following order: the pixel lines L5 and L12, the pixel lines L3 and L9, the pixel lines L4 and L10, the pixel lines L2 and L8, and the pixel lines L6 and L12. This order corresponds to the scanning ordinal numbers NS. Specifically, for example, the time between the Vth correction drive D2 and the write drive D3 is long in the pixels 11 that belong to the pixel lines L6 and L12 on which the write drive D3 is performed last. Accordingly, during the time, a leak current of the capacitor Cs or an off leak current of the write transistor WSTr, or other factors causes possibility that the gate-source voltage Vgs of the drive transistor DRTr is lowered from the threshold voltage Vth. In this case, even if the pixel voltage Vsig is written afterwards, the gate-source voltage Vgs of the drive transistor DRTr becomes slightly small, resulting in lowered intensity. As described, there is the possibility of the differences in the intensity according to the scanning ordinal numbers NS, even in the case where the same pixel voltage Vsig is written.

However, in this display device 1, as illustrated in FIG. 5, the write drive D3 is performed in the scanning order in which, for example, a sum S of the scanning ordinal numbers NS of any two adjacent pixel lines L approximates to a predetermined value. In other words, the sum S of the scanning ordinal number NS of the pixel line L1 and the scanning ordinal number NS of the pixel line L2 is "6" (=1+5). The sum S of the scanning ordinal number NS of the pixel line L2 and the scanning ordinal number NS of the pixel line L3 is "8" (=5+3). The sum S of the scanning ordinal number NS of the pixel line L3 and the scanning ordinal number NS of the pixel line L4 is "7" (=3+4). The sum S of the scanning ordinal number NS of the pixel line L4 and the scanning ordinal number NS of the pixel line L5 is "6" (=4+2). The sum S of the scanning ordinal number NS of the pixel line L5 and the scanning ordinal number NS of the pixel line L6 is "8" (=2+6). The sum S of the scanning ordinal number NS of the pixel line L6 and the scanning ordinal number NS of the pixel line L7 (L1) is "7" (=6+1). That is, in this example, the sum S of the scanning ordinal numbers NS of any two adjacent pixel lines L ranges from 6 to 8 both inclusive, with a smaller variation width than those of cases of comparative examples described later. Accordingly, in the display device 1, as described below, it is possible to enhance a spatial frequency fs in intensity distribution in a scanning direction. Hence, it is possible to enhance image quality.

FIG. 7 illustrates relation between the spatial frequency fs and contrast sensitivity. In general, an observer is most sensitive to contrast changes at a certain spatial frequency f0, and becomes less sensitive to the contrast changes as is away from the spatial frequency f0. Here, the spatial frequency fs corresponding to a pixel pitch in the scanning direction (the vertical direction in FIG. 1) is sufficiently higher than the spatial frequency f0. Accordingly, for example, in a case with alternate display of white and black on the one-pixel-line basis, with cycles of two pixel lines, the observer is insensitive to the contrast changes, and observes the alternate display as uniform gray, because the spatial frequency fs is sufficiently higher than the spatial frequency f0. Moreover, for example, in a case with alternate display of white and black on the three-pixel-line basis, with cycles of six pixel lines, the observer becomes more sensitive to the contrast changes, as compared to the case with the alternate display of white and black on the one-pixel-line basis.

FIG. 8 illustrates one example of a result of fast Fourier transform carried out on the basis of the intensity distribution in the scanning direction of the display device 1. The fast Fourier transform corresponds to fast Fourier transform of a numerical sequence "153426153426 . . . " of the scanning ordinal numbers NS. In FIG. 8, a vertical axis denotes a Fourier component, and a horizontal axis denotes a cycle on the pixel-line basis.

As illustrated in FIG. 8, in the display device 1, there is the largest spike of the component at the cycle of the two pixel lines. In other words, in the display device 1, the write drive D3 is performed in the scanning order in which the sum of the scanning ordinal numbers NS of any two adjacent pixel lines L approximates to the predetermined value. Accordingly, unlike the cases of the comparative examples described below, it is possible to reduce the components having the long cycle. That is, in the display device 1, it is possible to enhance the spatial frequency fs in the intensity distribution in the scanning direction. As a result, in the display device 1, it is possible to reduce possibility that the observer senses the contrast changes, and to enhance the image quality.

Comparative Examples

Description is given next of workings of this embodiment, in comparison with some comparative examples.

FIG. 9 illustrates drive operation in a display device 1R according to a comparative example. FIG. 9 corresponds to FIG. 5 according to this embodiment. In the period having the duration of the six horizontal periods (6H), a driver unit 20R according to the display device 1R performs, first, the Vth correction drive D2 simultaneously with respect to the pixels 11 that belong to the pixel lines L1 to L6, and thereafter, performs the write drive D3 with respect to the pixels 11 in the following order: the pixel lines L1, L2, L3, L4, L5, and L6. In other words, the scanning ordinal numbers NS of the pixel lines L1 to L6 are respectively "1", "2", "3", "4", "5", and "6". Moreover, in the next period having the duration of the six horizontal periods (6H), the driver unit 20R performs, first, the Vth correction drive D2 simultaneously with respect to the pixels 11 that belong to the pixel lines L7 to L12, and thereafter, performs the write drive D3 with respect to the pixels 11 in the following order: the pixel lines L7, L8, L9, L10, L11, and L12. In other words, the scanning ordinal numbers NS of the pixel lines L7 to L12 are respectively "1", "2", "3", "4", "5", and "6".

In this case, for example, the sum S of the scanning ordinal number NS of the pixel line L1 and the scanning ordinal number NS of the pixel line L2 is "3" (=1+2). The sum S of the scanning ordinal number NS of the pixel line L2 and the scanning ordinal number NS of the pixel line L3 is "5" (=2+3). The sum S of the scanning ordinal number NS of the pixel line L3 and the scanning ordinal number NS of the pixel line L4 is "7" (=3+4). The sum S of the scanning ordinal number NS of the pixel line L4 and the scanning ordinal number NS of the pixel line L5 is "9" (=4+5). The sum S of the scanning ordinal number NS of the pixel line L5 and the scanning ordinal number NS of the pixel line L6 is "11" (=5+6). The sum S of the scanning ordinal number NS of the pixel line L6 and the scanning ordinal number NS of the pixel line L7 (L1) is "7" (=6+1). That is, in the display device 1R, the sum S of the scanning ordinal numbers NS of any two adjacent pixel lines L ranges from 3 to 11 both inclusive, with a larger variation width than the case of the display device 1.

FIG. 10 illustrates intensity in the display device 1R in the case where the same pixel voltage Vsig is written. In this example, the intensity of the pixels 11 that belong to the pixel lines L1 and L7 is the highest. The intensity is gradually lowered in the following order: the pixel lines L2 and L8, the pixel lines L3 and L9, the pixel lines L4 and L10, the pixel lines L5 and L11, and the pixel lines L6 and L12, corresponding to the scanning ordinal numbers NS.

FIG. 11 illustrates one example of a result of the fast Fourier transform carried out on the basis of the intensity distribution in the scanning direction of the display device 1R. The fast Fourier transform corresponds to fast Fourier transform of a numerical sequence "123456123456 . . . " of the scanning ordinal numbers NS. As illustrated in FIG. 11, in the display device 1R, there is a spike of the component at the cycle of the six pixel lines. In other words, in the display device 1R, the spatial frequency fs in the intensity distribution in the scanning direction is lowered. As a result, in the display device 1R, there is possibility that the observer senses the contrast changes, and has a feeling that image quality is low.

FIG. 12 illustrates drive operation in a display device 1S according to another comparative example. In the period having the duration of the six horizontal periods (6H), a driver unit 20S according to the display device 1S performs, first, the Vth correction drive D2 simultaneously with respect to the pixels 11 that belong to the pixel lines L1 to L6, and thereafter, performs the write drive D3 with respect to the pixels 11 in the following order: the pixel lines L1, L2, L3, L4, L5, and L6. In other words, the scanning ordinal numbers NS of the pixel lines L1 to L6 are respectively "1", "2", "3", "4", "5", and "6". Moreover, in the next period having the duration of the six horizontal periods (6H), the driver unit 20S performs, first, the Vth correction drive D2 simultaneously with respect to the pixels 11 that belong to the pixel lines L7 to L12, and thereafter, performs the write drive D3 with respect to the pixels 11 in the following order: the pixel lines L12, L11, L10, L9, L8, and L7. In other words, the scanning ordinal numbers NS of the pixel lines L7 to L12 are respectively "6", "5", "4", "3", "2", and "1". That is, in the display device 1S, a sequence of the scanning ordinal numbers NS in the pixel lines L7 to L12 is in reverse to a sequence of the scanning ordinal numbers NS in the pixel lines L1 to L6.

In this case, the sum S of the scanning ordinal number NS of the pixel line L1 and the scanning ordinal number NS of the pixel line L2 is "3" (=1+2). The sum S of the scanning ordinal number NS of the pixel line L2 and the scanning ordinal number NS of the pixel line L3 is "5" (=2+3). The sum S of the scanning ordinal number NS of the pixel line L3 and the scanning ordinal number NS of the pixel line L4 is "7" (=3+4). The sum S of the scanning ordinal number NS of the pixel line L4 and the scanning ordinal number NS of the pixel line L5 is "9" (=4+5). The sum S of the scanning ordinal number NS of the pixel line L5 and the scanning ordinal number NS of the pixel line L6 is "11" (=5+6). The sum S of the scanning ordinal number NS of the pixel line L6 and the scanning ordinal number NS of the pixel line L7 is "12" (=6+6). The sum S of the scanning ordinal number NS of the pixel line L7 and the scanning ordinal number NS of the pixel line L8 is "11" (=6+5). The sum S of the scanning ordinal number NS of the pixel line L8 and the scanning ordinal number NS of the pixel line L9 is "9" (=5+4). The sum S of the scanning ordinal number NS of the pixel line L9 and the scanning ordinal number NS of the pixel line L10 is "7" (=4+3). The sum S of the scanning ordinal number NS of the pixel line L10 and the scanning ordinal number NS of the pixel line L11 is "5" (=3+2). The sum S of the scanning ordinal number NS of the pixel line L11 and the scanning ordinal number NS of the pixel line L12 is "3" (=2+1). The sum S of the scanning ordinal number NS of the pixel line L12 and the scanning ordinal number NS of the pixel line L13 (L1) is "2" (=1+1). That is, in the display device 1S, the sum S of the scanning ordinal numbers NS of any two adjacent pixel lines L ranges from 2 to 12 both inclusive, with an even larger variation width than the case of the display device 1R.

FIG. 13 illustrates intensity in the display device 1S in the case where the same pixel voltage Vsig is written. In this example, the intensity of the pixels 11 that belong to the pixel lines L1 and L12 is the highest. The intensity is gradually lowered in the following order: the pixel lines L2 and L11, the pixel lines L3 and L10, the pixel lines L4 and L9, the pixel lines L5 and L8, and the pixel lines L6 and L7, corresponding to the scanning ordinal numbers NS.

FIG. 14 illustrates one example of a result of the fast Fourier transform carried out on the basis of the intensity distribution in the scanning direction of the display device 1S. The fast Fourier transform corresponds to fast Fourier transform of a numerical sequence "123456654321 . . . " of the scanning ordinal numbers NS. As illustrated in FIG. 14, in the display device 1S, there is a spike of the component at the cycle of the twelve pixel lines. In other words, in the display device 1S, the spatial frequency fs in the intensity distribution in the scanning direction is more lowered. As a result, in the display device 1S, there is possibility that the observer senses the contrast changes, and has the feeling that the image quality is low.

As described, in the display devices 1R and 1S according to the comparative examples, the write drive D3 with respect to the pixels 11 is performed, for example, in the following order: the pixel lines L1, L2, L3, L4, L5, and L6. This causes the spatial frequency fs in the intensity distribution in the scanning direction to be lowered. As a result, there is possibility that the observer senses the contrast changes, and has the feeling that the image quality is low.

In contrast, in the display device 1 according to this embodiment, the write drive D3 is performed in the scanning order in which the sum of the scanning ordinal numbers NS of any two adjacent pixel lines L approximates to the predetermined value. This makes it possible to maximize the Fourier component at the cycle of the two pixel lines, in the intensity distribution in the scanning direction, leading to enhancement in the spatial frequency fs. As a result, it is possible to reduce the possibility that the observer senses the contrast changes, and to enhance the image quality.

Effects

As described, in this embodiment, the Vth correction drive is performed simultaneously with respect to the plurality of pixels. Hence, it is possible to enhance resolution, resulting in enhancement in the image quality.

In this embodiment, the write drive is performed in the scanning order in which the sum of the scanning ordinal numbers of any two adjacent pixel lines approximates to the predetermined value. Hence, it is possible to enhance the image quality.

Modification Example 1-1

In the forgoing embodiment, the write drive D3 with respect to the pixels 11 is performed in the following order: the pixel lines L1, L5, L3, L4, L2, and L6. However, this is non-limiting. In what follows, detailed description is made on this modification example, by giving some examples.

FIG. 15 illustrates drive operation in a display device 1A according to this modification example. In the period having the duration of the six horizontal periods (6H), a driver unit 20A according to the display device 1A performs, first, the Vth correction drive D2 simultaneously with respect to the pixels 11 that belong to the pixel lines L1 to L6, and thereafter, performs the write drive D3 with respect to the pixels 11 in the following order: the pixel lines L6, L2, L4, L3, L5, and L1. In other words, the scanning ordinal numbers NS of the pixel lines L1 to L6 are respectively "6", "2", "4", "3", "5", and "1". Moreover, in the next period having the duration of the six horizontal periods (6H), the driver unit 20A performs, first, the Vth correction drive D2 simultaneously with respect to the pixels 11 that belong to the pixel lines L7 to L12, and thereafter, performs the write drive D3 with respect to the pixels 11 in the following order: the pixel lines L12, L8, L10, L9, L11, and L7. In other words, the scanning ordinal numbers NS of the pixel lines L7 to L12 are respectively "6", "2", "4", "3", "5", and "1". Thus, in the display device 1A according to this modification example, the sequence of the scanning ordinal numbers NS is in reverse to that of the case of the display device 1 according to the first embodiment ("1", "5", "3", "4", "2", and "6").

In this case, for example, the sum S of the scanning ordinal number NS of the pixel line L1 and the scanning ordinal number NS of the pixel line L2 is "8" (=6+2). The sum S of the scanning ordinal number NS of the pixel line L2 and the scanning ordinal number NS of the pixel line L3 is "6" (=2+4). The sum S of the scanning ordinal number NS of the pixel line L3 and the scanning ordinal number NS of the pixel line L4 is "7" (=4+3). The sum S of the scanning ordinal number NS of the pixel line L4 and the scanning ordinal number NS of the pixel line L5 is "8" (=3+5). The sum S of the scanning ordinal number NS of the pixel line L5 and the scanning ordinal number NS of the pixel line L6 is "6" (=5+1). The sum S of the scanning ordinal number NS of the pixel line L6 and the scanning ordinal number NS of the pixel line L7 (L1) is "7" (=1+6).

FIG. 16 illustrates intensity in the display device 1A in the case where the same pixel voltage Vsig is written. In this example, the intensity of the pixels 11 that belong to the pixel lines L6 and L12 is the highest. The intensity is gradually lowered in the following order: the pixel lines L2 and L8, the pixel lines L4 and L10, the pixel lines L3 and L9, the pixel lines L5 and L11, and the pixel lines L1 and L7, corresponding to the scanning ordinal numbers NS.

With this configuration as well, as illustrated in FIG. 15, it is possible to allow the sum of the scanning ordinal numbers NS of any two adjacent pixel lines L to approximate to the predetermined value. It is therefore possible to enhance the spatial frequency in the intensity distribution in the scanning direction. Hence, it is possible to enhance the image quality.

FIG. 17 illustrates drive operation in another display device 1B according to this modification example. In the period having the duration of the six horizontal periods (6H), a driver unit 20B according to the display device 1B performs, first, the Vth correction drive D2 simultaneously with respect to the pixels 11 that belong to the pixel lines L1 to L6, and thereafter, performs the write drive D3 with respect to the pixels 11 in the following order: the pixel lines L3, L5, L1, L6, L2, and L4. In other words, the scanning ordinal numbers NS of the pixel lines L1 to L6 are respectively "3", "5", "1", "6", "2", and "4". Moreover, in the next period having the duration of the six horizontal periods (6H), the driver unit 20B performs, first, the Vth correction drive D2 simultaneously with respect to the pixels 11 that belong to the pixel lines L7 to L12, and thereafter, performs the write drive D3 with respect to the pixels 11 in the following order: the pixel lines L9, L11, L7, L12, L8, and L10. In other words, the scanning ordinal numbers NS of the pixel lines L7 to L12 are respectively "3", "5", "1", "6", "2", and "4". Thus, the sequence of the scanning ordinal numbers NS in the display device 1B according to this modification example is an equivalent to that of the case of the display device 1A according to this modification example ("6", "2", "4", "3", "5", and "1"), with the first three and the last three changed over.

In this case, for example, the sum S of the scanning ordinal number NS of the pixel line L1 and the scanning ordinal number NS of the pixel line L2 is "8" (=3+5). The sum S of the scanning ordinal number NS of the pixel line L2 and the scanning ordinal number NS of the pixel line L3 is "6" (=5+1). The sum S of the scanning ordinal number NS of the pixel line L3 and the scanning ordinal number NS of the pixel line L4 is "7" (=1+6). The sum S of the scanning ordinal number NS of the pixel line L4 and the scanning ordinal number NS of the pixel line L5 is "8" (=6+2). The sum S of the scanning ordinal number NS of the pixel line L5 and the scanning ordinal number NS of the pixel line L6 is "6" (=2+4). The sum S of the scanning ordinal number NS of the pixel line L6 and the scanning ordinal number NS of the pixel line L7 (L1) is "7" (=4+3).

FIG. 18 illustrates intensity in the display device 1B in the case where the same pixel voltage Vsig is written. In this example, the intensity of the pixels 11 that belong to the pixel lines L3 and L9 is the highest. The intensity is gradually lowered in the following order: the pixel lines L5 and L11, the pixel lines L1 and L7, the pixel lines L6 and L12, the pixel lines L2 and L8, and the pixel lines L4 and L10, corresponding to the scanning ordinal numbers NS.

With this configuration as well, as illustrated in FIG. 17, it is possible to allow the sum of the scanning ordinal numbers NS of any two adjacent pixel lines L to approximate to the predetermined value. It is therefore possible to enhance the spatial frequency in the intensity distribution in the scanning direction. Hence, it is possible to enhance the image quality.

It is to be noted that in the display device 1B, the first three and the last three are changed over in the sequence of the scanning ordinal numbers NS in the display device 1A according to this modification example. However, this is non-limiting. Alternative examples are as follows. The first one and the remaining five may be changed over. The first two and the remaining four may be changed over. The first four and the remaining two may be changed over. The first five and the remaining one may be changed over. Moreover, in the display device 1B, the scanning ordinal numbers NS in the display device 1A according to this modification example are changed over. However, this is non-limiting. In one alternative, for example, the scanning ordinal numbers NS in the display device 1 according to the embodiment may be changed over.

Modification Example 1-2

In the forgoing embodiment, in each frame period, the write drive D3 with respect to the pixels 11 is performed in the same scanning order. However, this is non-limiting. In one alternative, the scanning order may be changed for each frame period. Specifically, for example, in frame periods of odd-numbered frames, as illustrated in FIG. 5, the write drive D3 with respect to the pixels 11 may be performed in the following order: the pixel lines L1, L5, L3, L4, L2, and L6. In frame periods of even-numbered frames, as illustrated in FIG. 15, the write drive D3 with respect to the pixels 11 may be performed in the following order: the pixel lines L6, L2, L4, L3, L5, and L1. In other words, in this example, the sequence of the scanning ordinal numbers NS is reversed between the odd-numbered frames and the even-numbered frames. This causes the intensity distribution in the scanning direction to change for each frame period, as illustrated in FIG. 19, leading to uniformization of the intensity of each pixel line L. It is therefore possible to provide further improvement in the image quality.

Modification Example 1-3

In the forgoing embodiment, the write drive D3 is performed in the scanning order in which the sum S of the scanning ordinal numbers NS of any two adjacent pixel lines L approximates to the predetermined value. However, this is non-limiting. In the following, detailed description is given of this modification example.

FIG. 20 illustrates drive operation in a display device 1D according to this modification example. In a period having duration of twelve horizontal periods (12H), a driver unit 20D according to the display device 1D performs, first, the Vth correction drive D2 simultaneously with respect to the pixels 11 that belong to the pixel lines L1 to L12, and thereafter, performs the write drive D3 with respect to the pixels 11 in the following order: the pixel lines L1, L2, L9, L10, L5, L6, L7, L8, L3, L4, L11, and L12. In this example, the scanning ordinal number NS is set in units of the two pixel lines. The scanning ordinal number NS of the pixel lines L1 and L2 is "1". The scanning ordinal number NS of the pixel lines L3 and L4 is "5". The scanning ordinal number NS of the pixel lines L5 and L6 is "3". The scanning ordinal number NS of the pixel lines L7 and L8 is "4". The scanning ordinal number NS of the pixel lines L9 and L10 is "2". The scanning ordinal number NS of the pixel lines L11 and L12 is "6". In other words, the sequence of the scanning ordinal numbers NS is "1", "5", "3", "4", "2", and "6", as with the case of the first embodiment.

Here, for example, the pixel lines L1 to L12 correspond to one specific example of a "plurality of pixel lines" in the disclosure. For example, the pixel lines L1 and L2 correspond to one specific example of a "pixel line group" in the disclosure.

FIG. 21 illustrates intensity in the display device 1D in the case where the same pixel voltage Vsig is written. In this example, the intensity of the pixels 11 that belong to the pixel lines L1 is the highest. The intensity is gradually lowered in the following order: the pixel lines L2, L9, L10, L5, L6, L7, L8, L3, L4, L11, and L12, corresponding to the scanning ordinal numbers NS. With this configuration as well, it is possible to enhance the spatial frequency fs in the intensity distribution in the scanning direction. Hence, it is possible to enhance the image quality.

Modification Example 1-4

In the forgoing embodiment, the scanning drive is made on the six-pixel-line-L basis. However, this is non-limiting. In the following, detailed description is made on this modification example, by giving some examples.

FIG. 22 illustrates drive operation in a display device 1E according to this modification example. The display device 1E makes the scanning drive on the four-pixel-line-L basis. In a period having duration of four horizontal periods (4H), a driver unit 20E according to the display device 1E performs, first, the Vth correction drive D2 simultaneously with respect to the pixels 11 that belong to the pixel lines L1 to L4, and thereafter, performs the write drive D3 with respect to the pixels 11 in the following order: the pixel lines L1, L3, L2, and L4. In other words, the scanning ordinal numbers NS of the pixel lines L1 to L4 are respectively "1", "3", "2", and "4". Moreover, in the next period having the duration of the four horizontal periods (4H), the driver unit 20E performs, first, the Vth correction drive D2 simultaneously with respect to the pixels 11 that belong to the pixel lines L5 to L8, and thereafter, performs the write drive D3 with respect to the pixels 11 in the following order: the pixel lines L5, L7, L6, and L8. In other words, the scanning ordinal numbers NS of the pixel lines L5 to L8 are respectively "1", "3", "2", and "4".

In this case, for example, the sum S of the scanning ordinal number NS of the pixel line L1 and the scanning ordinal number NS of the pixel line L2 is "4" (=1+3). The sum S of the scanning ordinal number NS of the pixel line L2 and the scanning ordinal number NS of the pixel line L3 is "5" (=3+2). The sum S of the scanning ordinal number NS of the pixel line L3 and the scanning ordinal number NS of the pixel line L4 is "6" (=2+4). The sum S of the scanning ordinal number NS of the pixel line L4 and the scanning ordinal number NS of the pixel line L5 (L1) is "5" (=4+1). That is, in this example, the sum S of the scanning ordinal numbers NS of any two adjacent pixel lines L ranges from 4 to 6 both inclusive.

FIG. 23 illustrates drive operation in another display device 1F according to this modification example. The display device 1F makes the scanning drive on the five-pixel-line-L basis. In a period having duration of five horizontal periods (5H), a driver unit 20F according to the display device 1F performs, first, the Vth correction drive D2 simultaneously with respect to the pixels 11 that belong to the pixel lines L1 to L5, and thereafter, performs the write drive D3 with respect to the pixels 11 in the following order: the pixel lines L1, L4, L3, L2, and L5. In other words, the scanning ordinal numbers NS of the pixel lines L1 to L5 are respectively "1", "4", "3", "2", and "5". Moreover, in the next period having the duration of the five horizontal periods (5H), the driver unit 20F performs, first, the Vth correction drive D2 simultaneously with respect to the pixels 11 that belong to the pixel lines L6 to L10, and thereafter, performs the write drive D3 with respect to the pixels 11 in the following order: the pixel lines L6, L9, L8, L7, and L10. In other words, the scanning ordinal numbers NS of the pixel lines L6 to L10 are respectively "1", "4", "3", "2", and "5".

In this case, for example, the sum S of the scanning ordinal number NS of the pixel line L1 and the scanning ordinal number NS of the pixel line L2 is "5" (=1+4). The sum S of the scanning ordinal number NS of the pixel line L2 and the scanning ordinal number NS of the pixel line L3 is "7" (=4+3). The sum S of the scanning ordinal number NS of the pixel line L3 and the scanning ordinal number NS of the pixel line L4 is "5" (=3+2). The sum S of the scanning ordinal number NS of the pixel line L4 and the scanning ordinal number NS of the pixel line L5 is "7" (=2+5). The sum S of the scanning ordinal number NS of the pixel line L5 and the scanning ordinal number NS of the pixel line L6 (L1) is "6" (=5+1). That is, in this example, the sum S of the scanning ordinal numbers NS of any two adjacent pixel lines L ranges from 5 to 7 both inclusive.

FIG. 24 illustrates drive operation in another display device 1G according to this modification example. The display device 1G makes the scanning drive on the seven-pixel-line-L basis. In a period having duration of seven horizontal periods (7H), a driver unit 20G according to the display device 1G performs, first, the Vth correction drive D2 simultaneously with respect to the pixels 11 that belong to the pixel lines L1 to L7, and thereafter, performs the write drive D3 with respect to the pixels 11 in the following order: the pixel lines L1, L6, L3, L4, L5, L2, and L7. In other words, the scanning ordinal numbers NS of the pixel lines L1 to L7 are respectively "1", "6", "3", "4", "5", "2", and "7". Moreover, in the next period having the duration of the seven horizontal periods (7H), the driver unit 20G performs, first, the Vth correction drive D2 simultaneously with respect to the pixels 11 that belong to the pixel lines L8 to L14, and thereafter, performs the write drive D3 with respect to the pixels 11 in the following order: the pixel lines L8, L13, L10, L11, L12, L9, and L14. In other words, the scanning ordinal numbers NS of the pixel lines L8 to L14 are respectively "1", "6", "3", "4", "5", "2", and "7".

In this case, for example, the sum S of the scanning ordinal number NS of the pixel line L1 and the scanning ordinal number NS of the pixel line L2 is "7" (=1+6). The sum S of the scanning ordinal number NS of the pixel line L2 and the scanning ordinal number NS of the pixel line L3 is "9" (=6+3). The sum S of the scanning ordinal number NS of the pixel line L3 and the scanning ordinal number NS of the pixel line L4 is "7" (=3+4). The sum S of the scanning ordinal number NS of the pixel line L4 and the scanning ordinal number NS of the pixel line L5 is "9" (=4+5). The sum S of the scanning ordinal number of the pixel line L5 and the scanning ordinal number NS of the pixel line L6 is "7" (=5+2). The sum S of the scanning ordinal number NS of the pixel line L6 and the scanning ordinal number NS of the pixel line L7 is "9" (=2+7). The sum S of the scanning ordinal number NS of the pixel line L7 and the scanning ordinal number NS of the pixel line L8 (L1) is "8" (=7+1). That is, in this example, the sum S of the scanning ordinal numbers NS of any two adjacent pixel lines L ranges from 7 to 9 both inclusive.

FIG. 25 illustrates drive operation in another display device 1H according to this modification example. The display device 1H makes the scanning drive on the eight-pixel-line-L basis. In a period having duration of eight horizontal periods (8H), a driver unit 20H according to the display device 1H performs, first, the Vth correction drive D2 simultaneously with respect to the pixels 11 that belong to the pixel lines L1 to L8, and thereafter, performs the write drive D3 with respect to the pixels 11 in the following order: the pixel lines L1, L7, L3, L5, L4, L6, L2, and L8. In other words, the scanning ordinal numbers NS of the pixel lines L1 to L8 are respectively "1", "7", "3", "5", "4", "6", "2", and "8". Moreover, in the next period having the duration of the eight horizontal periods (8H), the driver unit 20H performs, first, the Vth correction drive D2 simultaneously with respect to the pixels 11 that belong to the pixel lines L9 to L16, and thereafter, performs the write drive D3 with respect to the pixels 11 in the following order: the pixel lines L9, L15, L11, L13, L12, L14, L10, and L16. In other words, the scanning ordinal numbers NS of the pixel lines L9 to L16 are respectively "1", "7", "3", "5", "6", "2", and "8".

In this case, for example, the sum S of the scanning ordinal number NS of the pixel line L1 and the scanning ordinal number NS of the pixel line L2 is "8" (=1+7). The sum S of the scanning ordinal number NS of the pixel line L2 and the scanning ordinal number NS of the pixel line L3 is "10" (=7+3). The sum S of the scanning ordinal number NS of the pixel line L3 and the scanning ordinal number NS of the pixel line L4 is "8" (=3+5). The sum S of the scanning ordinal number NS of the pixel line L4 and the scanning ordinal number NS of the pixel line L5 is "9" (=5+4). The sum S of the scanning ordinal number NS of the pixel line L5 and the scanning ordinal number NS of the pixel line L6 is "10" (=4+6). The sum S of the scanning ordinal number NS of the pixel line L6 and the scanning ordinal number NS of the pixel line L7 is "8" (=6+2). The sum S of the scanning ordinal number NS of the pixel line L7 and the scanning ordinal number NS of the pixel line L8 is "10" (=2+8). The sum S of the scanning ordinal number NS of the pixel line L8 and the scanning ordinal number NS of the pixel line L9 (L1) is "9" (=8+1). That is, in this example, the sum S of the scanning ordinal numbers NS of any two adjacent pixel lines L ranges from 8 to 10 both inclusive.

FIG. 26 illustrates drive operation in another display device 1J according to this modification example. The display device 1J makes the scanning drive on the nine-pixel-line-L basis. In a period having duration of nine horizontal periods (9H), a driver unit 20J according to the display device 1J performs, first, the Vth correction drive D2 simultaneously with respect to the pixels 11 that belong to the pixel lines L1 to L9, and thereafter, performs the write drive D3 with respect to the pixels 11 in the following order: the pixel lines L1, L8, L3, L6, L5, L4, L7, L2, and L9. In other words, the scanning ordinal numbers NS of the pixel lines L1 to L9 are respectively "1", "8", "3", "6", "5", "4", "7", "2", and "9". Moreover, in the next period having the duration of the nine horizontal periods (9H), the driver unit 20J performs, first, the Vth correction drive D2 simultaneously with respect to the pixels 11 that belong to the pixel lines L10 to L18, and thereafter, performs the write drive D3 with respect to the pixels 11 in the following order: the pixel lines L10, L17, L12, L15, L14, L13, L16, L11, and L18. In other words, the scanning ordinal numbers NS of the pixel lines L10 to L18 are respectively "1", "8", "3", "6", "5" "4", "7", "2", and "9".

In this case, for example, the sum S of the scanning ordinal number NS of the pixel line L1 and the scanning ordinal number NS of the pixel line L2 is "9" (=1+8). The sum S of the scanning ordinal number NS of the pixel line L2 and the scanning ordinal number NS of the pixel line L3 is "11" (=8+3). The sum S of the scanning ordinal number NS of the pixel line L3 and the scanning ordinal number NS of the pixel line L4 is "9" (=3+6). The sum S of the scanning ordinal number NS of the pixel line L4 and the scanning ordinal number NS of the pixel line L5 is "11" (=6+5). The sum S of the scanning ordinal number NS of the pixel line L5 and the scanning ordinal number NS of the pixel line L6 is "9" (=5+4). The sum S of the scanning ordinal number NS of the pixel line L6 and the scanning ordinal number NS of the pixel line L7 is "11" (=4+7). The sum S of the scanning ordinal number NS of the pixel line L7 and the scanning ordinal number NS of the pixel line L8 is "9" (=7+2). The sum S of the scanning ordinal number NS of the pixel line L8 and the scanning ordinal number NS of the pixel line L9 is "11" (=2+9). The sum S of the scanning ordinal number NS of the pixel line L9 and the scanning ordinal number NS of the pixel line L10 (L1) is "10" (=9+1). That is, in this example, the sum S of the scanning ordinal numbers NS of any two adjacent pixel lines L ranges from 9 to 11 both inclusive.

FIG. 27 illustrates drive operation in another display device 1K according to this modification example. The display device 1K makes the scanning drive on the ten-pixel-line-L basis. In a period having duration of ten horizontal periods (10H), a driver unit 20K according to the display device 1K performs, first, the Vth correction drive D2 simultaneously with respect to the pixels 11 that belong to the pixel lines L1 to L10, and thereafter, performs the write drive D3 with respect to the pixels 11 in the following order: the pixel lines L1, L9, L3, L7, L5, L6, L4, L8, L2, and L10. In other words, the scanning ordinal numbers NS of the pixel lines L1 to L10 are respectively "1", "9", "3", "7", "5", "6", "4", "8", "2", and "10". Moreover, in the next period having the duration of the ten horizontal periods (10H), the driver unit 20K performs, first, perform the Vth correction drive D2 simultaneously with respect to the pixels 11 that belong to the pixel lines L11 to L20, and thereafter, performs the write drive D3 with respect to the pixels 11 in the following order: the pixel lines L11, L19, L13, L17, L15, L16, L14, L18, L12, and L20. In other words, the scanning ordinal numbers NS of the pixel lines L11 to L20 are respectively "1", "9", "3", "7", "5", "6", "4", "8", "2", and "10".

In this case, for example, the sum S of the scanning ordinal number NS of the pixel line L1 and the scanning ordinal number NS of the pixel line L2 is "10" (=1+9). The sum S of the scanning ordinal number NS of the pixel line L2 and the scanning ordinal number NS of the pixel line L3 is "12" (=9+3). The sum S of the scanning ordinal number NS of the pixel line L3 and the scanning ordinal number NS of the pixel line L4 is "10" (=3+7). The sum S of the scanning ordinal number NS of the pixel line L4 and the scanning ordinal number NS of the pixel line L5 is "12" (=7+5). The sum S of the scanning ordinal number NS of the pixel line L5 and the scanning ordinal number NS of the pixel line L6 is "11" (=5+6). The sum S of the scanning ordinal number NS of the pixel line L6 and the scanning ordinal number NS of the pixel line L7 is "10" (=6+4). The sum S of the scanning ordinal number NS of the pixel line L7 and the scanning ordinal number NS of the pixel line L8 is "12" (=4+8). The sum S of the scanning ordinal number NS of the pixel line L8 and the scanning ordinal number NS of the pixel line L9 is "10" (=8+2). The sum S of the scanning ordinal number NS of the pixel line L9 and the scanning ordinal number NS of the pixel line L10 is "12" (=2+10). The sum S of the scanning ordinal number NS of the pixel line L10 and the scanning ordinal number NS of the pixel line L11 (L1) is "11" (=10+1). That is, in this example, the sum S of the scanning ordinal numbers NS of any two adjacent pixel lines L ranges from 10 to 12 both inclusive.

In the forgoing, description is given of the examples in which the scanning drive is made on the four to ten-pixel-line-L basis. However, this is non-limiting. The scanning drive may be made, for example, on the eleven or more-pixel-line-L basis.

In a case where the scanning drive is made on the N-pixel-line-L basis, the scanning ordinal number NS(i) of the i-th pixel line L(i) out of the N pixel lines L may be represented, for example, as follows using numerical expressions.

In a case where N is an even number, the scanning ordinal number NS(i) may be represented by the following expression.

[Expression 1]

$$NS(i) = \begin{cases} i & \left(i\text{: ODD NUMBER, } i \leqq \frac{N}{2}\right) \\ N - i + 1 & \left(i\text{: EVEN NUMBER, } i \leqq \frac{N}{2}\right) \\ N - i + 1 & \left(i\text{: ODD NUMBER, } i > \frac{N}{2}\right) \\ i & \left(i\text{: EVEN NUMBER, } i > \frac{N}{2}\right) \end{cases} \quad (1)$$

That is, in obtaining the scanning ordinal number NS(i) for the upper-half pixel lines L out of the N pixel lines L, the expression with i≤N/2 may be used. In obtaining the scanning ordinal number NS(i) for the lower-half pixel lines L, the expression with i>N/2 may be used. Moreover, in a case where N is an odd number, the scanning ordinal number NS(i) may be represented by the following expression.

[Expression 2]

$$NS(i) = \begin{cases} i & (i\text{: ODD NUMBER}) \\ N - i + 1 & (i\text{: EVEN NUMBER}) \end{cases} \quad (2)$$

Using the expressions makes it possible to obtain the scanning ordinal number NS(i) of each pixel line L(i), in the case where the scanning drive is made on the N-pixel-line-L basis in which N is any number.

It is to be noted that in this example, the scanning ordinal numbers NS are represented using the numerical expressions. However, the scanning ordinal numbers NS are not limited to as obtained by the numerical expressions. The scanning ordinal numbers NS may be anything as long as the sum S of the scanning ordinal numbers NS of any two adjacent pixel lines L approximates to the predetermined value. Specifically, for example, random scanning ordinal numbers may be used.

As described, the number of the pixel lines L that serves as a unit of the scanning drive may be set as any number. However, it is desirable that the number of the pixel lines L be an even number. In what follows, description is made, with the display device 1 and the display device 1G given as examples. The display device 1 makes the scanning drive on the six-pixel-line-L basis, while the display device 1G makes the scanning drive on the seven-pixel-line-L basis.

FIG. 28 illustrates intensity in the case with the alternate display of white and black on the one-pixel-line basis in the display device 1. FIG. 29 illustrates one example of a result of the fast Fourier transform carried out on the basis of the intensity distribution illustrated in FIG. 28. In this example, the pixels 11 that belong to the odd-numbered pixel lines L display white, while the pixels 11 that belong to the even-numbered pixel lines L display black. In the odd-numbered pixel lines that display white, the intensity of the pixels 11 that belong to the pixel lines L1 and L7 is the highest. The intensity is gradually lowered in the following order: the pixel lines L5 and L11, and the pixel lines L3 and L9. As a result, as illustrated in FIG. 29, there is a spike of the Fourier component at the cycle of the six pixel lines.

FIG. 30 illustrates intensity in the case with the alternate display of white and black on the one-pixel-line basis in the display device 1G. FIG. 31 illustrates one example of a result of the fast Fourier transform carried out on the basis of the intensity distribution illustrated in FIG. 30. In the odd-numbered pixel lines that display white, the intensity differs from one another, corresponding to the scanning ordinal numbers NS. Specifically, the intensity of the pixels 11 that belong to the pixel line L1 is the highest. The intensity is gradually lowered in the following order: the pixel lines L13, L3, L11, L5, L9, and L7. As a result, as illustrated in FIG. 31, there is a spike of the Fourier component at the cycle of the fourteen pixel lines.

As described, in the case where the number of the pixel lines L that serves as the unit of the scanning drive is set as an odd number, moire is conspicuously visually recognized, with an increase in the cycle as illustrated in FIGS. 30 and 31, and with the lowered spatial frequency fs. Moreover, each of the Fourier components increases. As a result, there is possibility that the observer senses the contrast changes, and has the feeling that the image quality is low.

In contrast, in the case where the number of the pixel lines L that serves as the unit of the scanning drive is set as an even number, as illustrated in FIGS. 28 and 29, it is possible to reduce the cycle, and to enhance the spatial frequency fs, as compared to the case with the odd number. As a result, it is possible to reduce the possibility that the observer senses the contrast changes, leading to the enhancement in the image quality.

Modification Example 1-5

In the forgoing embodiment, the pixel 11 is constituted using the two transistors and the single capacitor, but this is non-limiting. In the following, detailed description is given of an exemplary case where the pixel is constituted using three transistors and one capacitor.

FIG. 32 illustrates one configuration example of a display device 1L according to this modification example. The display device 1L includes a display unit 10L and a driver unit 20L.

The display unit 10L includes a plurality of pixels 11L arranged in a matrix. Moreover, the display unit 10L includes a plurality of control lines CTL that extend in the row direction (the horizontal direction). Each of the pixels 11L is coupled to the write control line WSL, the power supply line PL, the control line CTL, and the data line DTL. The pixel 11L includes the write transistor WSTr, the drive transistor DRTr, a control transistor CTr, the capacitor Cs, and the light emitting element 19. In other words, in this example, the pixel 11K has a so-called "3Tr1C" configuration that is constituted using the three transistors and the single capacitor. The control transistor CTr is constituted by, for example, an N-channel MOS TFT. The control transistor CTr includes a gate coupled to the control line CTL, a source supplied with the voltage Vofs by the driver unit 20L, and a drain coupled to the drain of the write transistor WSTr, the gate of the drive transistor DRTr, and the one end of the capacitor Cs.

The driver unit 20L includes a timing controller 22L, a write control line driver 23L, a data line driver 25L, and a control line driver 26L. The timing generator 22L supplies, on the basis of the synchronization signal Ssync supplied from the outside, a control signal to each of the write control line driver 23L, the power supply line driver 24, the data line driver 25L, and the control line driver 26L, to control them to operate in synchronization with one another. The write control line driver 23L applies, in accordance with the control signal supplied from the timing generator 22L, the write control signal VSCAN1 to the plurality of the write control lines WSL. Thus, the write control line driver 23L selects the pixel 11L. The data line driver 25L generates the signal SIG, in accordance with the image signal Spic2 supplied from the image signal processor 21 and in accordance with the control signal supplied from the timing generator 22L. The signal SIG includes the pixel voltage Vsig that instructs the light emission intensity of each of the pixels 11L. The data line driver 25L applies the signal SIG to each of the data lines DTL. The control line driver 26L applies, in accordance with the control signal supplied from the timing generator 22L, a control signal VSCAN3 to the plurality of the control lines CTL. Thus, the control line driver 26L performs the initialization drive D1 and the Vth correction drive D2 with respect to the pixels 11L.

FIG. 33 provides a timing chart of drive operation with respect to the pixels 11L(1) to 11L(6), with (A) indicating waveforms of the write control signals VSCAN1(1) and VSCAN1(5), with (B) indicating waveforms of the power supply signals VSCAN2(1) and VSCAN2(5), with (C) indicating waveforms of the control signals VSCAN3(1) and VSCAN3(5), with (D) indicating the signal SIG, with (E) and (F) respectively indicating waveforms of a gate voltage Vg(1) and a source voltage Vs(1) of the pixel 11L(1), and with (G) and (H) respectively indicating waveforms of a gate voltage Vg(5) and a source voltage Vs(5) of the pixel 11(5).

First, prior to the initialization period P1, the power supply line driver 24 sets the voltages of the power supply signals VSCAN2(1) to VSCAN2(6) as the voltage Vini ((B) of FIG. 33), as with the display device 1 (FIG. 4) according to the forgoing embodiment. This causes each of the drive transistors DRTr of the pixels 11L(1) to 11L(6) to be turned on, causing the source voltages Vs(1) to Vs(6) of the respective drive transistors DRTr to be set as the voltage Vini ((F) and (H) of FIG. 33).

Thereafter, in the period of the timing t2 to t3 (the initialization period P1), the driver unit 20L performs the initialization drive D1 with respect to the pixels 11L(1) to 11L(6). Specifically, at the timing t2, the control line driver 26L changes the voltages of the control signals VSCAN3(1) to VSCAN3(6) from the low level to the high level ((C) of FIG. 33). This causes each of the control transistors CTr of the pixels 11L(1) to 11L(6) to be turned on, causing the gate voltages Vg(1) to Vg(6) of the respective drive transistors DRTr to be set as the voltage Vofs ((E) and (G) of FIG. 33). In this way, the gate-source voltage Vgs (=Vofs−Vini) of each of the drive transistors DRTr is set as the voltage larger than the threshold voltage Vth of the relevant drive transistor DRTr. Thus, the pixels 11L(1) to 11L(6) are each initialized.

Thereafter, in the period of the timing t3 to t4 (the Vth correction period P2), the driver unit 20L performs the Vth correction drive D2, as with the display device 1 (FIG. 4) according to the forgoing embodiment. Moreover, at the timing t4, the control line driver 26L changes the voltages of the control signals VSCAN3(1) to VSCAN3(6) from the high level to the low level ((C) of FIG. 33). This causes each of the control transistors CTr of the pixels 11L(1) to 11L(6) to be turned off.

The operation afterwards is similar to that of the display device 1 (FIG. 4) according to the forgoing embodiment.

With this configuration as well, it is possible to produce similar effects to those of the case of the forgoing embodiment.

Modification Example 1-6

In the forgoing embodiment, for example, the light emission drive D4 is performed sequentially with respect to the pixels 11(1) to 11(6), but this is non-limiting. In one alternative, the light emission drive D4 may be performed simultaneously. In the following, detailed description is given on this modification example.

A display device 1M according to this modification example includes a driver unit 20M. The driver unit 20M includes a power supply line driver 24M.

FIG. 34 illustrates drive operation of the driver unit 20M with respect to the pixels 11 that belong to the pixel lines L1 to L6, with (A) indicating the waveforms of the write control signals VSCAN1(1) to VSCAN1(6), with (B) indicating the waveforms of the power supply signals VSCAN2(1) to VSCAN2(6), and with (C) indicating the signal SIG. The power supply line driver 24M of the driver unit 20M changes the voltages of the power supply signals VSCAN2(1) to VSCAN2(6), simultaneously from the voltage Vini to the voltage Vp, at certain timing within the pulse period of the pulses PU1 of the write control signals VSCAN1(1) to VSCAN1(6) in the period of the timing t81 to t82. Moreover, thereafter, the power supply line driver 24M changes the voltage of the power supply signal VSCAN2(1) from the voltage Vp to the voltage Vini at timing of an end of the pulse PU2 of the write control signal VSCAN1(1), changes the voltage of the power supply signal VSCAN2(5) from the voltage Vp to the voltage Vini at timing of an end of the pulse PU2 of the write control signal VSCAN1(5), changes the voltage of the power supply signal VSCAN2(3) from the voltage Vp to the voltage Vini at timing of an end of the pulse PU2 of the write control signal VSCAN1(3), changes the voltage of the power supply signal VSCAN2(4) from the voltage Vp to the voltage Vini at timing of an end of the pulse PU2 of the write control signal VSCAN1(4), changes the voltage of the power supply signal VSCAN2(2) from the voltage Vp to the voltage Vini at timing of an end of the pulse PU2 of the write control signal VSCAN1(2), and changes the voltage of the power supply signal VSCAN2(6) from the voltage Vp to the voltage Vini at timing of an end of the pulse PU2 of the write control signal VSCAN1(6). Moreover, thereafter, the power supply line driver 24M changes, at timing t98, the voltages of the power supply signals VSCAN2(1) to VSCAN2(6), simultaneously from the voltage Vini to the voltage Vp, and changes, at timing t99, the voltages of the power supply signals VSCAN2(1) to VSCAN2(6), simultaneously from the voltage Vp to the voltage Vini.

FIG. 35 provides a timing chart of the drive operation with respect to the pixels 11(1) to 11(6), with (A) indicating the waveforms of the write control signals VSCAN1(1) and VSCAN1(5), with (B) indicating the waveforms of the power supply signals VSCAN2(1) and VSCAN2(5), with (C) indicating the signal SIG, with (D) and (E) respectively indicating the waveforms of the gate voltage Vg(1) and the source voltage Vs(1) of the pixel 11(1), and with (F) and (G) respectively indicating the waveforms of the gate voltage Vg(5) and the source voltage Vs(5) of the pixel 11(5).

The driver unit 20M performs the initialization drive D1 with respect to the pixels 11L(1) to 11L(6) in the period of the timing t2 to t3 (the initialization period P1), and performs the Vth correction drive D2 in the period of the timing t3 to t4 (the Vth correction period P2), as with the case of the driver unit 20 (FIG. 4) according to the first embodiment. Moreover, at the timing t4, the write control line driver 23 changes the voltages of the write control signals VSCAN1(1) to VSCAN1(6) from the high level to the low level ((A) of FIG. 35). This causes each of the write transistors WSTr of the pixels 11(1) to 11(6) to be turned off. Moreover, at the timing t5, the data line driver 25 sets the voltage of the signal SIG as the pixel voltage Vsig(1) ((C) of FIG. 35).

Thereafter, in the period of the timing t6 to t7 (the write and μ correction period P3), the driver unit 20M performs the write drive D3 with respect to the pixel 11(1), as with the case of the driver unit 20 (FIG. 4) according to the first embodiment.

Thereafter, at the timing t7, the write control line driver 23 changes the voltage of the write control signal VSCAN1(1) from the high level to the low level ((A) of FIG. 35). This causes the write transistor WSTr of the pixel 11(1) to be turned off, causing the gate of the drive transistor DRTr of the pixel 11(1) to become floating. Accordingly, thereafter, the terminal voltage of the capacitor Cs of the pixel 11(1), i.e., the gate-source voltage Vgs of the drive transistor DRTr is maintained. Simultaneously with this, the power supply line driver 24M changes the voltage of the power supply signal VSCAN2(1) from the voltage Vp to the voltage Vini ((B) of FIG. 35). This causes the source voltage Vs(1) of the drive transistor DRTr of the pixel 11(1) to fall and to be set as the voltage Vini ((E) of FIG. 35). At this occasion, because the gate-source voltage Vgs of the drive transistor DRTr is maintained, the gate voltage Vg(1) of the drive transistor DRTr also falls ((D) of FIG. 35).

Thereafter, at the timing t8, the data line driver 25 sets the voltage of the signal SIG as the pixel voltage Vsig(5) ((C) of FIG. 35).

Thereafter, in the period of the timing t9 to t10 (the write and μ correction period P3), the driver unit 20M performs the write drive D3 with respect to the pixel 11(5), as with the case of the pixel 11(1).

Thereafter, at the timing t10, the write control line driver 23 changes the voltage of the write control signal VSCAN1(1) from the high level to the low level ((A) of FIG. 35), while the power supply line driver 24M changes the voltage of the power supply signal VSCAN2(1) from the voltage Vp to the voltage Vini ((B) of FIG. 35). Accordingly, in the pixel 11(5), as with the pixel 11(1), with the gate-source voltage Vgs of the drive transistor DRTr being maintained, the source voltage Vs(5) of the drive transistor DRTr falls and is set as the voltage Vini. The gate voltage Vg(5) of the drive transistor DRTr also falls ((F) and (G) of FIG. 35).

Thereafter, although undepicted, the driver unit 20M performs the write drive D3 in a similar manner with respect to the pixel 11(3), the pixel 11(4), the pixel 11(2), and the pixel 11(6) in the order named.

Thereafter, in a period from timing t16 to t17 (the light emission period P4), the driver 20M performs the light emission drive D4 with respect to the pixels 11(1) to 11(6). Specifically, at the timing t16, the power supply line driver 24M changes the voltages of the power supply signals VSCAN2(1) to VSCAN2(6) from the voltage Vini to the voltage Vp ((B) of FIG. 35). This causes each of the drive transistors DRTr of the pixels 11(1) to 11(6) to operate in the saturated regions. As the current Ids flows from the drain to the source, the gate voltages Vg(1) to Vg(6) and the source voltages Vs(1) to Vs(6) of the respective drive transistors DRTr increase ((D) to (G) of FIG. 35). Moreover, when each of the source voltages Vs(1) to Vs(6) of the drive transistors DRTr becomes higher than the sum (Vel+Vcath) of the threshold voltage Vel and the voltage Vcath of the light emitting element 19 of each of the pixels 11(1) to 11(6), the current flows between the anode and the cathode of the light emitting element 19. Thus, the light emitting elements 19 each emit light.

Moreover, at the timing t17, the power supply line driver 24M changes the voltages of the power supply signals VSCAN2(1) to VSCAN2(6) from the voltage Vp to the voltage Vini. This causes the source voltages Vs(1) to Vs(6) of the respective drive transistors DRTr of the pixels 11(1) to 11(6) to fall and to be set as the voltage Vini ((E) and (G) of FIG. 35). At this occasion, because the gate-source voltage Vgs of each of the drive transistors DRTr is maintained, the gate voltages Vg(1) to Vg(6) of the respective drive transistors DRTr also fall ((D) and (F) of FIG. 35). As a result, the light emitting elements 19 of the pixels 11(1) to 11(6) are each put out.

In this way, at the timing t13, the one frame period (1F) finishes. The driver unit 20 repeats such operation with respect to the pixels 11(1) to 11(6). Thus, the display device 1M displays the image.

FIG. 36 illustrates the drive operation with respect to the pixels 11 that belong to the pixel lines L1 to L12. It is to be noted that FIG. 36 omits illustration except for the Vth correction drive D2, the write drive D3, and the light emission drive D4, for convenience of explanation. As illustrated in FIG. 36, in the period having the duration of the six horizontal periods (6H), the driver unit 20M performs, first, the Vth correction drive D2 simultaneously with respect to the pixels 11 that belong to the pixel lines L1 to L6, and thereafter, performs the write drive D3 with respect to the pixels 11 in the following order: the pixel lines L1, L5, L3, L4, L2, and L6. In other words, the scanning ordinal numbers NS of the pixel lines L1 to L6 are respectively "1", "5", "3", "4", "2", and "6". Moreover, the driver unit 20M performs the light emission drive D4 simultaneously with respect to the pixels 11 that belong to the pixel lines L1 to L6. Likewise, in the next period having the duration of the six horizontal periods (6H), the driver unit 20M performs, first, the Vth correction drive D2 simultaneously with respect to the pixels 11 that belong to the pixel lines L7 to L12, and thereafter, performs the write drive D3 with respect to the pixels 11 in the following order: the pixel lines L7, L11, L9, L10, L8, and L12. In other words, the scanning ordinal numbers NS of the pixel lines L7 to L12 are respectively "1", "5", "3", "4", "2", and "6". Moreover, the driver unit 20M performs the light emission drive D4 simultaneously with respect to the pixels 11 that belong to the pixel lines L7 to L12.

In the display device 1M as well, there is possibility that the intensity differs according to the pixel lines L. To be specific, first, as with the case of the forgoing first embodiment, there is the possibility of the differences in the intensity, because of the differences in the length of the time between the Vth correction drive D2 and the write drive D3. Furthermore, in the display device 1M, a length of time between the write drive D3 and the light emission drive D4 differs. Accordingly, there occurs a similar difference in an amount of shift of the gate-source voltage Vgs of the drive transistor DRTr, causing the possibility that the intensity differs according to the pixel lines L. However, in the display device 1M, as with the display device 1 according to the first embodiment, the write drive D3 is performed in the scanning order in which the sum S of the scanning ordinal numbers NS of any two adjacent pixel lines L approximates to the predetermined value. Hence, it is possible to enhance the spatial frequency fs in the intensity distribution in the scanning direction, leading to the enhancement in the image quality.

Modification Example 1-7

In the forgoing embodiment, the drain of the write transistor WSTr is coupled to the gate of the drive transistor DRTr, but this is non-limiting. In the following, detailed description is made regarding a display device 1N in which the drain of the write transistor WSTr is coupled to the source of the drive transistor DRTr.

FIG. 37 illustrates one configuration example of the display device 1N. The display device 1N includes a display unit 10N and a driver unit 20N.

The display unit 10N includes a plurality of pixels 11N arranged in a matrix. Moreover, the display unit 10N includes the plurality of the write control lines WSL extending in the row direction (the horizontal direction), a plurality of control lines CTL1 extending in the row direction, a plurality of control lines CTL3 extending in the row direction, and the plurality of the data lines DTL extending in the column direction (the vertical direction). Each of the pixels 11N is coupled to the write control line WSL, the control lines CTL1 and CTL3, and the data line DTL.

The pixel 11N includes the write transistor WSTr, the drive transistor DRTr, control transistors CTr1 to CTr4, the capacitor Cs, and the light emitting element 19. In other words, in this example, the pixel 11N has a so-called "6Tr1C" configuration that is constituted using the six transistors and the single capacitor.

The write transistor WSTr, the drive transistor DRTr, and the control transistor CTr1 to CTr4 are constituted by, for example, P-channel MOS TFTs. The write transistor WSTr includes the gate coupled to the write control line WSL, the source coupled to the data line DTL, and the drain coupled to the source of the drive transistor DRTr and a drain of the control transistor CTr3. The drive transistor DRTr includes the gate coupled to sources of the control transistors CTr1 and CTr2, and coupled to the one end of the capacitor Cs, the source coupled to the drain of the write transistor WSTr and coupled to a drain of the control transistor CTr3, and the drain coupled to a drain of the control transistor CTr2 and coupled to a source of the control transistor CTr4. The control transistor CTr1 includes a gate coupled to the control line CTL, the source supplied with the voltage Vini by the driver unit 20N, and a drain coupled to the gate of the drive transistor DRTr, coupled to the source of the control transistor CTr2, and coupled to the one end of the capacitor Cs. The control transistor CTr2 includes a gate coupled to the write control line WSL, the source coupled to the gate of the drive transistor DRTr, coupled to the drain of the control transistor CTr1, and coupled to the one end of the capacitor Cs, and the drain coupled to the drain of the drive transistor DRTr and the source of the control transistor CTr4. The control transistor CTr3 includes a gate coupled to the control line CTL3, a source supplied with a voltage VDD by the driver unit 20N, and the drain coupled to the drain of the write transistor WSTr and the source of the drive transistor DRTr. The control transistor CTr4 includes a gate coupled to the control line CTL3, the source coupled to the drain of the drive transistor DRTr and the drain of the control transistor CTr2, and a drain coupled to the anode of the light emitting element 19. The capacitor Cs includes the one end coupled to the gate of the drive transistor DRTr, coupled to the drain of the control transistor CTr1, and coupled to the source of the control transistor CTr2, and the other end supplied with the voltage VDD by the driver unit 20N. The light emitting element 19 includes the anode coupled to the drain of the control transistor CTr4, and the cathode supplied with the voltage Vcath by the driver unit 20N.

The driver unit 20N includes a timing controller 22N, a write control line driver 23N, a data line driver 25N, a control line drivers 26N and 27N. The timing generator 22N supplies, on the basis of the synchronization signal Ssync supplied from the outside, a control signal to each of the write control line driver 23N, the data line driver 25N, and the control line drivers 26N and 27N, to control them to operate in synchronization with one another. The write control line driver 23N applies, in accordance with the control signal supplied from the timing generator 22N, a write control signal VS2 to the plurality of the write control lines WSL. Thus, the write control line driver 23N selects the pixel 11N. The data line driver 25N generates the signal SIG, in accordance with the image signal Spic2 supplied from the image signal processor 21 and in accordance with the control signal supplied from the timing generator 22N. The signal SIG includes the pixel voltage Vsig that instructs the light emission intensity of each of the pixels 11N. The data line driver 25N applies the signal SIG to each of the data lines DTL. The control line driver 26N applies, in accordance with the control signal supplied from the timing generator 22N, a control signal VS1 to the plurality of the control lines CTL1, to perform an initialization drive E1 (described later) with respect to the pixels 11N. The control line driver 27N applies, in accordance with the control signal supplied from the timing generator 22N, a control signal VS3 to the plurality of the control lines CTL3, to perform the light emission drive E3 (described later) with respect to the pixels 11N.

Here, the initialization drive E1 corresponds to one specific example of a "preparatory drive" in the disclosure.

FIG. 38 illustrates drive operation of the driver unit 20N with respect to the pixels 11N that belong to the pixel lines L1 to L6, with (A) indicating waveforms of control signals VS1(1) to VS1(6), with (B) indicating waveforms of write control signals VS2(1) to VS2(6), with (C) indicating waveforms of control signals VS3(1) to VS3(6), and with (D) indicating the signal SIG.

The data line driver 25N of the driver unit 20N generates the signal SIG ((D) of FIG. 38), in the leading period (a period of timing t61 to t69) of the one frame period (1F). The leading period has the duration of the six horizontal periods (6H). The signal SIG includes the pixel voltages Vsig(1) to Vsig(6) to be written to the pixels 11N(1) to 11N(6). Specifically, the data line driver 25N sets the voltage of the signal SIG as the pixel voltage Vsig(1) in a period of timing t62 to t63, sets the voltage of the signal SIG as the pixel voltage Vsig(5) in a period of the timing t63 to t64, sets the voltage of the signal SIG as the pixel voltage Vsig(3) in a period of the timing t64 to t65, sets the voltage of the signal SIG as the pixel voltage Vsig(4) in a period of the timing t65 to t66, sets the voltage of the signal SIG as the pixel voltage Vsig(2) in a period of the timing t66 to t67, and sets the voltage of the signal SIG as the pixel voltage Vsig(6) in a period of the timing t67 to t68.

Moreover, the control line driver 26N of the driver unit 20N generates the control signals VS1(1) to VS1(6) including pulses of negative polarity in a period of the timing t61 to t62 ((A) of FIG. 38).

Furthermore, the write control line driver 23N of the driver unit 20N generates the write control signal VS2(1) to VS2(6) including pulses of the negative polarity, in a period of the timing t62 to t68 ((B) of FIG. 38). Specifically, the write control line driver 23N generates the write control signal VS2(1) including the pulse in the period of the timing t62 to t63 in which the signal SIG is set as the pixel voltage Vsig(1), generates the write control signal VS2(5) including the pulse in the period of the timing t63 to t64 in which the signal SIG is set as the pixel voltage Vsig(5), generates the write control signal VS2(3) including the pulse in the period of the timing t64 to t65 in which the signal SIG is set as the pixel voltage Vsig(3), generates the write control signal VS2(4) including the pulse in the period of the timing t65 to t66 in which the signal SIG is set as the pixel voltage Vsig(4), generates the write control signal VS2(2) including the pulse in the period of the timing t66 to t67 in which the signal SIG is set as the pixel voltage Vsig(2), and generates the write control signal VS2(6) including the pulse in the period of the timing t67 to t68 in which the signal SIG is set as the pixel voltage Vsig(6).

Moreover, the control line driver 27N of the driver unit 20N generates the control signals VS3(1) to VS3(6) including pulses of the negative polarity in a period of the timing t69 to t70 ((C) of FIG. 38).

FIG. 39 provides a timing chart of drive operation with respect to the pixels 11N(1) to 11N(6), with (A) indicating waveforms of the control signals VS1(1) to VS1(6), with (B) indicating waveforms of the write control signals VS2(1) and VS2(5), with (C) indicating waveforms of the control signals VS3(1) to VS3(6), with (D) indicating the signal SIG, with (E) and (F) respectively indicating waveforms of the gate voltage Vg(1) and the source voltage Vs(1) of the pixel 11N(1), and with (G) and (H) respectively indicating waveforms of the gate voltage Vg(5) and the source voltage Vs(5) of the pixel 11N(5).

First, in a period of timing t42 to t43 (an initialization period P11), the driver unit 20N performs the initialization drive E1 with respect to the pixels 11N(1) to 11N(6). Specifically, at the timing 42, the control line driver 26N changes the voltages of the control signals VS1(1) to VS1(6) from the high level to the low level ((A) of FIG. 39). This causes each of the control transistors CTr1 of the pixels 11N(1) to 11N(6) to be turned on, causing the gate voltages Vg(1) to Vg(6) of the respective drive transistors DRTr to be set as the voltage Vini ((E) and (G) of FIG. 39). As a result, an absolute value of the gate-source voltage Vgs of each of the drive transistors DRTr is set as a voltage larger than an absolute value of the threshold voltage Vth of the relevant drive transistor DRTr. Thus, the pixels 11N(1) to 11N(6) are each initialized.

Thereafter, at the timing t43, the control line driver 26N changes the voltages of the control signal VS1(1) to VS1(6) from the low level to the high level ((A) of FIG. 39). This causes each of the control transistors CTr1 of the pixels 11N(1) to 11N(6) to be turned off, causing the gate of each of the drive transistors DRTr to be in a floating state. Thereafter, the gate voltages Vg(1) to Vg(6) are maintained ((E) and (G) of FIG. 39).

Thereafter, at timing t44, the data line driver 25N sets the voltage of the signal SIG as the pixel voltage Vsig(1) ((D) of FIG. 39).

Thereafter, in a period of timing t45 to t46 (a write period P12), the driver unit 20N performs a write drive E2 with respect to the pixel 11N(1). Specifically, at the timing t45, the write control line driver 23N changes the voltage of the write control signal VS2(1) from the high level to the low level ((B) of FIG. 39). This causes the write transistor WSTr of the pixel 11N(1) to be turned on, causing the source voltage Vs(1) of the drive transistor DRTr of the pixel 11N(1) to be set as the pixel voltage Vsig(1) ((F) of FIG. 39).

Moreover, at the same time, the control transistor CTr2 of the pixel 11N(1) is turned on. This causes the drive transistor DRTr of the pixel 11N(1) to be in a state in which the drain and the gate are coupled to each other through the control transistor CTr2 (a so-called diode coupling). As a result, a current flows from the source to the drain of the drive transistor DRTrTr, resulting in an increase in the gate voltage Vg(1) ((E) of FIG. 39). Such an increase in the gate voltage Vg(1) causes a gradual decrease in the current from the source to the drain of the drive transistor DRTr. By this negative feedback operation, the absolute value of the gate-source voltage Vgs of each of the drive transistors DRTr converges to become equal to the absolute value of the threshold voltage Vth of the relevant drive transistor DRTr (|Vgs|=|Vth|). In other words, the gate voltage Vg(1) of the drive transistor DRTr is set as a voltage that is smaller than the pixel voltage Vsig(1) by an amount of the absolute value of the threshold voltage Vth (Vsig(1)−|Vth|).

Thereafter, at the timing t46, the write control line driver 23N changes the voltage of the write control signal VS2(1) from the low level to the high level ((B) of FIG. 39). This causes the write transistor WSTr and the control transistor CTr2 of the pixel 11N(1) to be turned off.

Thereafter, at timing t47, the data line driver 25N sets the voltage of the signal SIG as the pixel voltage Vsig(5) ((D) of FIG. 39).

Thereafter, in the period of the timing t45 to t46 (the write period P12), the driver unit 20N performs the write drive E2 with respect to the pixel 11N(5), as with the pixel 11N(1). This causes the gate voltage Vg(5) of the drive transistor DRTr of the pixel 11N(5) to be set as a voltage that is smaller than the pixel voltage Vsig(5) by the amount of the absolute value of the threshold voltage Vth (Vsig(5)−|Vth|).

Thereafter, although undepicted, the driver unit 20N performs the write drive D2 in a similar manner with respect to the pixel 11N(3), the pixel 11N(4), the pixel 11N(2), and the pixel 11N(6), in the order named.

Thereafter, in a period of timing t51 to t52 (a light emission period P13), the driver unit 20N performs the light emission drive E3 with respect to the pixels 11N(1) to 11N(6). Specifically, at the timing t51, the control line driver 27N changes the voltages of the control signals VS3(1) to VS3(6) from the high level to the low level ((C) of FIG. 39). This causes each of the control transistors CTr3 and CTr4 of the pixels 11N(1) to 11N(6) to be turned on, causing an increase in the source voltages Vs(1) to Vs(6) of the respective drive transistors DRTr toward the voltage VDD ((F) and (H) of FIG. 39). In this way, the drive transistors DRTr come to operate in the saturated regions, causing a current flow through a path including the control transistor CTr3, the drive transistor DRTr, the control transistor CTr4, and the light emitting element 19. Thus, the light emitting element 19 emits light.

Moreover, at the timing t52, the control line driver 27N changes the voltages of the control signals VS3(1) to VS3(6) from the low level to the high level. This causes each of the control transistors CTr3 and CTr4 of the pixels 11N(1) to 11N(6) to be turned off, causing a decrease in the source voltages Vs(1) to Vs(6) of the respective drive transistors DRTr ((F) and (H) of FIG. 39). As a result, the light emitting elements 19 of the pixels 11N(1) to 11N(6) are each put out.

In this way, at timing t53, the one frame period (1F) finishes. The driver unit 20N repeats such operation with respect to the pixels 11N(1) to 11N(6). Thus, the display device 1N displays the image.

FIG. 40 illustrates drive operation with respect to the pixels 11N that belong to the pixel lines L1 to L12. In the period having the duration of the six horizontal periods (6H), the driver unit 20N performs, first, the initialization drive E1 simultaneously with respect to the pixels 11N that belong to the pixel lines L1 to L6, and thereafter, performs the write drive E2 with respect to the pixels 11N in the following order: the pixel lines L1, L5, L3, L4, L2, and L6. Moreover, the driver unit 20N performs the light emission drive E3 simultaneously with respect to the pixels 11N that belong to the pixel lines L1 to L6. Likewise, in the next period having the duration of the six horizontal periods (6H), the driver unit 20N performs, first, the initialization drive E1 simultaneously with respect to the pixels 11N that belong to the pixel lines L7 to L12, and thereafter, performs the write drive E2 with respect to the pixels 11N in the following order: the pixel lines L7, L11, L9, L10, L8, and L12. Moreover, the driver unit 20N performs the light emission drive E3 simultaneously with respect to the pixels 11N that belong to the pixel lines L7 to L12.

Modification Example 1-8

In the forgoing embodiment, the Vth correction drive D2 is performed simultaneously with respect to the pixels that belong to, for example, the six pixel lines L. However, this is non-limiting. In one alternative, for example, the Vth correction drive D2 may be performed simultaneously with respect to the pixels that belong to all the pixel lines L of the display unit 10.

Other Modification Examples

Moreover, two or more of the modification examples may be combined.

2. Second Embodiment

Description is given next of a display device 2 according to a second embodiment. This embodiment involves performing the Vth correction drive D2 and the write drive D3 sequentially with respect to the plurality of (e.g., six) pixel lines L, and simultaneously performing the light emission drive D4. It is to be noted that the substantially same components as those of the display device 1 according to the forgoing first embodiment are denoted by the same reference characters, and description thereof is omitted as appropriate.

As illustrated in FIG. 1, the display device 2 includes a driver unit 30. The driver unit 30 includes a write control line driver 33, a power supply line driver 34, and a data line driver 35.

FIG. 41 illustrates drive operation of the driver unit 30 with respect to the pixels 11 that belong to the pixel lines L1 to L6, with (A) indicating the waveforms of the write control signals VSCAN1(1) to VSCAN1(6), with (B) indicating the waveforms of the power supply signals VSCAN2(1) to VSCAN2(6), and with (C) indicating the signal SIG.

The data line driver 35 of the driver unit 30 generates the signal SIG ((C) of FIG. 41), in the leading period (a period of timing t181 to t193) of the one frame period (1F). The leading period has the duration of the six horizontal periods (6H). The signal SIG includes the predetermined voltage Vofs and the pixel voltages Vsig(1) to Vsig(6). The pixel voltages Vsig(1) to Vsig(6) are to be written to the pixels 11(1) to 11(6). Specifically, the data line driver 35 sets the voltage of the signal SIG as the voltage Vofs in a period of the timing t181 to t182, and sets the voltage of the signal SIG as the voltage Vsig(1) in a period of the timing t182 to t183. Likewise, the data line driver 35 sets the voltage of the signal SIG as the voltage Vofs in a period of the timing t183 to t184, and sets the voltage of the signal SIG as the pixel voltage Vsig(5) in a period of the timing t184 to t185. Moreover, the data line driver 35 sets the voltage of the signal SIG as the voltage Vofs in a period of the timing t185 to t186, and sets the voltage of the signal SIG as the pixel voltage Vsig(3) in a period of the timing t186 to t187. Furthermore, the data line driver 35 sets the voltage of the signal SIG as the voltage Vofs in a period of the timing t187 to t188, and sets the voltage of the signal SIG as the pixel voltage Vsig(4) in a period of the timing t188 to t189. Moreover, the data line driver 35 sets the voltage of the signal SIG as the voltage Vofs in a period of the timing t189 to t190, and sets the voltage of the signal SIG as the pixel voltage Vsig(2) in a period of the timing t190 to t191. Furthermore, the data line drive 35 sets the voltage of the signal SIG as the voltage Vofs in a period of the timing t191 to t192, and sets the voltage of the signal SIG as the pixel voltage Vsig(6) in a period of the timing t192 to t193.

Moreover, the write control line driver 33 of the driver unit 30 generates the write control signals VSCAN1(1) to VSCAN1(6) including the pulses PU1 and PU2 of the positive polarity, in the period of the timing t181 to t194 ((A) of FIG. 41). Specifically, the write control line driver 33 generates the write control signal VSCAN1(1) that includes the pulse PU1 in the period of the timing t181 to t182 and includes the pulse PU2 in the period of the timing t182 to t183 in which the signal SIG is set as the pixel voltage Vsig(1). Moreover, the write control line driver 33 generates the write control signal VSCAN1(5) that includes the pulse PU1 in the period of the timing t183 to t184 and includes the pulse PU2 in the period of the timing t184 to t185 in which the signal SIG is set as the pixel voltage Vsig(5). Furthermore, the write control line driver 33 generates the write control signal VSCAN1(3) that includes the pulse PU1 in the period of the timing t185 to t186 and includes the pulse PU2 in the period of the timing t186 to t187 in which the signal SIG is set as the pixel voltage Vsig(3). Moreover, the write control line driver 33 generates the write control signal VSCAN1(4) that includes the pulse PU1 in the period of the timing t187 to t188 and includes the pulse PU2 in the period of the timing t188 to t189 in which the signal SIG is set as the pixel voltage Vsig(4). Furthermore, the write control line driver 33 generates the write control signal VSCAN1(2) that includes the pulse PU1 in the period of the timing t189 to t190 and includes the pulse PU2 in the period of the timing t190 to t191 in which the signal SIG is set as the pixel voltage Vsig(2). Moreover, the write control line driver 33 generates the write control signal VSCAN1(6) that includes the pulse PU1 in the period of the timing t191 to t192 and includes the pulse PU2 in the period of the timing t192 to t193 in which the signal SIG is set as the pixel voltage Vsig(6).

Moreover, the power supply line driver 34 of the driver unit 30 changes the voltage of the power supply signal VSCAN2(1) from the voltage Vini to the voltage Vp at certain timing within the pulse period of the pulse PU1 of the write control signal VSCAN1(1), and changes the voltage of the power supply signal VSCAN2(1) from the voltage Vp to the voltage Vini at the timing of the end of the pulse PU2 of the write control signal VSCAN1(1). Likewise, the power supply line driver 34 changes the voltage of the power supply signal VSCAN2(5) from the voltage Vini to the voltage Vp at certain timing within the pulse period of the pulse PU1 of the write control signal VSCAN1(5), and changes the voltage of the power supply signal VSCAN2(5) from the voltage Vp to the voltage Vini at the timing of the end of the pulse PU2 of the write control signal VSCAN1(5). Moreover, the power supply line driver 34 changes the voltage of the power supply signal VSCAN2(3) from the voltage Vini to the voltage Vp at certain timing within the pulse period of the pulse PU1 of the write control signal VSCAN1(3), and changes the voltage of the power supply signal VSCAN2(3) from the voltage Vp to the voltage Vini at the timing of the end of the pulse PU2 of the write control signal VSCAN1(3). Furthermore, the power supply line driver 34 changes the voltage of the power supply signal VSCAN2(4) from the voltage Vini to the voltage Vp at certain timing within the pulse period of the pulse PU1 of the write control signal VSCAN1(4), and changes the voltage of the power supply signal VSCAN2(4) from the voltage Vp to the voltage Vini at the timing of the end of the pulse PU2 of the write control signal VSCAN1(4). In addition, the power supply line driver 34 changes the voltage of the power supply signal VSCAN2(2) from the voltage Vini to the voltage Vp at certain timing within the pulse period of the pulse PU1 of the write control signal VSCAN1(2), and changes the voltage of the power supply signal VSCAN2(2) from the voltage Vp to the voltage Vini at the timing of the end of the pulse PU2 of the write control signal VSCAN1(2). Moreover, the power supply line driver 34 changes the voltage of the power supply signal VSCAN2(6) from the voltage Vini to the voltage Vp at certain timing within the pulse period of the pulse PU1 of the write control signal VSCAN1(6), and changes the voltage of the power supply signal VSCAN2(6) from the voltage Vp to the voltage Vini at the timing of the end of the pulse PU2 of the write control signal VSCAN1(6). Furthermore, thereafter, the power supply line driver 34 changes, at the timing t194, the voltages of the power supply signals VSCAN2(1) to VSCAN2(6) simultaneously from the voltage Vini to the voltage Vp, and changes, at the timing t195, the voltages of the power supply signals VSCAN2(1) to VSCAN2(6) simultaneously from the voltage Vp to the voltage Vini.

FIG. 42 provides a timing chart of the drive operation with respect to the pixels 11(1) to 11(6), with (A) indicating the waveforms of the write control signals VSCAN1(1) and VSCAN1(5), with (B) indicating the waveforms of the power supply signals VSCAN2(1) and VSCAN(5), with (C) indicating the signal SIG, with (D) and (E) respectively indicating the waveforms of the gate voltage Vg(1) and the source voltage Vs(1) of the pixel 11(1), and with (F) and (G) respectively indicating the waveforms of the gate voltage Vg(5) and the source voltage Vs(5) of the pixel 11(5).

First, prior to the initialization period P1, the power supply line driver 34 sets the voltages of the power supply signals VSCAN2(1) to VSCAN2(6) as the voltage Vini ((B) of FIG. 42). This causes each of the drive transistors DRTr of the pixels 11(1) to 11(6) to be turned on, causing the source voltages Vs(1) to Vs(6) of the respective drive transistors DRTr to be set as the voltage Vini ((E) and (G) of FIG. 42). Moreover, at timing t21, the data line driver 35 sets the voltage of the signal SIG as the voltage Vofs ((C) of FIG. 42).

Thereafter, in a period of timing t22 to t23 (the initialization period P1), the driver unit 30 performs the initialization drive D1 with respect to the pixel 11(1). Specifically, at the timing t22, the write control line driver 33 changes the voltage of the write control signal VSCAN1(1) from the low level to the high level ((A) of FIG. 42). Accordingly, in the pixel 11(1), as with the case of the first embodiment, the gate-source voltage Vgs (=Vofs−Vini) of the drive transistor DRTr is set as the voltage that is larger than the threshold voltage Vth of the relevant drive transistor DRTr. Thus, the pixel 11(1) is initialized.

Thereafter, in a period of the timing t23 to t24 (the Vth correction period P2), the driver unit 30 performs the Vth correction drive D2. Specifically, at the timing t23, the power supply line driver 34 changes the power supply signal VSCAN2(1) from the voltage Vini to the voltage Vp ((B) of FIG. 42). Accordingly, in the pixel 11(1), as with the case of the first embodiment, the gate-source voltage Vgs of the drive transistor DRTr is set as the threshold voltage Vth of the relevant drive transistor DRTr.

Thereafter, at the timing t24, the write control line driver 33 changes the voltage of the write control signal VSCAN1(1) from the high level to the low level ((A) of FIG. 42). This causes the write transistor WSTr of the pixel 11(1) to be turned off. Moreover, at timing t25, the data line driver 35 sets the voltage of the signal SIG as the pixel voltage Vsig(1) ((C) of FIG. 42).

Thereafter, in a period of timing t26 to t27 (the write and μ correction period P3), the driver unit 30 performs the write drive D3 with respect to the pixel 11(1). Specifically, at the timing t26, the write control line driver 33 changes the voltage of the write control signal VSCAN1(1) from the low level to the high level ((A) of FIG. 42). Accordingly, in the pixel 11(1), as with the case of the first embodiment, the gate-source voltage Vgs of the drive transistor DRTr is set as the voltage corresponding to the pixel voltage Vsig(1).

Thereafter, at the timing t27, the write control line driver 33 changes the voltage of the write control signal VSCAN1(1) from the high level to the low level ((A) of FIG. 42). This causes the write transistor WSTr of the pixel 11(1) to be turned off, causing the gate of the drive transistor DRTr of the pixel 11(1) to become floating. Accordingly, after this, the terminal voltage of the capacitor Cs of the pixel 11(1), i.e., the gate-source voltage Vgs of the drive transistor DRTr is maintained. At the same time, the power supply line driver 34 changes the voltage of the power supply signal VSCAN2(1) from the voltage Vp to the voltage Vini ((B) of FIG. 42). This causes the source voltage Vs(1) of the drive transistor DRTr of the pixel 11(1) to fall and to be set as the voltage Vini ((E) of FIG. 42). At this occasion, because the gate-source voltage Vgs of the drive transistor DRTr is maintained, the gate voltage Vg(1) of the drive transistor DRTr also falls ((D) of FIG. 42). Moreover, at timing t28, the data line driver 35 sets the voltage of the signal SIG as the voltage Vofs ((C) of FIG. 42).

Thereafter, the driver unit 30 performs the initialization drive D1 in a period of timing t29 to t30 (the initialization period P1), performs the Vth correction drive D2 in a period of the timing t30 to t31 (the Vth correction period P2), and performs the write drive D3 in a period of timing t33 to t34 (the write and μ correction period P3), with respect to the pixel 11(5), as with the case of the pixel 11(1). Moreover, at the timing t34, the write control line driver 33 changes the voltage of the write control signal VSCAN1(5) from the high level to the low level ((A) of FIG. 42), and the power supply line driver 34 changes the voltage of the power supply signal VSCAN2(5) from the voltage Vp to the voltage Vini ((B) of FIG. 42). Accordingly, in the pixel 11(5), as with the pixel 11(1), with the gate-source voltage Vgs of the drive transistor DRTr being maintained, the source voltage Vs(5) of the drive transistor DRTr falls to be set as the voltage Vini, and the gate voltage Vg(5) of the drive transistor DRTr also falls ((F) and (F) of FIG. 42).

Thereafter, although undepicted, the driver unit 30 performs the initialization drive D1, the Vth correction drive D2, and the write drive D3 in a similar manner, with respect to the pixel 11(3), the pixel 11(4), the pixel 11(2) and the pixel 11(6) in the order named.

Thereafter, in a period of timing t36 to t37 (the light emission period P4), the driver unit 30 performs the light emission drive D4 with respect to the pixels 11(1) to 11(6). Specifically, at the timing t36, the power supply line driver 34 changes the voltages of the power supply signals VSCAN2(1) to VSCAN2(6) from the voltage Vini to the voltage Vp ((B) of FIG. 42). This causes each of the transistors DRTr of the pixels 11(1) to 11(6) to operate in the saturated regions. As the current Ids flows from the drain to the source, the gate voltages Vg(1) to Vg(6) and the source voltages Vs(1) to Vs(6) of the respective drive transistors DRTr increase ((D) to (G) of FIG. 42). Moreover, when the source voltages Vs(1) to Vs(6) of the respective drive transistors DRTr becomes higher than the sum (Vel+Vcath) of the threshold voltage Vel and the voltage Vcath of the light emitting element 19 of each of the pixels 11(1) to 11(6), the current flows between the anode and the cathode of each of the light emitting elements 19. Thus, the light emitting elements 19 each emit light.

Moreover, at the timing t37, the power supply line driver 34 changes the voltages of the power supply signals VSCAN2(1) to VSCAN2(6) from the voltage Vp to the voltage Vini. This causes the source voltages Vs(1) to Vs(6) of the respective drive transistors DRTr of the pixels 11(1) to 11(6) to fall and to be set as the voltage Vini ((E) and (G) of FIG. 42). At this occasion, because the gate-source voltage Vgs of each of the drive transistor DRTr is maintained, the gate voltages Vg(1) to Vg(6) of the respective transistors DRTr also fall ((D) and (F) of FIG. 42). As a result, the light emitting elements 19 of the pixels 11(1) to 11(6) are each put out.

In this way, at timing t38, the one frame period (1F) finishes. The driver unit 30 repeats such operation with respect to the pixels 11(1) to 11(6). Accordingly, the display device 2 displays the image.

FIG. 43 illustrates the drive operation with respect to the pixels 11 that belong to the pixel lines L1 to L12. It is to be noted that FIG. 43 omits illustration except for the Vth correction drive D2, the write drive D3, and the light emission drive D4, for convenience of explanation. As illustrated in FIG. 43, in the period having the duration of the six horizontal periods (6H), the driver unit 30 performs the Vth correction drive D2 and the write drive D3 with respect to the pixels 11 in the following order: the pixel lines L1, L5, L3, L4, L2, and L6. In other words, the scanning ordinal numbers NS of the pixel lines L1 to L6 are respectively "1", "5", "3", "4", "2", and "6". Moreover, the driver unit 30 performs the light emission drive D4 simultaneously with respect to the pixels 11 that belong to the pixel lines L1 to L6. Likewise, in the next period having the duration of the six horizontal periods (6H), the driver unit 20M performs the Vth correction drive D2 and the write drive D3 with respect to the pixels 11 in the following order: the pixel lines L7, L11, L9, L10, L8, and L12. In other words, the scanning ordinal numbers NS of the pixel lines L7 to L12 are respectively "1", "5", "3", "4", "2", and "6". Moreover, the driver unit 30 performs the light emission drive D4 simultaneously with respect to the pixels 11 that belong to the pixel lines L7 to L12.

In the display device 2 as well, there is possibility that the intensity differs according to the pixel lines L. To be specific, in the display device 2, the length of the time between the write drive D3 and the light emission drive D4 differs. Accordingly, for example, in the pixels 11 that belong to the pixel lines L1 and L7 on which the Vth correction drive D2 and the write drive D3 are performed first, the time between the write drive D3 and the light emission drive D4 is long. During the time, the leak current of the capacitor Cs or the off leak current of the write transistor WSTr, or other factors causes possibility that the gate-source voltage Vgs of the drive transistor DRTr is lowered from the voltage corresponding to the pixel voltage Vsig(1), contributing to the decrease in the intensity. However, in the display device 2, as with the display device 1 according to the first embodiment, the write drive D3 is performed in the scanning order in which the sum S of the scanning ordinal numbers NS of any two adjacent pixel lines L approximates to the predetermined value. This makes it possible to enhance the spatial frequency fs in the intensity distribution in the scanning direction. Hence, it is possible to enhance the image quality.

In this embodiment, the write drive is performed in the scanning order in which the sum of the scanning ordinal numbers of any two adjacent pixel lines approximates to the predetermined value. Hence, it is possible to enhance the image quality even in a case where the Vth correction drive and the write drive are sequentially performed with respect to the plurality of (e.g., six) pixel lines, and the light emission drive is performed simultaneously.

Modification Example 2

Each of the modification examples of the forgoing first embodiment may be applied to the display device 2 according to the forgoing embodiment.

3. Application Examples

Description is given next of application examples of the display devices described in the forgoing embodiments and modification examples.

FIG. 44 illustrates an external appearance of a television device to which the display devices according to the forgoing example embodiments are applied. The television device includes, for example, a picture display screen unit 510 including a front panel 511 and a filter glass 512. The picture display screen unit 510 is constituted by the display devices according to the forgoing example embodiments.

The display devices according to the forgoing example embodiments may be applied to electronic apparatuses in various fields, in addition to the television device. Examples include a digital camera, a notebook personal computer, a mobile terminal device such as a mobile phone, a portable game machine, and a video camera. In other words, the display devices according to the forgoing example embodiments may be applied to the electronic apparatuses in various fields that display pictures. Applying the display devices according to the forgoing example embodiments to the electronic apparatuses as mentioned above makes it possible to enhance the image quality.

Although description has been made by giving the embodiments and the modification examples, and their specific applied examples and the application examples to the electronic apparatus as mentioned above, the contents of the technology are not limited to the above-mentioned example embodiments and may be modified in a variety of ways.

For example, in the forgoing example embodiments, the organic EL element is utilized as the light emitting element 19. However, this is non-limiting. Any current drive display element may be utilized.

It is to be noted that effects described herein are merely exemplified. Effects of the technology are not limited to the effects described herein. Effects of the technology may further include other effects than the effects described herein.

Moreover, the technology may have the following configurations.

(1) A display device, including:

a plurality of pixels; and a driver unit that makes scanning of pixels that belong to a plurality of pixel lines out of the plurality of pixels, in units of pixel line groups each of which is constituted by a predetermined number of the pixel lines, in a scanning order indicated by scanning ordinal numbers associated with the respective pixel line groups, to perform a write drive that includes writing a pixel voltage to each pixel, the scanning ordinal numbers being set to allow a sum of the scanning ordinal numbers of any two adjacent pixel line groups to approximate to a predetermined value.

(2) The display device according to (1), in which the driver unit performs the write drive, after collectively performing a preparatory drive, with respect to the pixels that belong to the plurality of the pixel lines.

(3) The display device according to (1) or (2), in which the driver unit makes the scanning in the scanning order, to perform the write drive and to perform a light emission drive that includes allowing each pixel to emit light on a basis of the pixel voltage.

(4) The display device according to (1) or (2), in which the driver unit collectively performs a light emission drive, after the write drive, with respect to the pixels that belong to the plurality of the pixel lines, the light emission drive including allowing each pixel to emit light.

(5) The display device according to (1), in which the driver unit makes the scanning in the scanning order, to perform a preparatory drive and the write drive, and subsequently, collectively performs the light emission drive, with respect to the pixels that belong to the plurality of the pixel lines, the light emission drive including allowing each pixel to emit light.

(6) The display device according to any one of (1) to (5), in which a sequence of the scanning ordinal numbers in the N pixel lines is a first sequence, a second sequence, a third sequence, or a fourth sequence of ordinal numbers NS, the first sequence of the ordinal numbers NS being given with utilization of Expression (1) below if N is an even number, or with utilization of Expression (2) below if N is an odd number, with i sequentially varied from 1 to N, the second sequence being in reverse to the first sequence, the third sequence being given with a predetermined number of the ordinal numbers from a head of the first sequence and remaining ordinal numbers changed over, and the fourth sequence being in reverse to the third sequence.

[Expression 1]

$$NS(i) = \begin{cases} i & \left(i\text{: ODD NUMBER}, i \leqq \frac{N}{2}\right) \\ N - i + 1 & \left(i\text{: EVEN NUMBER}, i \leqq \frac{N}{2}\right) \\ N - i + 1 & \left(i\text{: ODD NUMBER}, i > \frac{N}{2}\right) \\ i & \left(i\text{: EVEN NUMBER}, i > \frac{N}{2}\right) \end{cases} \quad (1)$$

-continued

[Expression 2]

$$NS(i) = \begin{cases} i & (i\text{: ODD NUMBER}) \\ N - i + 1 & (i\text{: EVEN NUMBER}) \end{cases} \quad (2)$$

(7) The display device according to any one of (1) to (6), in which the plurality of the pixel lines includes an even number of the pixel lines.

(8) The display device according to any one of (1) to (5), in which the scanning order is a random scanning order.

(9) The display device according to any one of (1) to (8), in which the driver unit changes the scanning order for each frame.

(10) The display device according to (9), in which the scanning order in any one frame is a scanning order in reverse to the scanning order in a frame preceding the relevant one frame.

(11) The display device according to any one of (1) to (8), in which the driver unit makes, in each frame, the scanning of the pixels that belong to the plurality of the pixel lines, in a same scanning order.

(12) The display device according to any one of (1) to (11), in which the predetermined number of the pixel lines includes a single pixel line.

(13) The display device according to any one of (1) to (11), in which the predetermined number of the pixel lines includes a plurality of the pixel lines.

(14) The display device according to any one of (1) to (13), in which each pixel includes:

a light emitting element;

a drive transistor that includes a gate and drives the light emitting element;

a capacitor coupled to the gate of the drive transistor; and a write transistor that is turned on to set the pixel voltage to the capacitor, in the write drive.

(15) The display device according to any one of (1) to (14), in which the driver unit make sequential scanning of the plurality of the pixels on the plurality-of-pixel-line basis, while performing the write drive with respect to the pixels that belong to the plurality of the pixel lines.

(16) A display device, including:

a plurality of pixels; and a driver unit that makes scanning of pixels that belong to a plurality of pixel lines out of the plurality of pixels, in units of pixel line groups each of which is constituted by a predetermined number of the pixel lines, in a scanning order indicated by scanning ordinal numbers associated with the respective pixel line groups, to perform a write drive that includes writing a pixel voltage to each pixel, the scanning ordinal numbers being set to allow a component at a high spatial frequency to become larger, in a sequence of the scanning ordinal numbers of the respective pixel line groups.

(17) A drive circuit, including a driver unit that makes scanning of pixels that belong to a plurality of pixel lines, in units of pixel line groups each of which is constituted by a predetermined number of the pixel lines, in a scanning order indicated by scanning ordinal numbers associated with the respective pixel line groups, to perform a write drive that includes writing a pixel voltage to each pixel, the scanning ordinal numbers being set to allow a sum of the scanning ordinal numbers of any two adjacent pixel line groups to approximate to a predetermined value.

(18) A driving method, including:

setting scanning ordinal numbers of a plurality of respective pixel line groups, the plurality of pixel line groups being each constituted by a predetermined number of pixel lines, and the scanning ordinal numbers being set to allow a sum of the scanning ordinal numbers of any two adjacent pixel line groups to approximate to a predetermined value; and making scanning of pixels that belong to a plurality of pixel lines, in units of the pixel line groups, in a scanning order indicated by the scanning ordinal numbers, to write a pixel voltage to each pixel, This application claims the benefit of Japanese Priority Patent Application JP2014-258526 filed on Dec. 22, 2014, the entire contents of which are incorporated herein by reference.

It should be understood by those skilled in the art that various modifications, combinations, sub-combinations and alterations may occur depending on design requirements and other factors insofar as they are within the scope of the appended claims or the equivalents thereof.

The invention claimed is:

1. A display device comprising:

display circuitry that comprises N contiguous pixel lines, N is an integer greater than 3; and driver circuitry configured to output a preparatory drive to the pixel lines in a manner that permits each of the pixel lines to simultaneously receive the preparatory drive from the driver circuitry, wherein during a horizontal period of a frame, the pixel lines are configured to receive a write drive from the driver circuitry after receiving the preparatory drive from the driver circuitry, wherein the driver circuitry is configured to output the write drive to the pixel lines in a scanning order, the scanning order is indicated by scanning ordinal numbers associated with the pixel lines, and wherein a sequence of the scanning ordinal numbers in the pixel lines is a first sequence of the ordinal numbers, a second sequence of the ordinal numbers, a third sequence of the ordinal numbers, or a fourth sequence of ordinal numbers, wherein the first sequence of the ordinal numbers is by Expression (1) when N is an even number and by Expression (2) when N is an odd number, $$NS(i) = \begin{cases} i & \left(i\text{: ODD NUMBER}, i \leqq \frac{N}{2}\right) \\ N - i + 1 & \left(i\text{: EVEN NUMBER}, i \leqq \frac{N}{2}\right) \\ N - i + 1 & \left(i\text{: ODD NUMBER}, i > \frac{N}{2}\right) \\ i & \left(i\text{: EVEN NUMBER}, i > \frac{N}{2}\right) \end{cases} \quad (1)$$

$$NS(i) = \begin{cases} i & \left(i\text{: ODD NUMBER}, i \leqq \frac{N}{2}\right) \\ N - i + 1 & \left(i\text{: EVEN NUMBER}, i \leqq \frac{N}{2}\right) \\ N - i + 1 & \left(i\text{: ODD NUMBER}, i > \frac{N}{2}\right) \\ i & \left(i\text{: EVEN NUMBER}, i > \frac{N}{2}\right) \end{cases} \quad (1)$$

wherein NS is one of the ordinal numbers, wherein i is sequentially varied from 1 to N, wherein the second sequence is in reverse to the first sequence, wherein the third sequence is given with a predetermined number of the ordinal numbers from a head of the first sequence and remaining ordinal numbers changed over, and wherein the fourth sequence is in reverse to the third sequence.

2. The display device according to claim 1, wherein the scanning order in the frame is a scanning order in reverse to a scanning order in a preceding frame, the frame occurs after the preceding frame.

3. The display device according to claim 1, wherein during the horizontal period, the pixel lines are configured to receive perform a light emission drive in a manner that permits pixels in the pixel lines to emit light.

4. The display device according to claim 1, wherein N is the number of the pixel lines that receives the preparatory drive during a horizontal period of a frame.

5. The display device according to claim 1, wherein N is 4.

6. The display device according to claim 1, wherein N is 5.

7. The display device according to claim 1, wherein N is 6.

8. The display device according to claim 1, wherein N is 7.

9. The display device according to claim 1, wherein N is 8.

10. The display device according to claim 1, wherein N is 9.

11. The display device according to claim 1, wherein N is 10.

12. The display device according to claim 1, wherein N is the number of the pixel lines that receives the write drive during the horizontal period.

* * * * *